United States Patent [19]

Fujimaki et al.

[11] Patent Number: 4,891,288

[45] Date of Patent: Jan. 2, 1990

[54] PHOTORECEPTOR FOR POSITIVE ELECTROSTATIC CHARGE

[75] Inventors: Yoshihide Fujimaki; Yasuo Suzuki; Masataka Takimoto, all of Hachioji, Japan

[73] Assignee: Konischiroku Photo Industry Co., Ltd., Tokyo, Japan

[21] Appl. No.: 163,215

[22] Filed: Feb. 24, 1988

Related U.S. Application Data

[63] Continuation of Ser. No. 765,062, Aug. 12, 1985, abandoned.

[30] Foreign Application Priority Data

Aug. 17, 1984 [JP] Japan ..... 59-171745

[51] Int. Cl.[4] ..... G03G 5/14

[52] U.S. Cl. ..... 430/58; 430/59

[58] Field of Search ..... 430/57, 58

[56] References Cited

U.S. PATENT DOCUMENTS

| | | | |
|---|---|---|---|
| 4,256,821 | 3/1981 | Enomoto | 430/59 |
| 4,327,168 | 4/1982 | Hashimoto | 430/57 |
| 4,390,608 | 6/1983 | Hashimoto | 430/57 |
| 4,476,208 | 10/1984 | Horie et al. | 430/58 |
| 4,556,621 | 12/1985 | Hoffmann et al. | 430/58 |

*Primary Examiner*—J. David Welsh

*Attorney, Agent, or Firm*—Jordan B. Bierman

[57] ABSTRACT

Disclosed is a photoreceptor for electrophotography comprising a carrier generation layer and a charge transport layer. The organic charge generating substance has, at the time of positive charging, a photosensitivity less than the photosensitivity at the time of negative charging.

9 Claims, 2 Drawing Sheets

FIG. 2

| NO | CARRIER GENERATING SUBSTANCE | CARRIER TRANSPORT SUBSTANCE | BINDER OF PHOTOSENSITIVE LAYER | THICKNESS OF CARRIER GENERATING LAYER | VA (V) | E1/2 (lux·sec) | DARK ATTENUATION RATIO (%) | IMAGE DISFIGURE CAUSED AFTER 10000 COPIES |
|---|---|---|---|---|---|---|---|---|
| EXAMPLE 1 | I-1 1.5g | II-2 4g | POLYCARBONATE (PANLIGHT L-1250) | 1μm | 890 | 1.9 | 16 | NIL |
| EXAMPLE 2 | 〃 | 〃 | 〃 | 3μm | 850 | 1.7 | 20 | 〃 |
| EXAMPLE 3 | 〃 | 〃 | 〃 | 10μm | 980 | 1.5 | 28 | 〃 |
| EXAMPLE 4 | I"-7 1.5g | II-74 4g | 〃 | 1μm | 830 | 1.8 | 23 | 〃 |
| EXAMPLE 5 | 〃 | 〃 | 〃 | 3μm | 795 | 1.7 | 25 | 〃 |
| EXAMPLE 6 | 〃 | 〃 | 〃 | 10μm | 980 | 1.6 | 32 | 〃 |
| EXAMPLE 7 | II-4 1.5g | IV-13 4g | 〃 | 5μm | 750 | 2.8 | 32 | 〃 |
| EXAMPLE 8 | I'-8 1.5g | V-11 4g | 〃 | 〃 | 880 | 1.8 | 21 | 〃 |
| EXAMPLE 9 | I'-5 1.5g | VII-75 4g | 〃 | 〃 | 950 | 1.6 | 19 | 〃 |
| EXAMPLE 10 | I-4 1.5g | VII-22 4g | 〃 | 〃 | 1050 | 1.8 | 21 | 〃 |
| COMPARATIVE EXAMPLE 1 | I-1 1.5g | III-2 4g | 〃 | 0.5μm | 1030 | 2.2 | 12 | YES |
| COMPARATIVE EXAMPLE 2 | I-1 1.5g | II-2 4g | 〃 | 0.8μm | 950 | 2.0 | 14 | 〃 |
| COMPARATIVE EXAMPLE 3 | I"-7 1.5g | II-74 4g | 〃 | 0.5μm | 880 | 2.0 | 18 | 〃 |
| COMPARATIVE EXAMPLE 4 | I"-7 1.5g | II-74 4g | 〃 | 0.8μm | 850 | 1.9 | 20 | 〃 |

* THE SAME BINDER IS USED IN EITHER CASES OF CARRIER GENERATING LAYER AND CARRIER TRANSPORT LAYER.

PHOTORECEPTOR FOR POSITIVE ELECTROSTATIC CHARGE

This application is a continuation of application Ser. No. 765,062, filed Aug. 12, 1985, now abandoned.

BACKGROUND OF THE INVENTION

The invention relates to a photoreceptor for positive electrostatic charge such as an electrophotographic photoreceptor for positive electrostatic charge.

Heretofore, as for the electrophotographic photoreceptors, there have so far popularly been used an inorganic photoreceptor bearing thereon a photosensitive layer mainly comprising such an inorganic photoconductive substance as selenium, zinc oxide, cadmium sulfide and the like.

On the other hand, in the recent years, it has been positively developed and researched to utilize a variety of organic photoconductive substance for the materials of the photosensitive layers of such electrophotographic photoreceptors.

For example, Japanese Patent Examined Publication No. 10496/1975 describes organic photoreceptors bearing thereon a photosensitive layer containing poly-N-vinyl carbazole and 2,4,7-trinitro-9-fluorenone. However, this photoreceptor is not always satisfactory because of its sensitivity and durability. With the purpose of improving such faults, there are attempts to develop organic photoreceptors having a high sensitivity and an increased durability in such a manner that, in a photosensitive layer, a carrier generating function and a carrier transport function are alloted separately to the different substances. In the so-called function separation type electrophotographic photoreceptors such as mentioned above, the substances capable of displaying each of the function may be selected from a wide range of substances. It is, therefore, relatively easy to make an electrophotographic photoreceptor having any desired characteristics.

Many substances have so far been proposed to serve as the carrier generating substances capable of being effectively used in such function separation type electrophotographic photoreceptors. Examples of those using an inorganic substance include amorphous selenium, as described in Japanese Patent Examined Publication No. 16198/1968, which is used in combination with an organic carrier transporting substance.

There has also been proposed many electrophotographic photoreceptors each having used an organic dyestuff or an organic pigment to serve as the carrier generating substances thereof. They include, for example, those having a photosensitive layer containing a bisazo compound, which have already known in Japanese Patent Publication Open to Public Inspection Nos. 37543/1972, 22834/1980, 79632/1979, 116040/1981 and the like.

Well-known photoreceptors using an organic photoconductive substance are normally used for negative electrostatic charge. The reason thereof is that they are advantageous in photosensitivity and the like because the hole mobility of carriers is great when an electrostatic charge is negative.

In the use of such a negative charge, it is verified that there are the following problems. Namely, taking precedence of all other problems, there is such a problem first that ozone is apt to produce in atmosphere when a negative charge is applied by an electric charge, so that the environmental conditions may be worsened. One of the other problelms is that toners of positive polarity are required to use in the development of a photoreceptor for negative electrostatic charge and the toners of positive polarity can hardly be prepared from the viewpoint of triboelectrification series to ferromagnetic carrier particles.

It is, accordingly, proposed to use a photoreceptor using an organic photoconductive substance with a positive charge. For example, in the case of a photoreceptor for positive electrostatic charge in which a carrier transport layer is laminated on a carrier generation layer and the carrier transport layer is formed of a substance having a relatively great electron transport function, the carrier transport layer has to contain trinitrofluorenone or the like which is, however, not suitable for use because this substance is carcinogenic. On the other hand, it may be possible to use a photoreceptor for positive electrostatic charge, which is prepared by laminating a carrier generation layer on a carrier transport layer having a relatively great hole transport function. With this photoreceptor, however, there is an extremely thin carrier generation layer on the surface of the photoreceptor, therefore the printing resistance and the like are deteriorated and the layer arrangement thereof is not suitable for practical use.

U.S. Pat. No. 3,615,414 indicates a photoreceptor for positive charge containing a thiapyrylium salt, i.e., the carrier generating substance, so as to form an eutectic complex with polycarbonate, i.e., the binder resin. In the well-known photoreceptor, there are the faults that a memory phenomenon is relatively serious and ghosts are apt to cause. U.S. Pat. No. 3,357,989 also indicates a photoreceptor containing phthalocyanine. However, phthalocyanine is varied in its characteristics because of the crystal systems and besides the crystal systems are to be strictly controlled, and further not only the sensitivity in short wavelength is not enough but also the memory phenomenon is serious, therefore, such a photoreceptor is not suitably used with a copying apparatus using a light source having a wavelength region of visible light.

As it has so far been, the photoreceptors using an organic photoconductive substance have been scarcely ever feasible of using for positive electrostatic charge, therefore they have so far been used solely for negative charge.

SUMMARY OF THE INVENTION

It is according by a primary object of the invention to provide a photoreceptor which is constituted suitably for positive electrostatic charge and in particular excellent in dispersibility or distribution of the carrier generating substance thereof and further capable of reducing memory phenomena, stabilizing the residual potential and improving the printing resistance thereof, and still further capable of forming excellent visible images without fail.

BRIEF DESCRIPTION OF THE DRAWINGS

The drawings illustrate the example of the invention.

FIG. 2 is a drawing illustrating the characteristic variations according to the constitutions of each electrophotographic receptor;

DETAILED DESCRIPTION OF THE INVENTION

Figure 1:
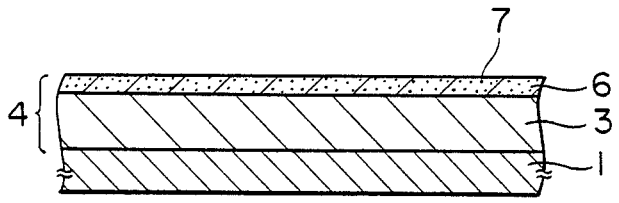
FIG. 1 is a cross section of a portion of each example of the electrophotographic photoreceptor.

Photoreceptors of the invention are a photoreceptor for positive electrostatic charge characterized in bearing on the surfce thereof a carrier generation layer comprising a particulate carrier generating substance having a substantially higher photosensitivity at the time of negative electrostatic charge than at the time of positive electrostatic charge, a carrier transporting substance and a binder substance, and beneath the carrier generation layer, a carrier transport layer comprising a carrier transporting substance and a binder substance, and in having a thickness of the carrier generating layer of at least 1 μm.

According to the invention, the carrier generation layer is prepared by solidifying both of the particulate carrier generating substance and the carrier transporting substance with the binder substance, so that the printing resistance and the like can be excellent and at the same time memory phenomena can be reduced and residual potential can also be stabilized because the carrier generating substance is particulate, that is dispersed in the form of pigment in the layer. In addition, the particulate carrier generating substance is required to have enough electron transport function within the layer. In other words, when using as a photoreceptor for positive electrostatic charge comprising a mixed phase type photosensitive layer containing the above-mentioned carrier generating substance and carrier transporting substance irradiated with light, it shows a tendency that the surface positive potential is decreased to some extent but not satisfactorily decreased more than that extent. In the invention, there uses such a carrier generating substance that, when negatively charging a photoreceptor bearing an independant photosensitive layer, the electron mobility is relatively faster than when positively charging the photoreceptor (i.e., the photosensitivity thereof is higher when negatively charging than when positively charging), the electrons produced by irradiating with light the positively charged photoreceptor bearing the above-mentioned mixed phase photosensitive layer will move at a high speed to the surface of the photoreceptor. Thereby the surface positive potential thereof will satisfactorily be decreased, i.e., the photosensitivity can be improved and the residual potential will also be reduced. On the other hand, the carrier transport substances used in the invention have such a characteristic that the holl mobilization can easily be made. It is, therefore, realized to use the photoreceptors positively charged, provided that characteristics of the above-mentioned carrier generating substance are utilized in combination and the sublayered carrier transport layer is provided.

Also, according to the invention, it is very essential that the thickness of the above-mentioned carrier generating layer provided onto the surface is to be at least 1 μm and more desirably not less than 3 μm. In other words, if the thickness of such potential generation layer is thinner than 1 μm, the surface thereof will receive a mechanical damage caused according to how to develop and to clean when operating repeatedly. For example, a portion of the layer is shaved off or black streaks are produced on an image. It is, therefore, inevitable to make the thickness of the layer be not thinner than 1 μm. However, if the thickness of such potential generation layer is made too thicker, say, not thinner than 10 μm, thermally excited carriers generated is increased in number and the receptive potential will be lowered with raising a circumstantial temperature and further the density in an image area will also be apt to lower. In addition, if irradiating a light having a longer wavelength than that of the absorption edge of the carrier generating substance, the photo-carriers are generated even in the vicinity of the lowermost portion of the potential generation layer. In this case, the electrons will have to move up to the surface of the layer. It will, therefore, develop a general tendency to hardly obtain a satisfactory transport function. Accordingly, when operating repeatedly, the residual potential is apt to raise.

From the above-mentioned point of view, the thickness of such potential generation layer ought to be not thinner than 1 μm, and desirably not thicker than 10 μm.

In the meantime, the thickness of the aforementioned potential transport layer is preferably between not thinner than 5 μm and not thicker than 50 μm, and more preferably between not thinner than 5 μm and not thicker than 30 μm.

The ratio of the thickness of the carrier generation layer to that of the carrier transport layer is preferably 1:(1~30).

In the invention, the carrier generation layer is formed in such a constitution that a carrier generating substance is dispersed in the form of particles (as a pigment) in a layer prepared by solidifying a carrier transporting substance with a binder substance. Wherein, the average particle size of the carrier generating substance is particularly desired to be not larger than 2 μm and more desirably not larger than 1 μm. Because, if the average particle size thereof is too large, the dispersibility is deteriorated and the particles will cohere to be localized and further extra toners will adhere to the localized areas, so that the so-called toner filming phenomena are apt to cause.

In the invention, a charge transfer complex is formed if an electron receptive substance or Lewis acid is added in a photosensitive layer, therefore the sensitization effect can be more improved.

The carrier generating substances capable of being used in the invention preferably include, for example, azo compounds represented by the following formulas [I]:

Formula [I]:

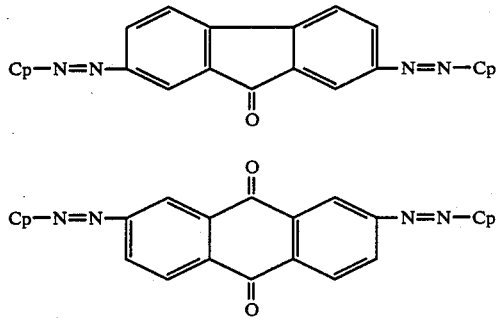

-continued

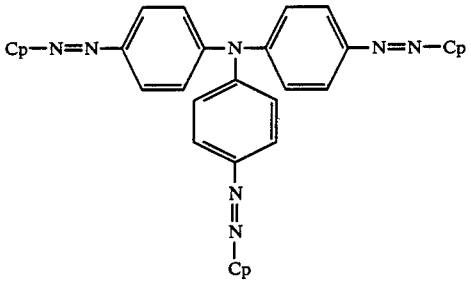

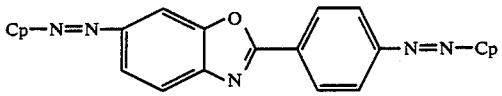

$Cp-N=N-Ar_1-CH=CH-Ar_2-N=N-Cp$ $Cp-N=N-Ar_1-CH=CH-Ar_2-CH=CH-Ar_3-N=N-Cp$

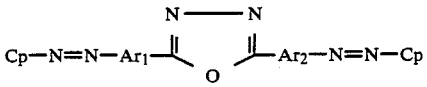

Wherein, $Ar_1$, $Ar_2$ and $Ar_3$ each represent a substituted or unsubstituted carbocyclic compounds, respectively; Cp is

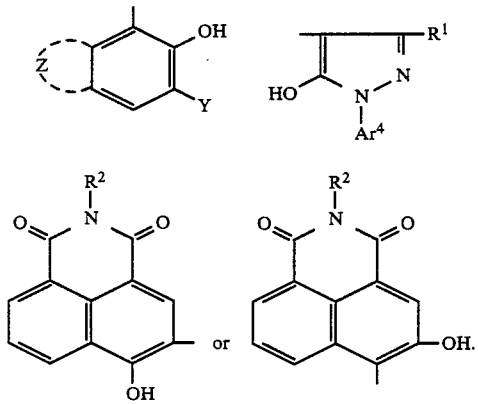

wherein Z is a group of atoms necessary for forming a substituted or unsubstituted aromatic carbocyclic ring or a substituted or unsubstituted aromatic heterocyclic ring; Y is hydrogen, a hydroxyl group, carboxyl group or any of the ester groups thereof, a sulfo group, a substituted or unsubstituted carbamoyl group, or a substituted or unsubstituted sulfamoyl group; $R^1$ is hydrogen, a substituted or unsubstituted alkyl group, a substituted or unsubstituted amino group, a substituted or unsubstituted carbamoyl group, a carboxyl group or any of the ester groups thereof, or a cyano group; $Ar^4$ is a substituted or unsubstituted aryl group; and $R^2$ is a substituted or unsubstituted alkyl group, a substituted or unsubstituted aralkyl group, or substituted or unsubstituted aryl group.

It is also possible to use any azo pigments represented by the following formulas [I'] and [I'']:

Formula [I']

$A-N=N-Ar^5-N=N-Ar^6-N=N-A$ $A-N=N-Ar^5-N=N-Ar^6-N=N-Ar^7-N=N-A$

Wherein, $Ar^5$, $Ar^6$ and $Ar^7$ are a substituted or unsubstituted carbocyclic aromatic ring group; A is

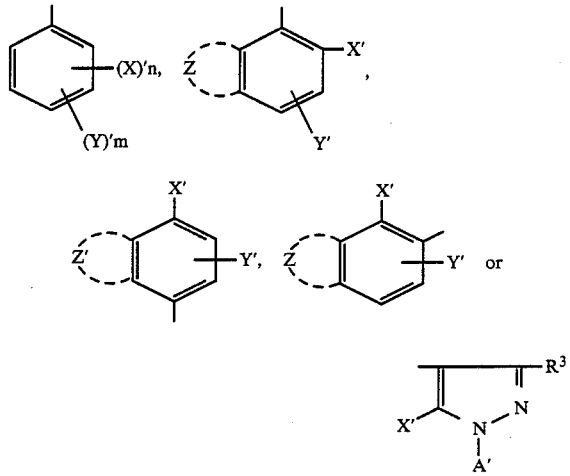

wherein

X' is a hydroxy group,

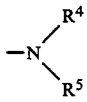

or $-NHSO_2-R^6$, wherein $R^4$ and $R^5$ are hydrogen, or a substituted or unsubstituted alkyl group; and $R^6$ is a substituted or unsubstituted alkyl group or a substituted or unsbstituted aryl group, Y' is hydrogen, a halogen, a substituted or unsubstituted alkyl group, an alkoxy group, a carboxy group, a sulfo group, a substituted or unsubstituted carbamoyl group, or a substituted or unsubstituted sulfamoyl group, in which if m represents not less than two the groups are allowed to be different from each other;

Z' is a group of atoms necessary for forming a substituted or unsubstituted carbocyclic aromatic ring or a substituted or unsubstituted heterocyclic aromatic ring; $R^3$ is a hydrogen, a substituted or unsubstituted amino group, a substituted or unsubstituted carbamoyl group, or a carboxyl group or any of the ester groups thereof;

A' is a substituted or unsubstituted aryl group;

n is an integer of one or two; and m is an integer of from zero to four.

Formula [I'']:

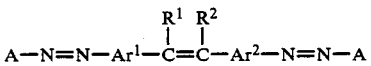

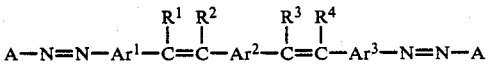

-continued

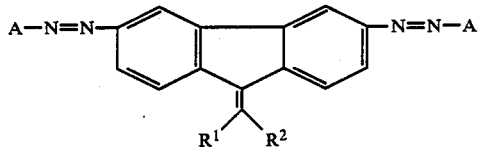

Wherein, $Ar^1$, $Ar^2$ and $Ar^3$ each are a substituted or unsubstituted carbocyclic aromatic ring group; $R^1$, $R^2$, $R^3$ and $R^4$ each are an electron withdrawing group or hydrogen, and at least one of the $R^1$ through $R^4$ is an electron withdrawing group such as a cyano group;

A is

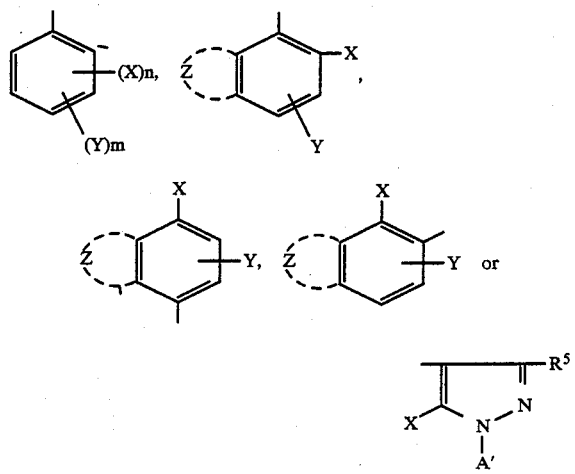

wherein,

X is a hydroxy group,

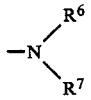

or —$NHSO_2$—$R^8$ provided that $R^6$ and $R^7$ each are hydrogen, or a substituted or unsubstituted alkyl group and $R^8$ is a substituted or unsubstituted alkyl group or a substituted or unsubstituted aryl group;

Y is hydrogen, a halogen, a substituted or unsubstituted alkyl group, an alkoxy group, a carboxyl group, a sulfo group, a substituted or unsubstituted carbamoyl group or a substituted or unsubstituted sulfamoyl group, in which if m represents not less than two the groups are allowed to be different from each other;

Z is a group of atoms necessary for forming a substituted or unsubstituted carbocyclic aromatic ring or a substituted or unsubstituted heterocyclic aromatic ring;

$R^5$ is hydrogen, a substituted or unsubstituted amino group, a substituted or unsubstituted carbamoyl group, or a carboxyl group or any of the ester group thereof;

A′ is a substituted or unsubstituted aryl group;

n is an integer of one or two; and m is an integer of from zero to four.

The typical examples of the above-described azo compounds represented by Formulas [I] and azo pigments represented by Formulas [I′] and [I″] include the following ones:

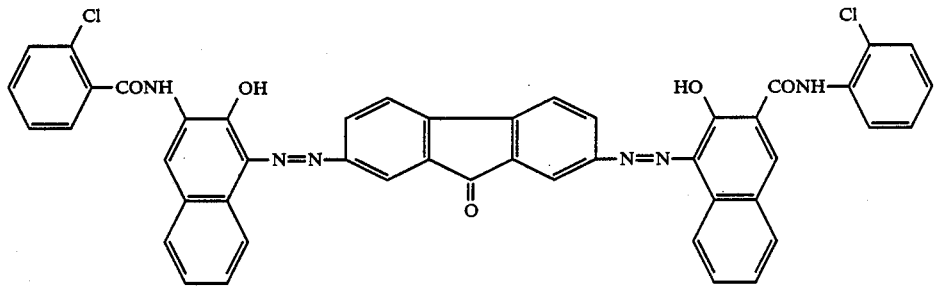

(I-1)

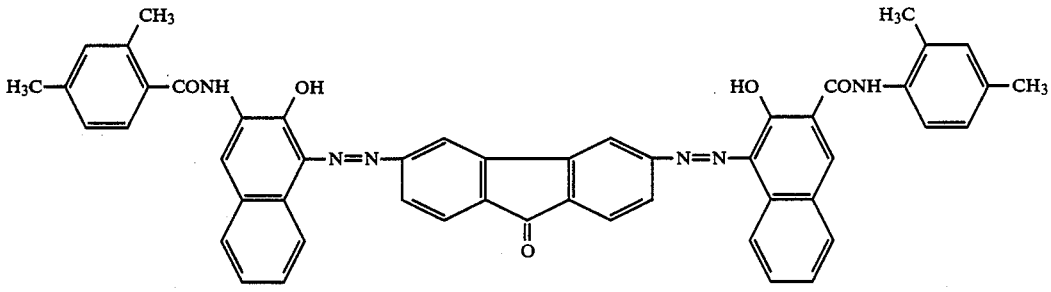

(I-2)

-continued
(I-3)
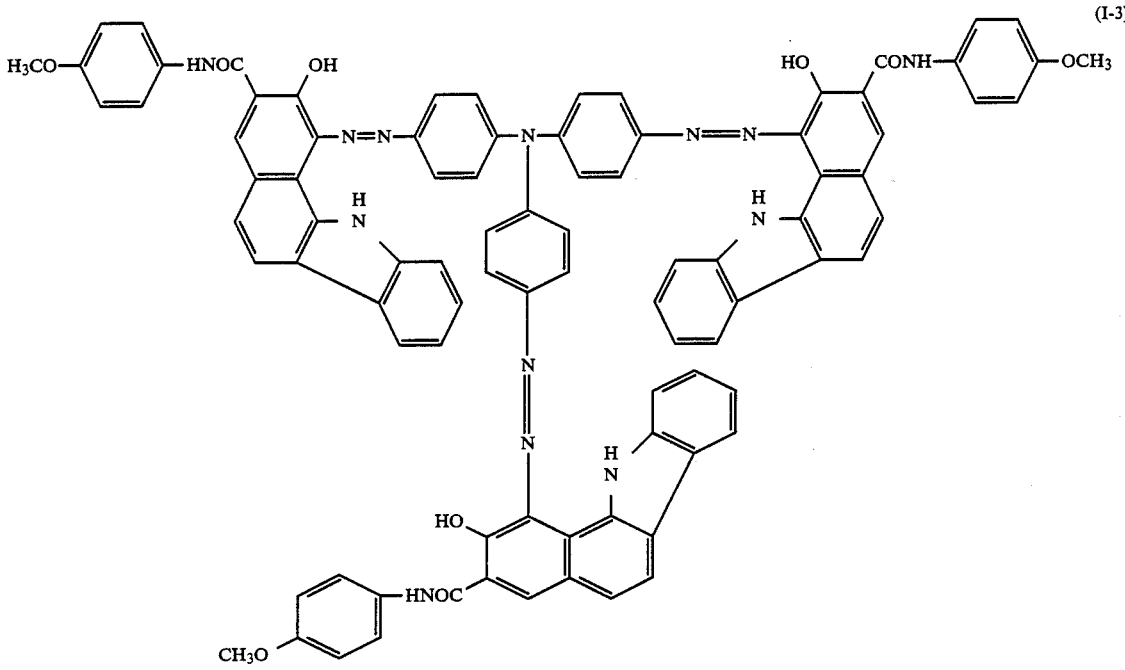
(I-4)
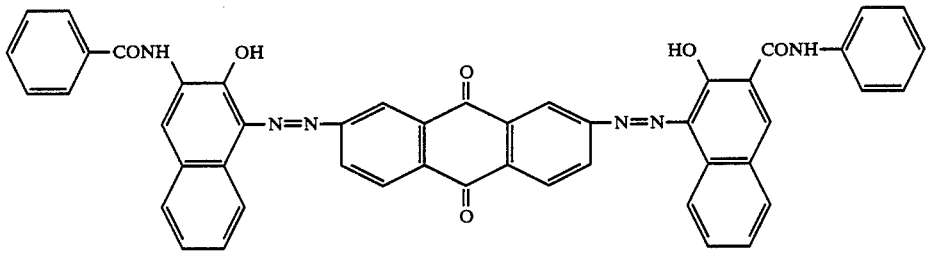
(I-5)
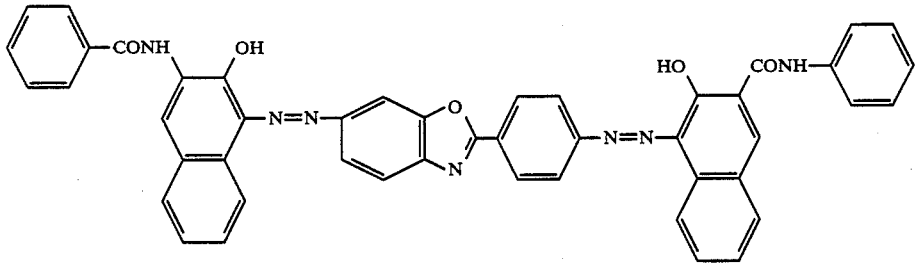
(I-6)
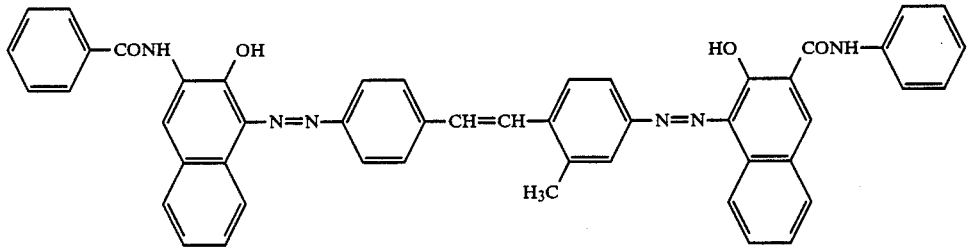

-continued
(I-7)
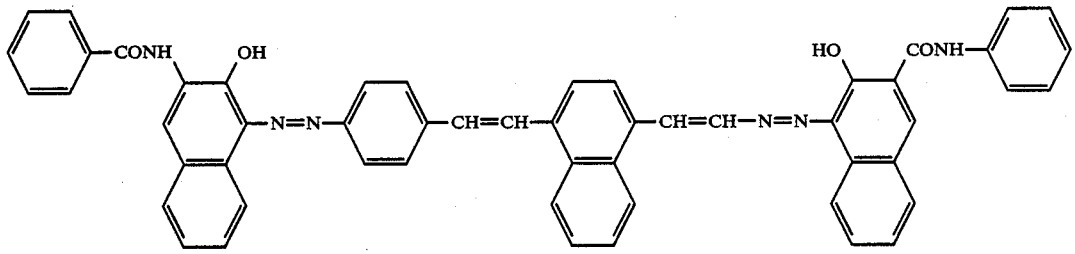
(I-8)
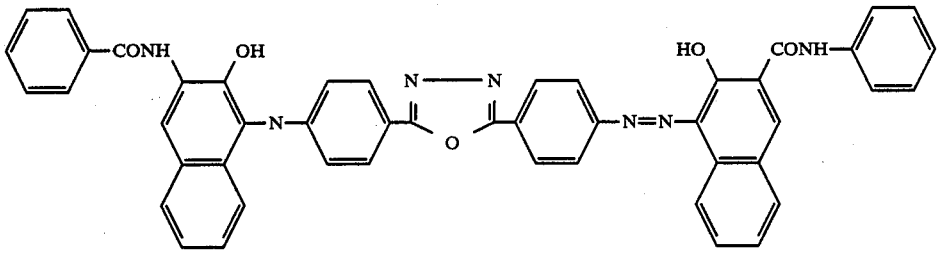
(I'-1)
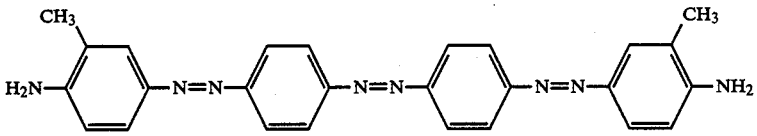
(I'-2)
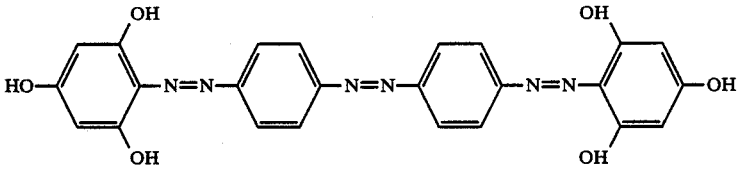
(I'-3)
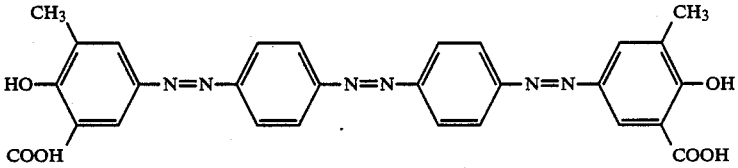
(I'-4)
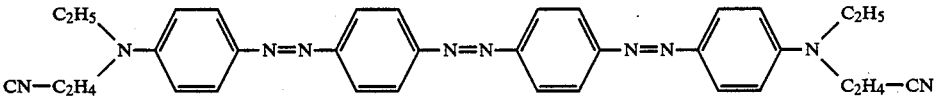
(I'-5)
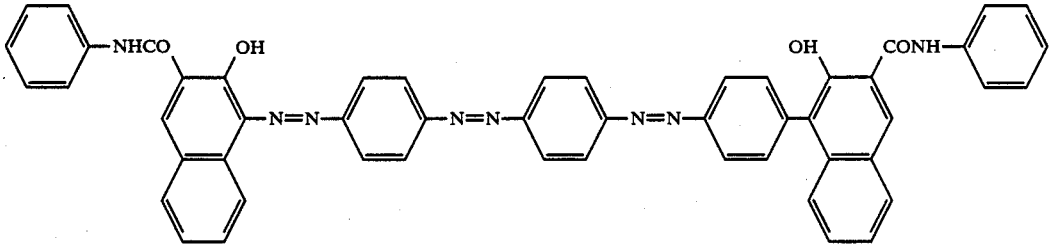

-continued
(I'-6)
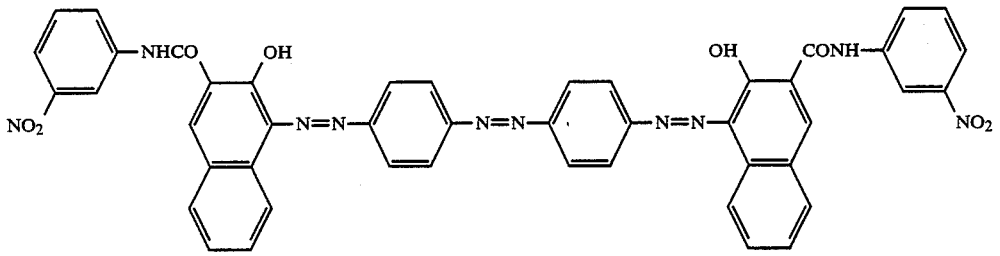
(I'-7)
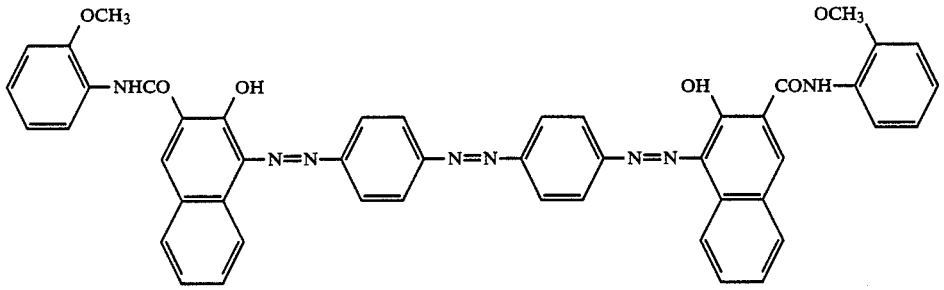
(I'-8)
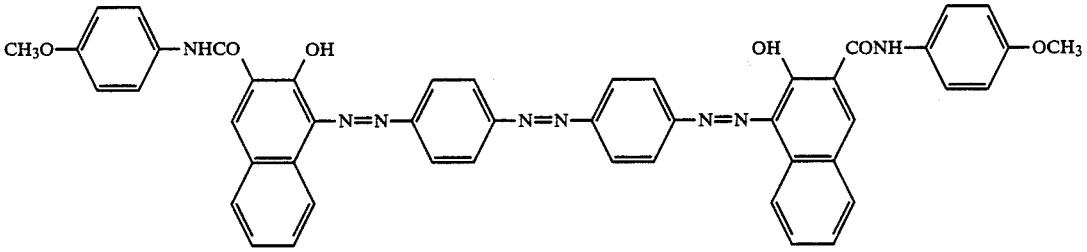
(I'-9)
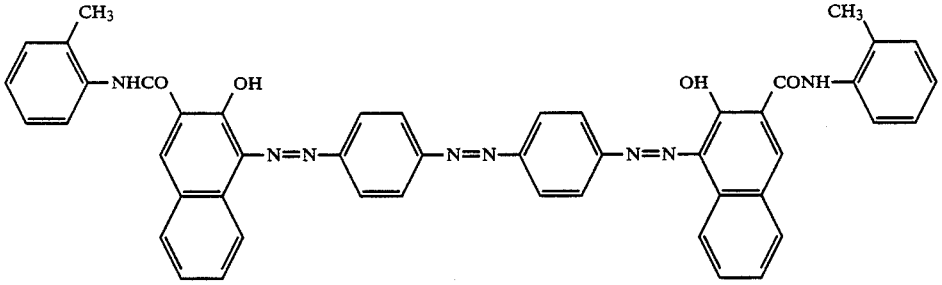
(I'-10)
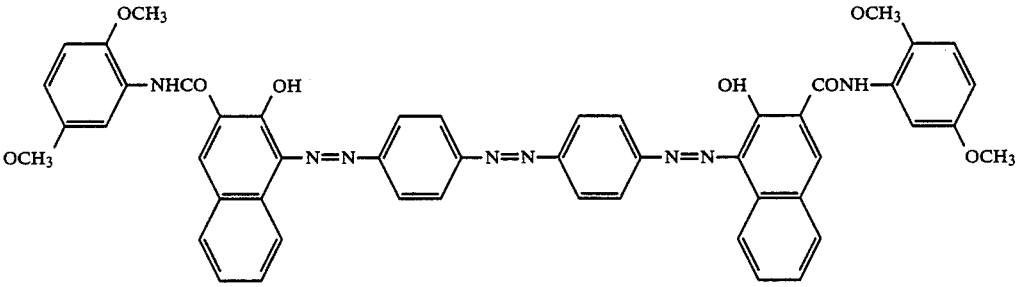

-continued
(I'-11)
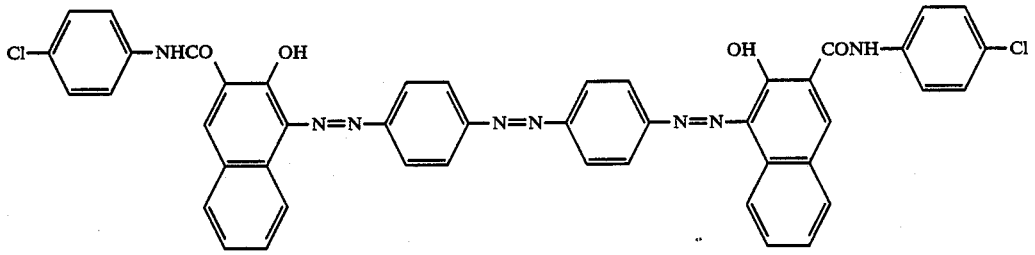
(I'-12)
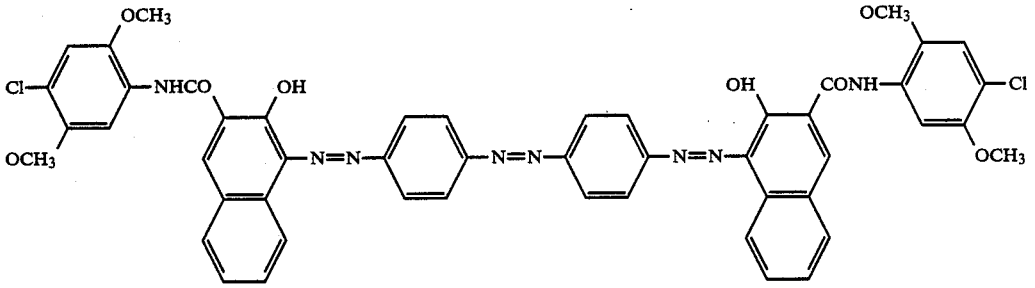
(I'-13)
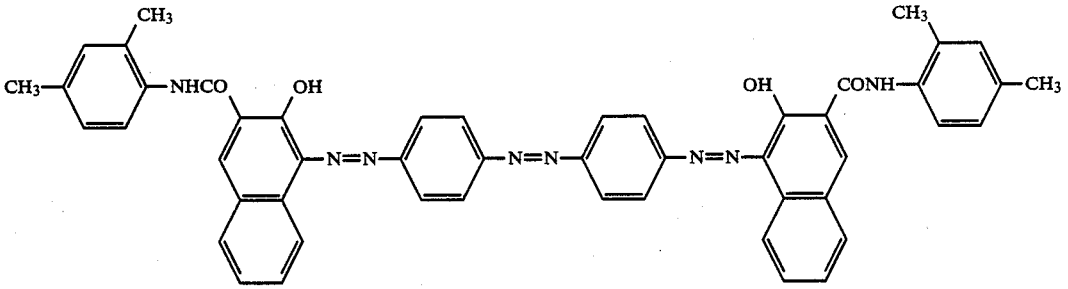
(I'-14)
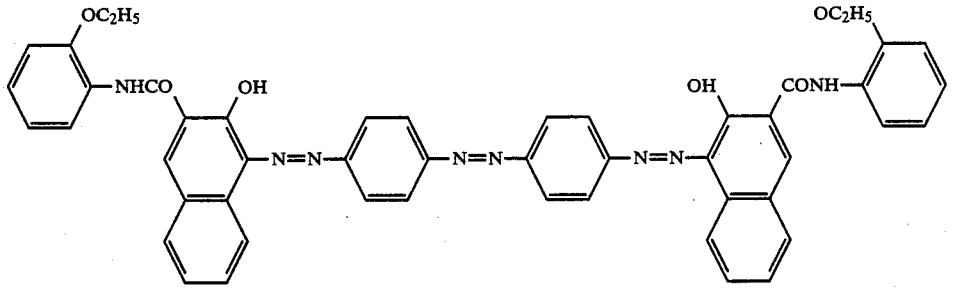
(I'-15)
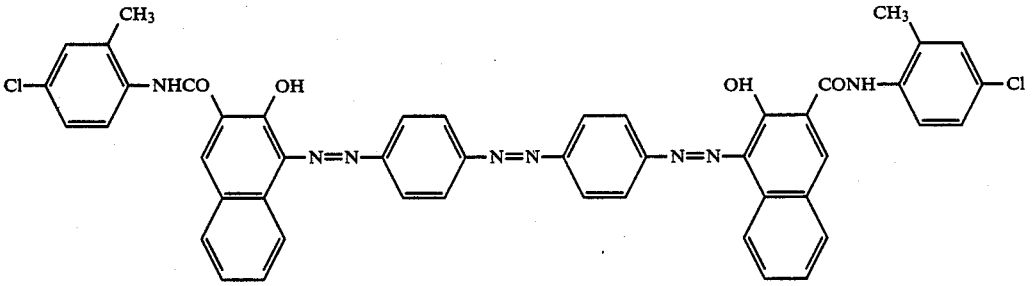

-continued
(I'-16)
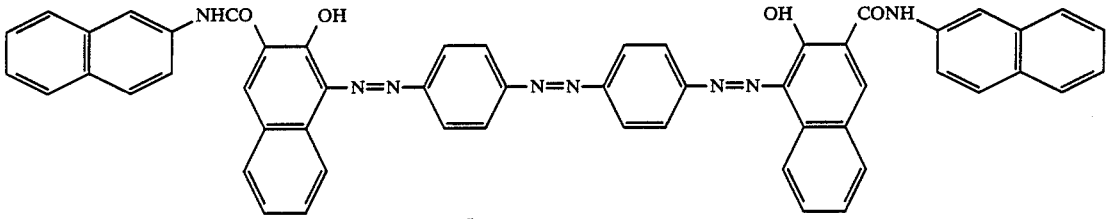
(I'-17)
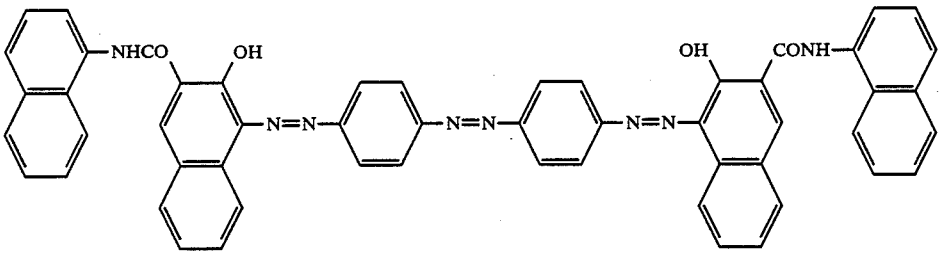
(I'-18)
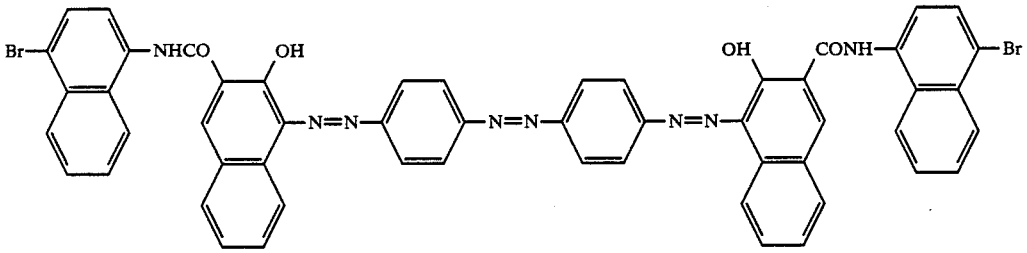
(I'-19)
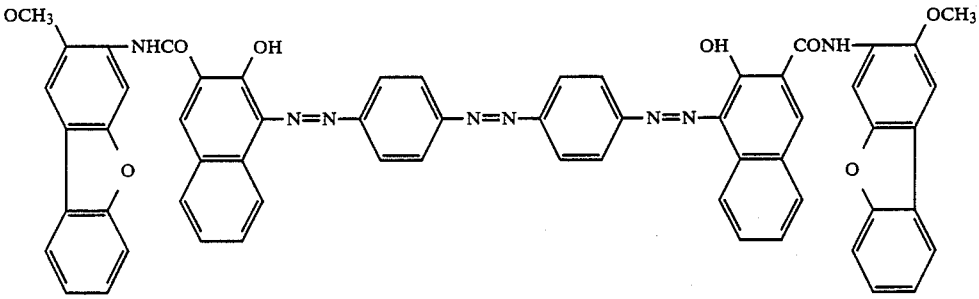
(I'-20)
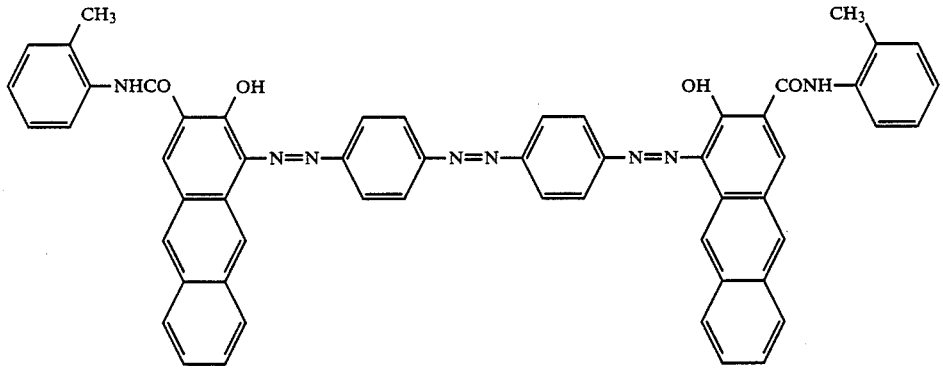

-continued
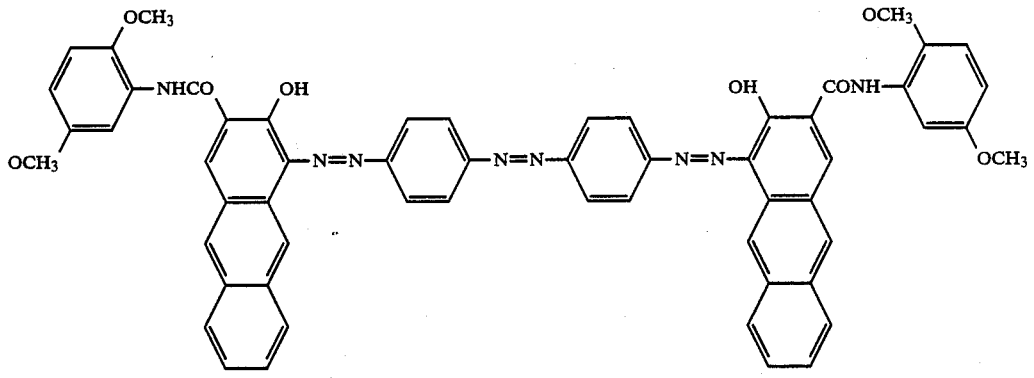
(I'-21)
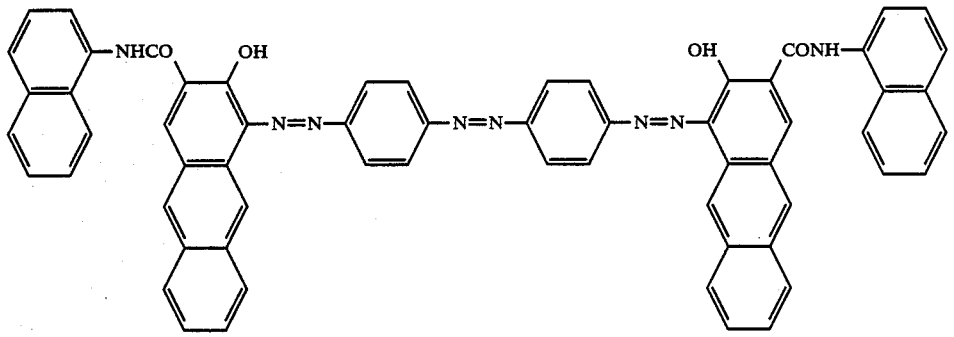
(I'-22)
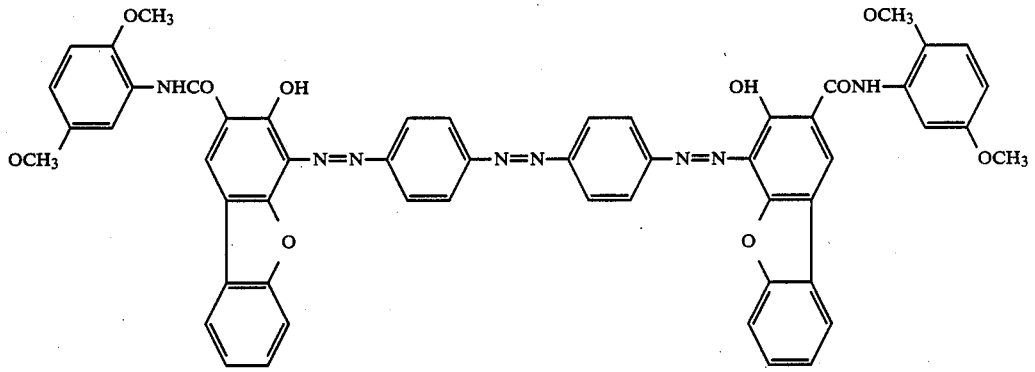
(I'-23)
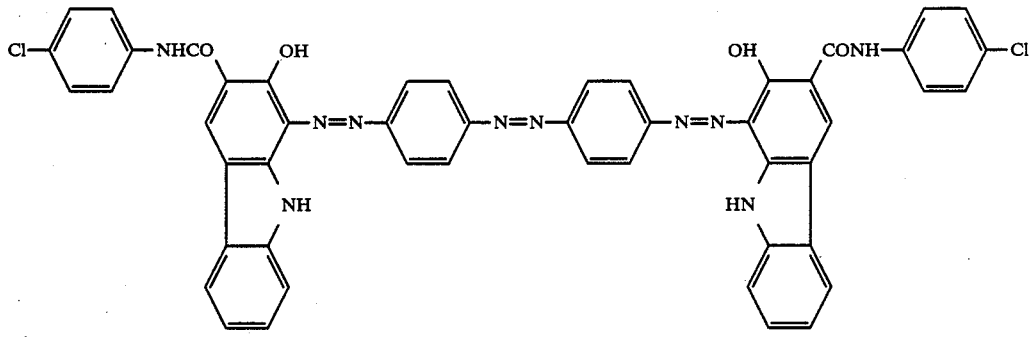
(I'-24)

-continued
(I'-25)
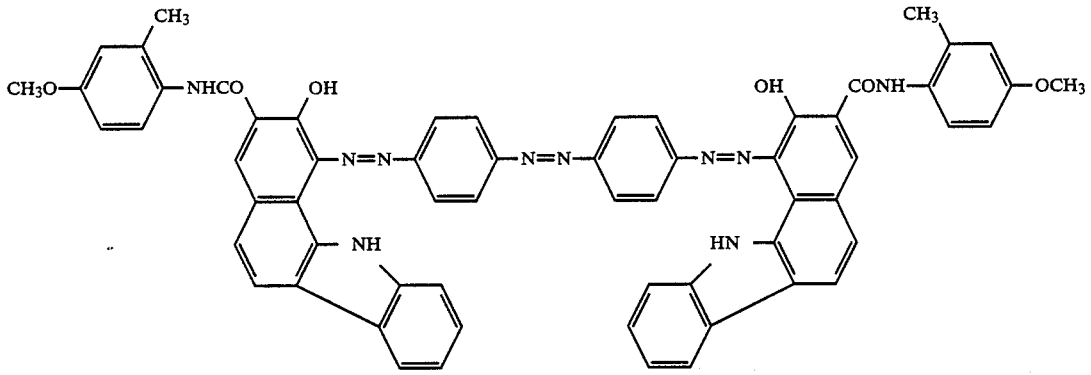
(I'-26)
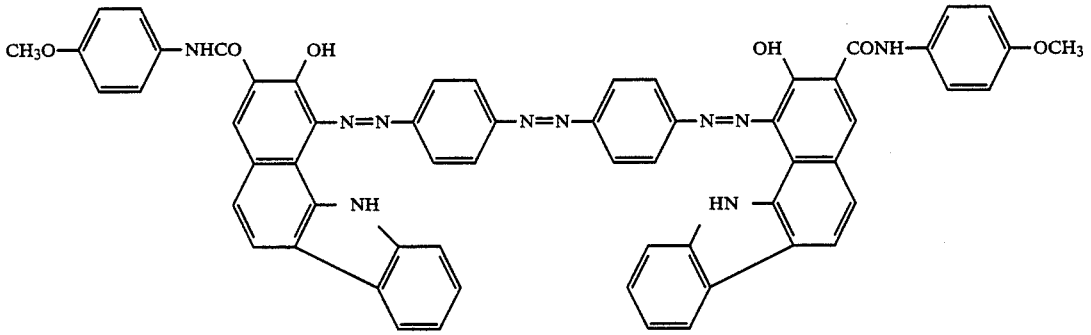
(I''-1)
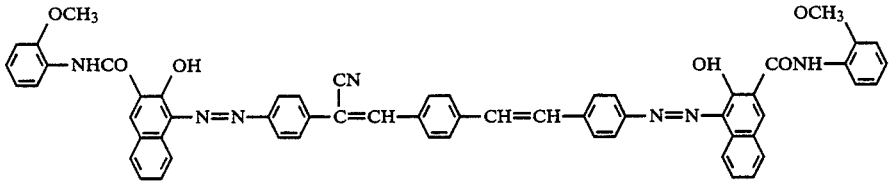
(I''-2)
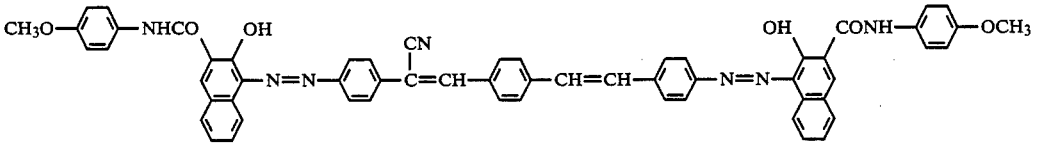
(I''-3)
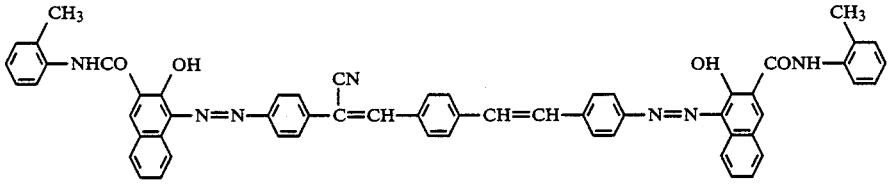
(I''4)
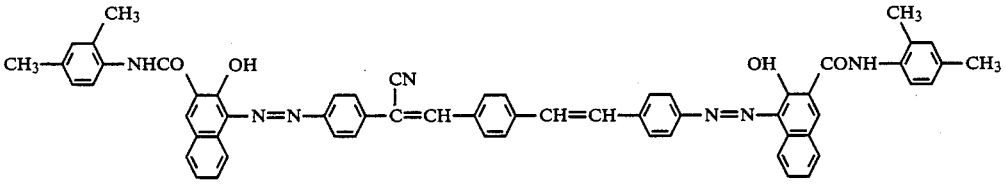

-continued
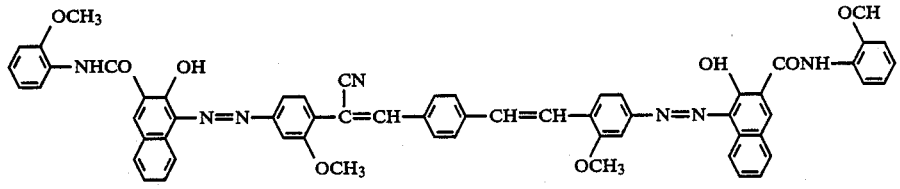
(I''-5)
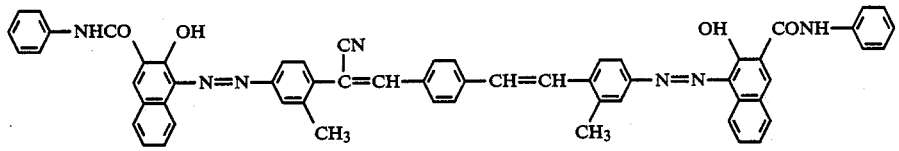
(I''-6)
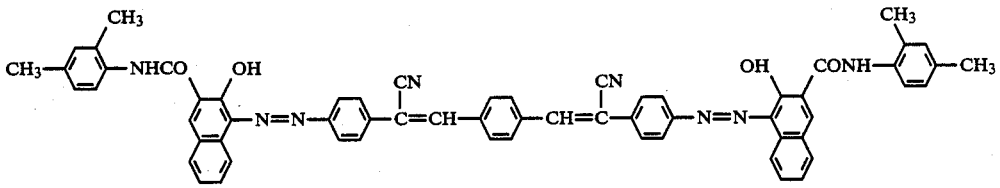
(I''-7)
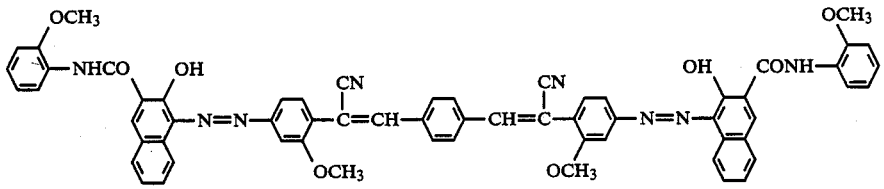
(I''-8)
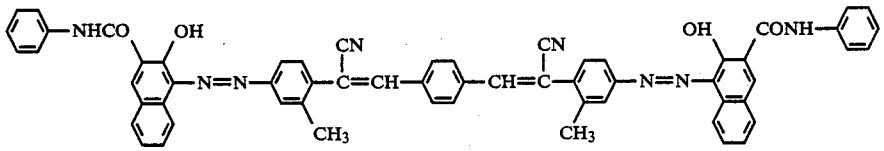
(I''-9)
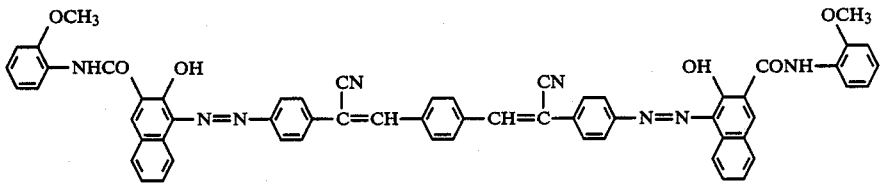
(I''-10)
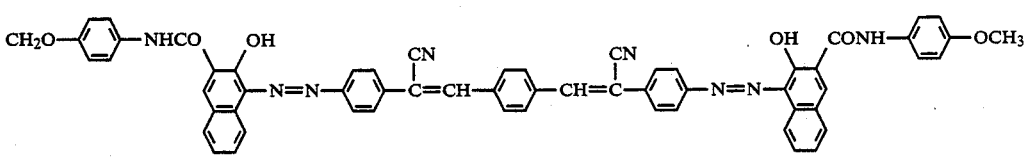
(I''-11)
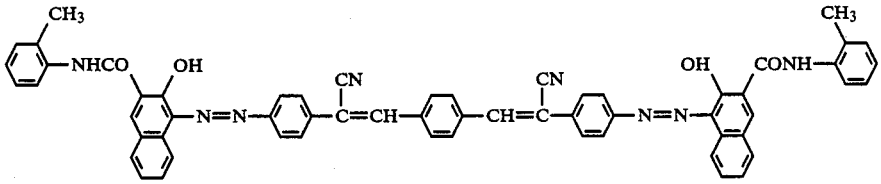
(I''-12)
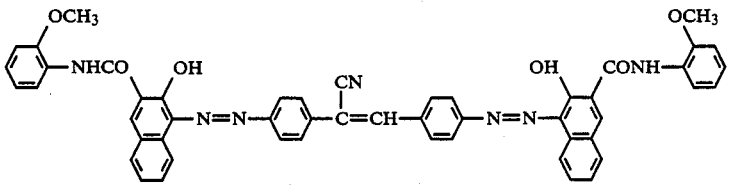
(I''-13)

-continued
(I''-14)
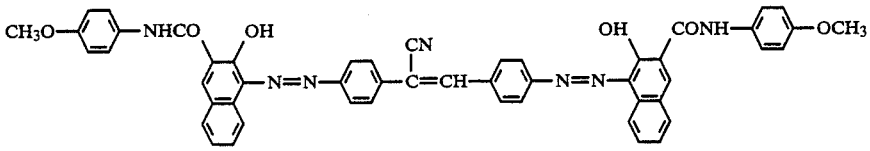
(I''-15)
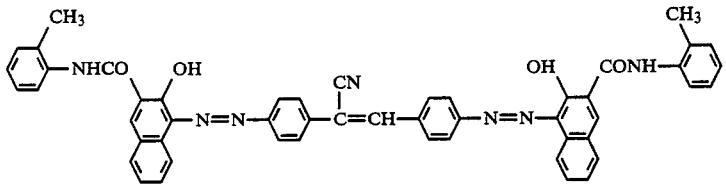
(I''-16)
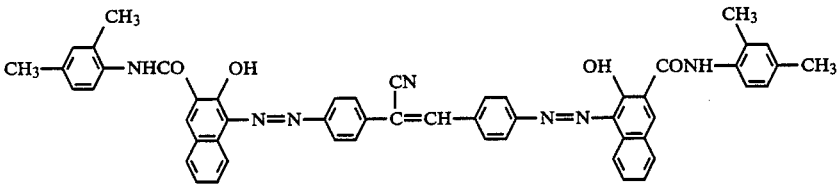
(I''-17)
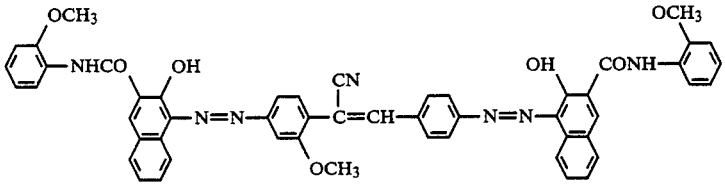
(I''-18)
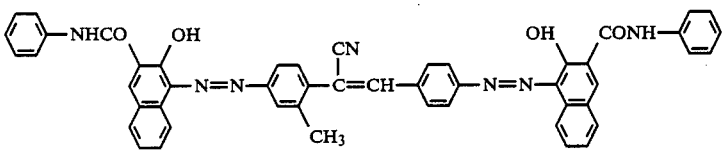
(I''-19)
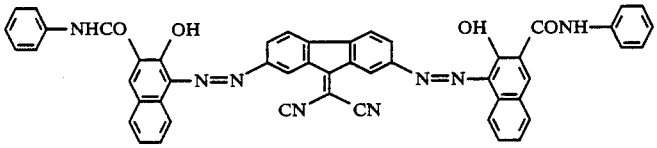
(I''-20)
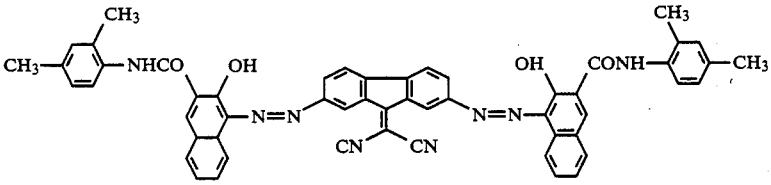
(I''-21)
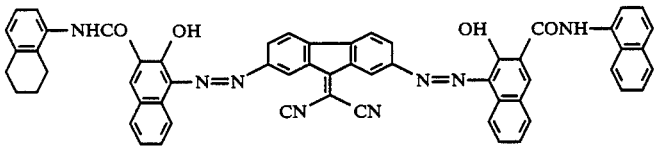
(I''-22)
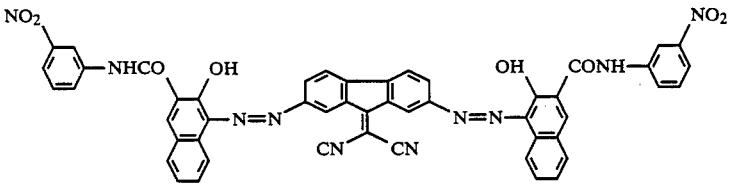

-continued
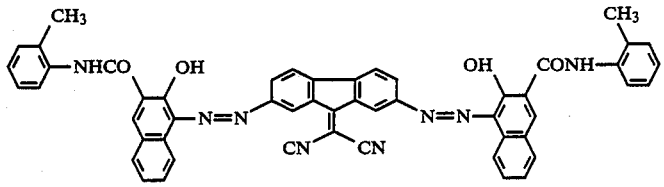
(I''-23)
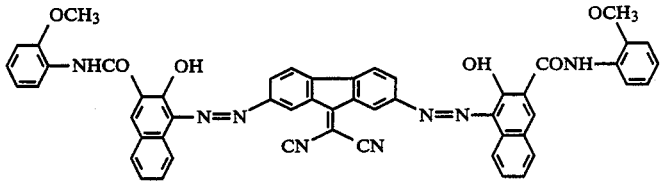
(I''-24)
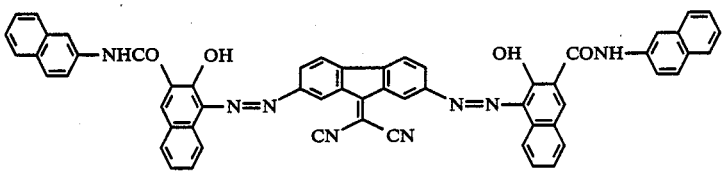
(I''-25)
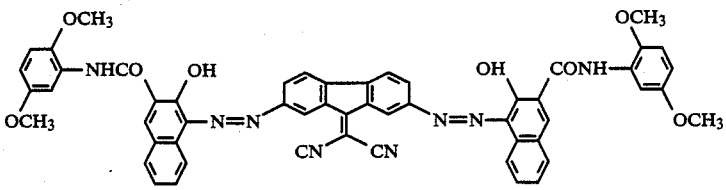
(I''-26)
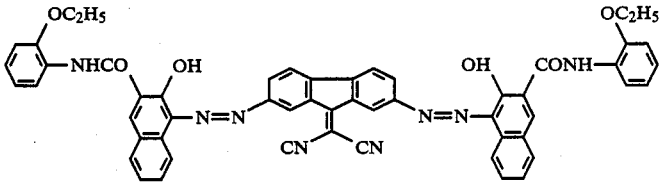
(I''-27)
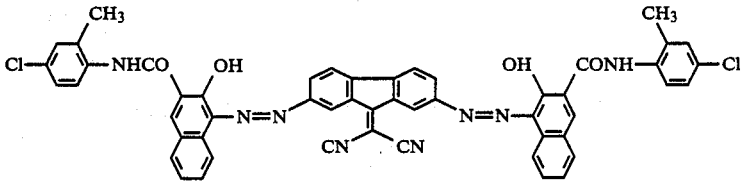
(I''-28)
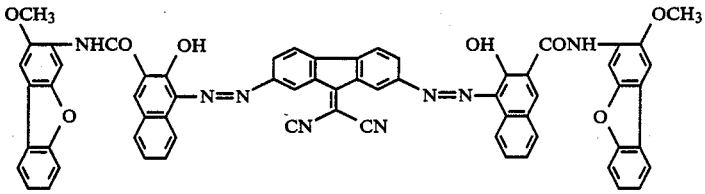
(I''-29)
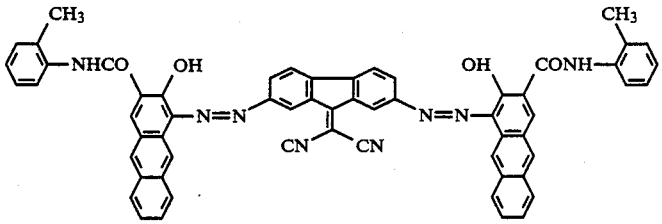
(I''-30)

-continued
(I''-31)
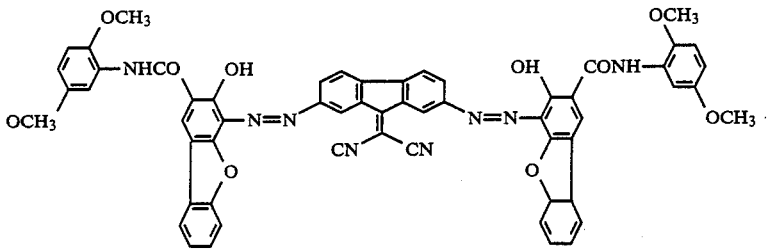
(I''-32)
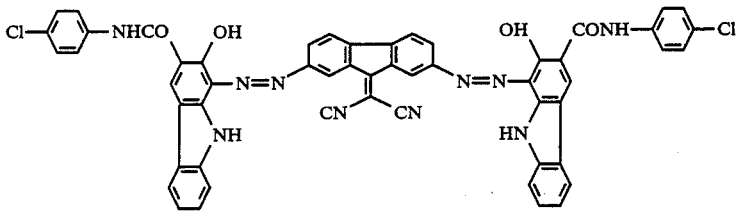
(I''-33)
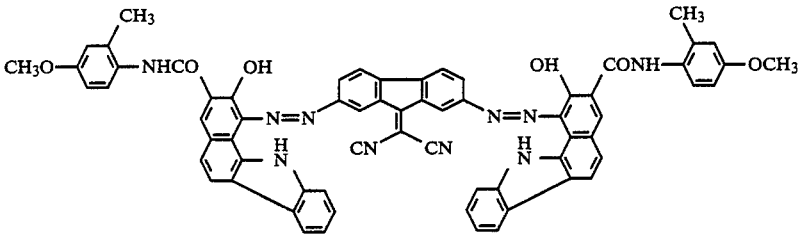
(I''-34)
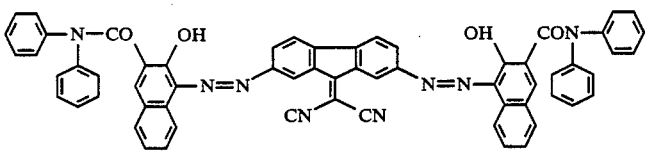
(I''-35)
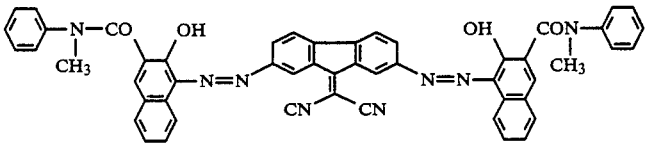
(I''-36)
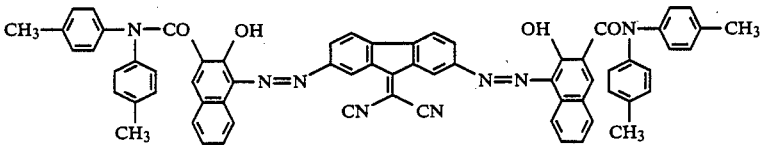
(I''-37)
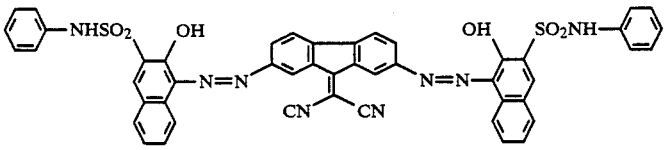
(I''-38)
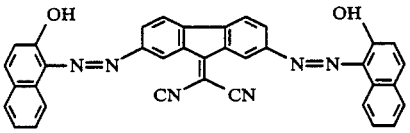

-continued
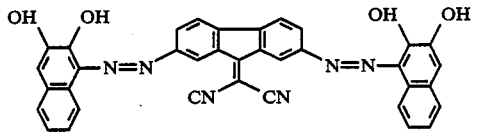
(I''-39)
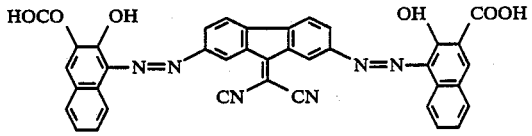
(I''-40)
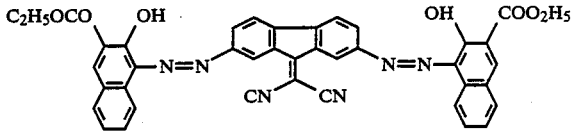
(I''-41 )
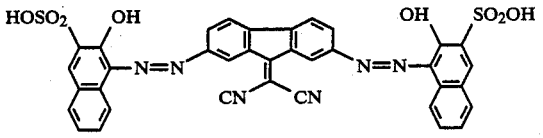
(I''-42)
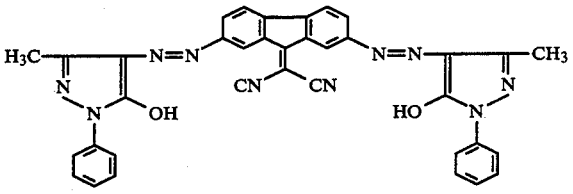
(I''-43)
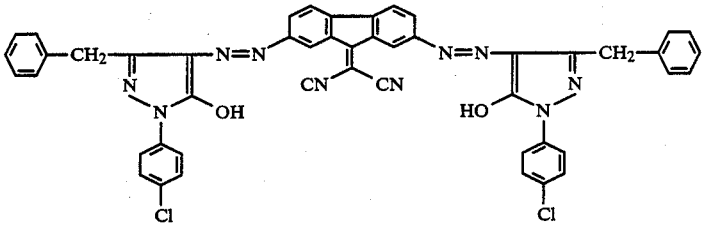
(I''-44)
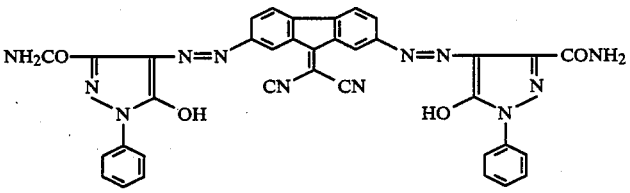
(I''-45)
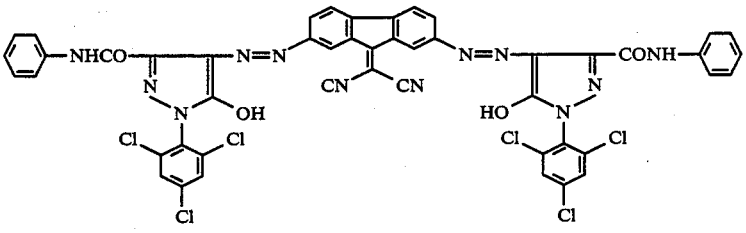
(I''-46)
The polycyclic quinone pigments represented by the group of the following formulas [II] may also be used for the carrier generating substances:
Formula [II]

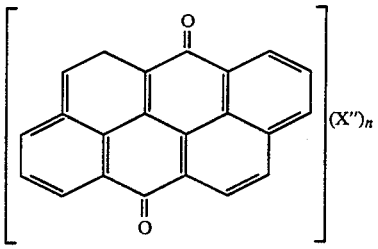
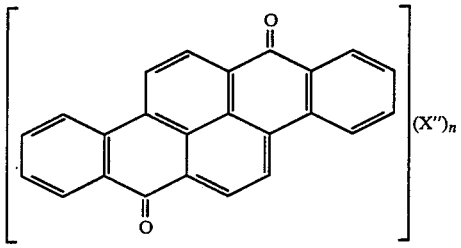
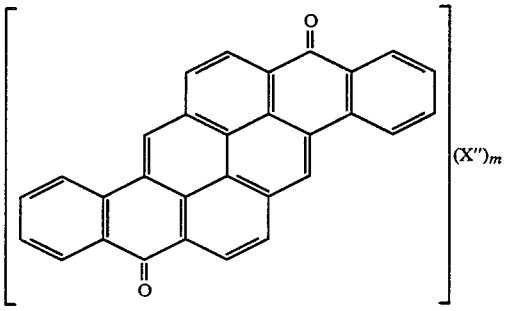
wherein, X″ represents a halogen, nitro group, cyano group, acyl group or carboxyl group; n is an integer of from zero to 4; and m is an integer of from zero to 6. The typical examples of these polycyclic quinone pigments are given as follows:
(II-1)
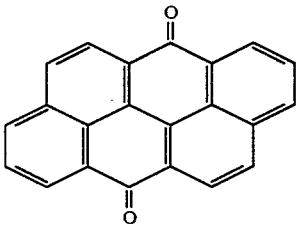
(II-2)
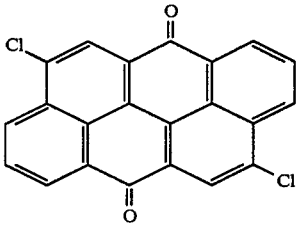
-continued
(II-3)
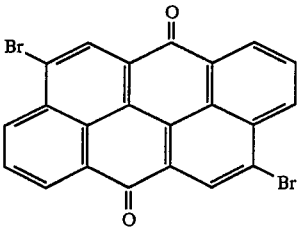
(II-4)
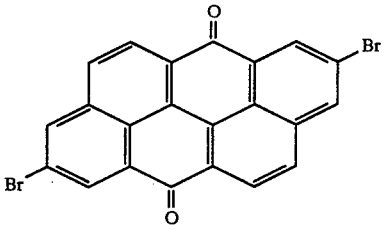
(II-5)
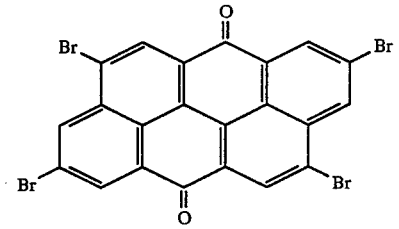
(II-6)
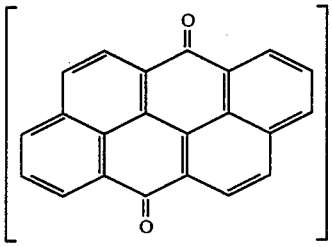
$(I)_2$
(II-7)
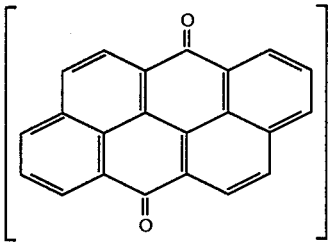
$(I)_3$
(II-8)
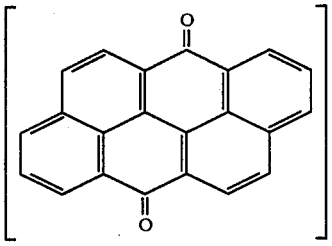
$(I)_4$ -continued
(II-9)
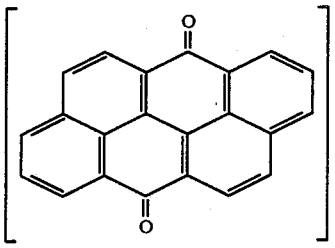
$(NO_2)_2$
(II-10)
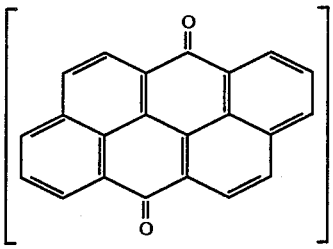
$(CN)_2$
(II-11)
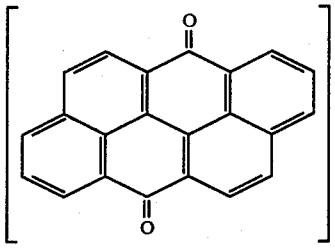
$(COCH_3)_2$
(II-12)
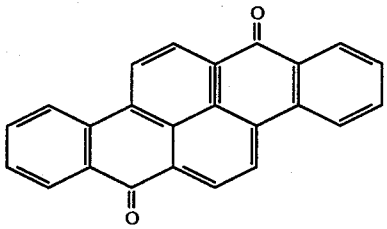
(II-13)
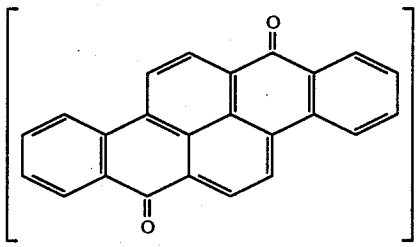
$(Cl)_2$
(II-14)
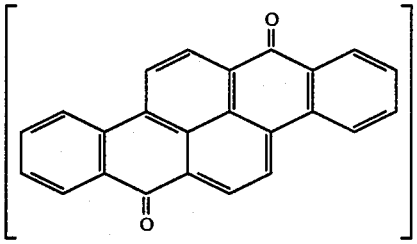
$(Br)_2$
-continued
(II-15)
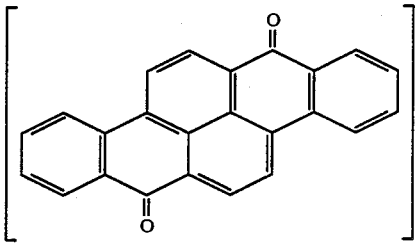
$(I)_2$
(II-16)
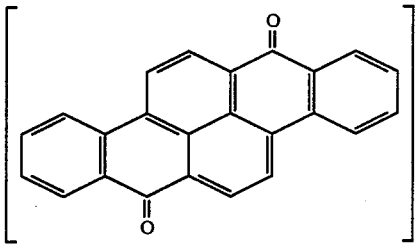
$(I)_3$
(II-17)
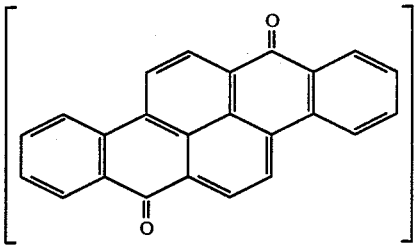
$(I)_4$
(II-18)
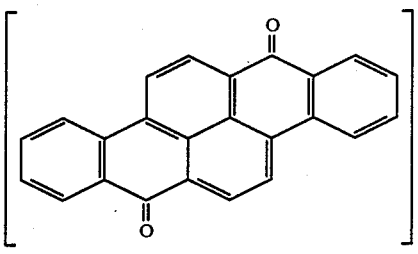
$(NO_2)_2$
(II-19)
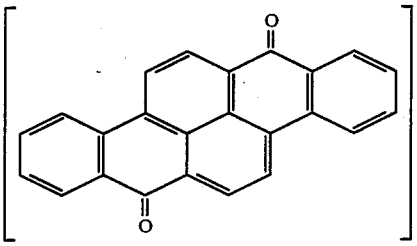
$(CN)_2$
(II-20)
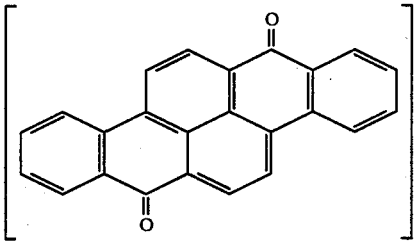
$(COC_6H_5)_2$ -continued (II-21)

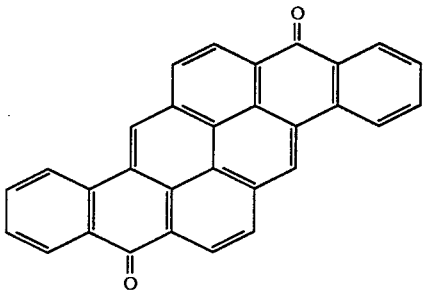

(II-22)

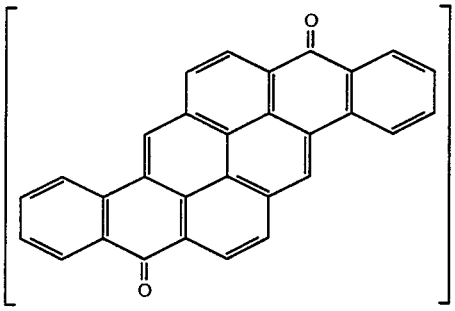

$(Cl)_2$ (II-23)

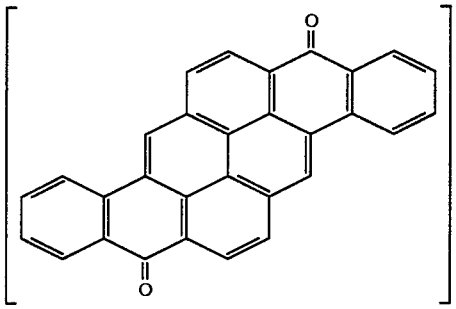

$(Br)_2$ (II-24)

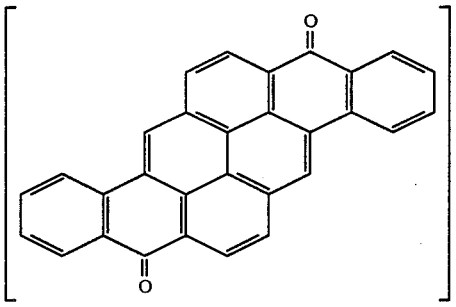

$(Br)_3$ (II-25)

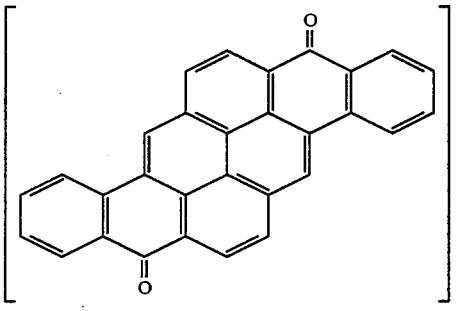

$(Br)_4$

-continued (II-26)

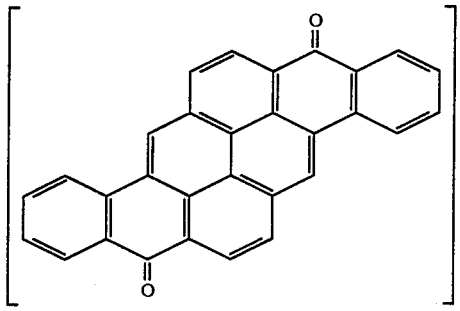

$(I)_4$ (II-27)

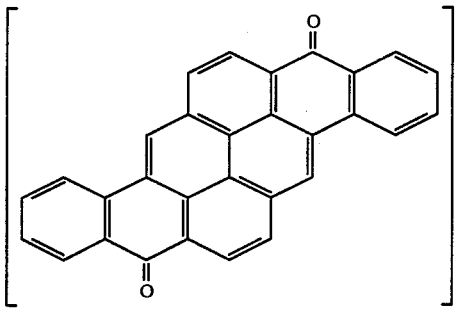

$(NO_2)_3$ (II-28)

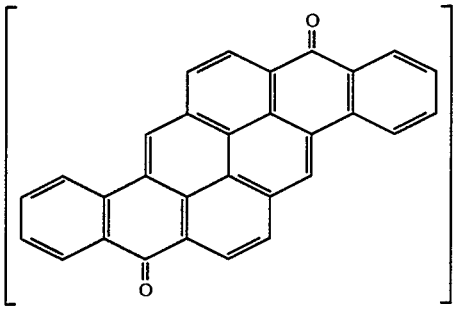

$(CN)_4$ (II-29)

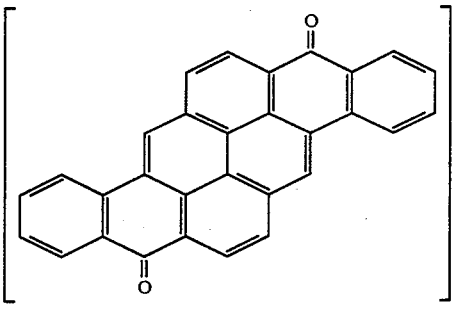

$(COCH_3)_4$

Carrier transporting substances to be used in the invention include, for example, an oxazole derivative, an oxadiazole derivative, a thiazole derivative, a thiadiazole derivative, a triazole derivative, an imidazole derivative, an imidazolone derivative, an imidazolidine derivative, a bisimidazolidine derivative, a styryl compound, a hydrazone compound, a pyrazoline derivative, an oxazolone derivative, a benzothiazole derivative, a benzimidazole derivative, a quinazoline derivative, a benzofuran derivative, an acridine derivative, a phenazine derivative, an aminostilbene derivative, poly-N-vinylcarbazole, poly-1-vinylpyrene, poly-9-vinylanthracene and the like.

To serve as the carrier transporting substances, the styryl compounds represented by the following formula [III] or [IV] can be used:

Formula [III]:

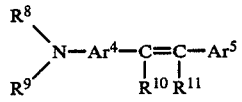

Wherein, $R^8$ and $R^9$ represent a substituted or unsubstituted alkyl group, or aryl group; and an alkyl group, alkoxy group, a substituted amino group, a hydroxyl group, a halogen or an aryl group is used as the substituents; $Ar^4$ and $Ar^5$ represent a substituted or unsubstituted aryl group; and an alkyl group, an alkoxy group, a substituted amino group, a hydroxyl group, a halogen, or an aryl group is used as the substituents; and $R^{10}$ and $R^{11}$ represent a substituted or unsubstituted aryl group or hydrogen; and an alkyl group, an alkoxy group, a substituted amino group, a hydroxyl group, a halogen, or an aryl group is used as the substituents.

Formula [IV]:

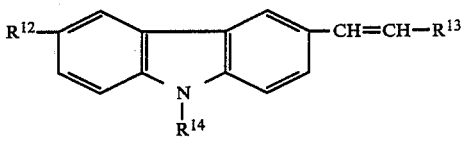

Wherein, $R^{12}$ represents a substituted or unsubstitued aryl group;

$R^{13}$ represent hydrogen, a halogen, a substituted or unsubstituted alkyl group, an alkoxy group, an amino group, a substituted amino group or a hydroxyl group; and $R^{14}$ represents a substituted or unsubstituted aryl group, or a substituted or unsubstituted heterocyclic ring group.

Typical examples of the styryl compounds represented by the Formula [III] or [IV] are give as follows:

(III-1)

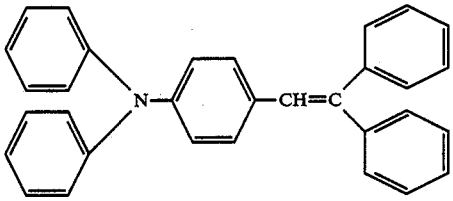

(III-2)

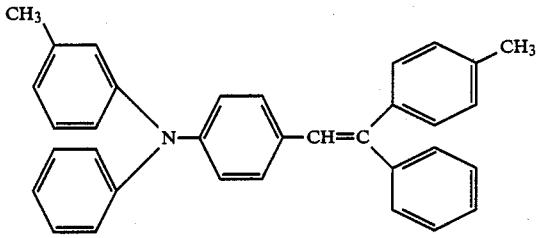

(III-3)

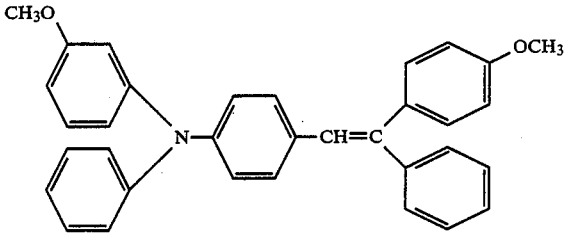

(III-4)

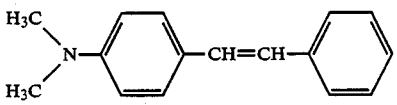

(III-5)

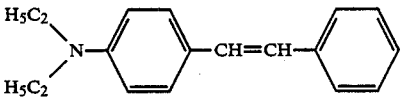

(III-6)

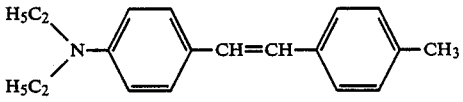

-continued
(III-7)
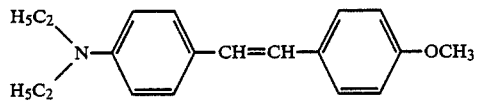
(III-8)
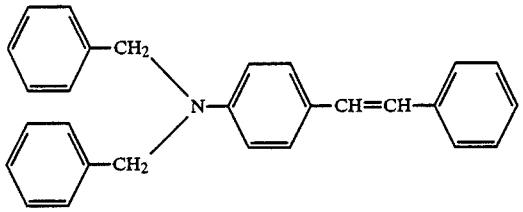
(III-9)
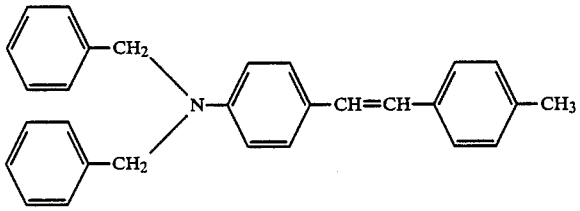
(III-10)
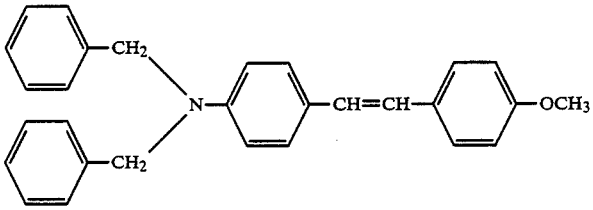
(III-11)
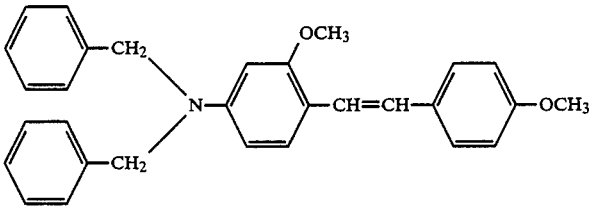
(III-12)
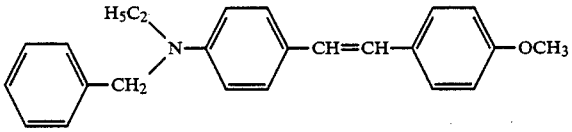
(III-13)
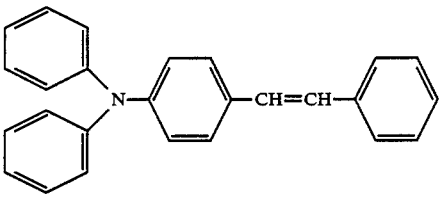
(III-14)
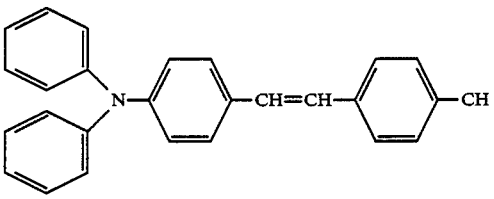

-continued
(III-15)
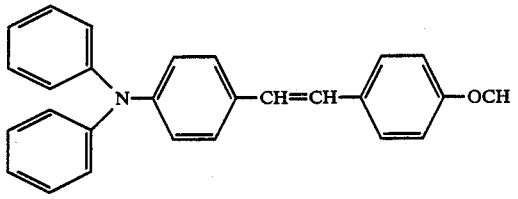
(III-16)
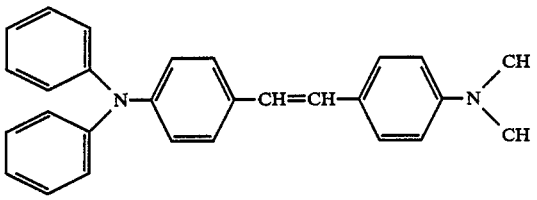
(III-17)
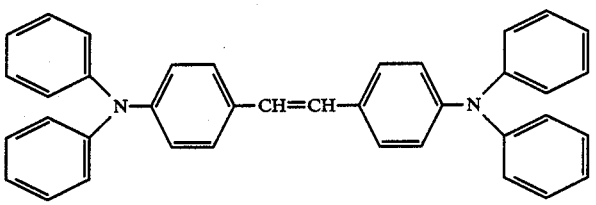
(III-18)
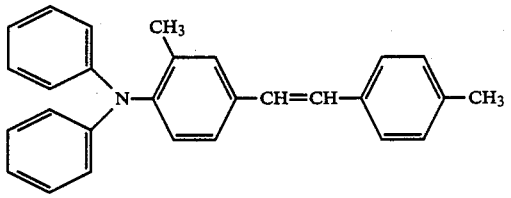
(III-19)
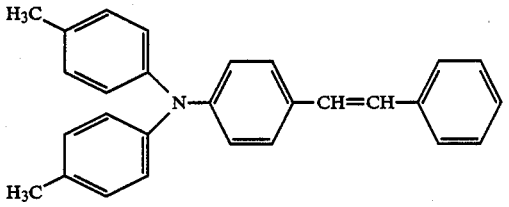
(III-20)
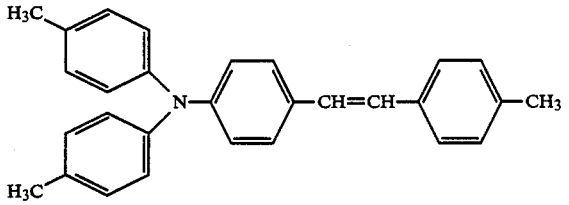
(III-21)
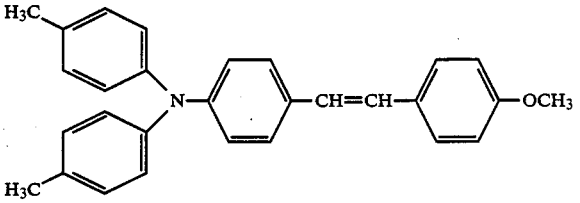

-continued
(III-22)
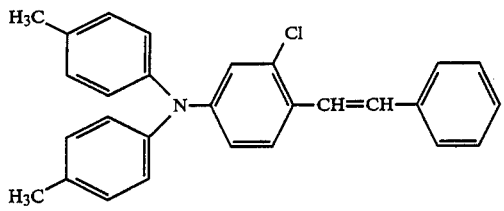
(III-23)
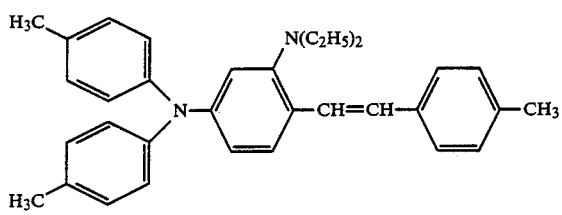
(III-24)
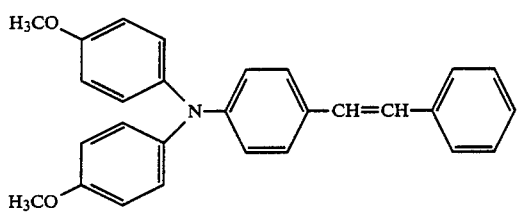
(III-25)
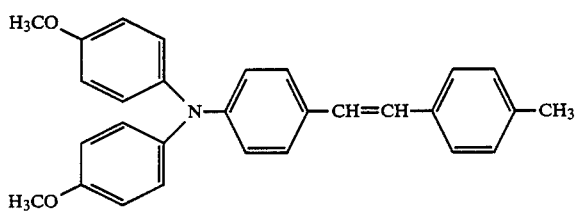
(III-26)
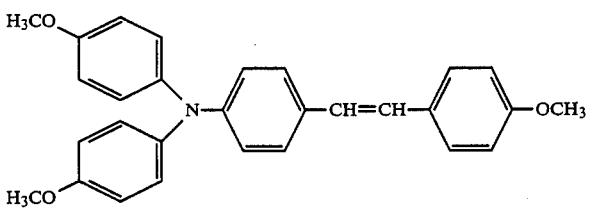
(III-27)
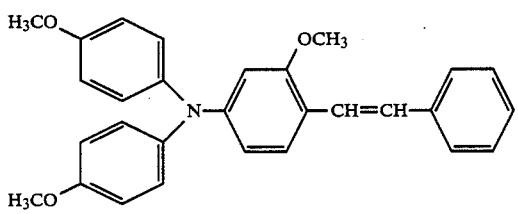
(III-28)
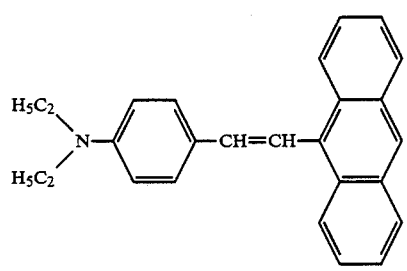

-continued
(III-29)
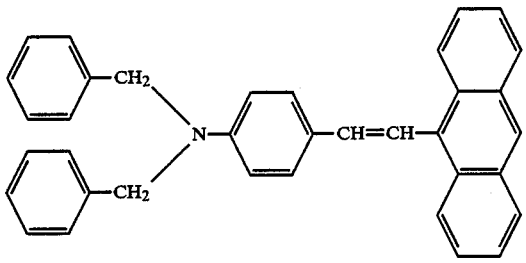
(III-30)
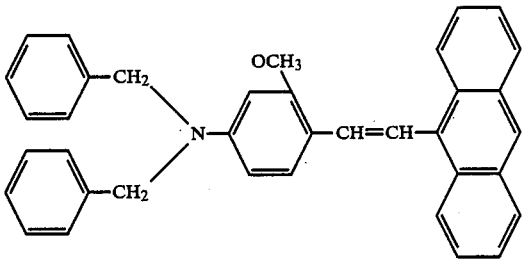
(III-31)
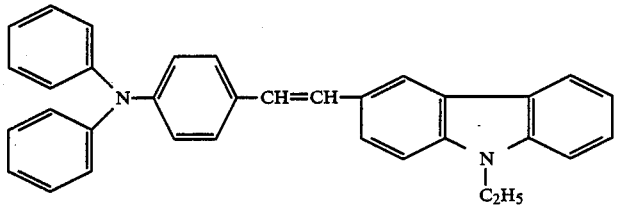
(III-32)
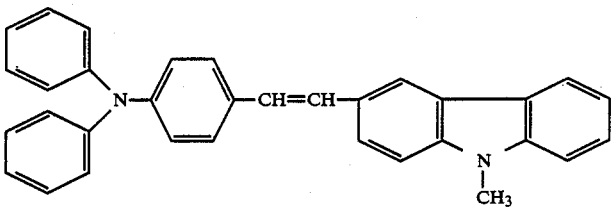
(III-33)
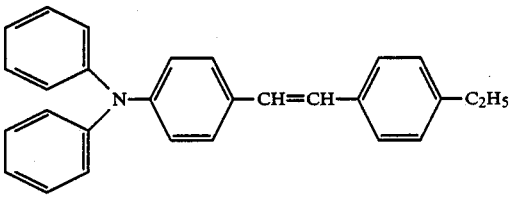
(III-34)
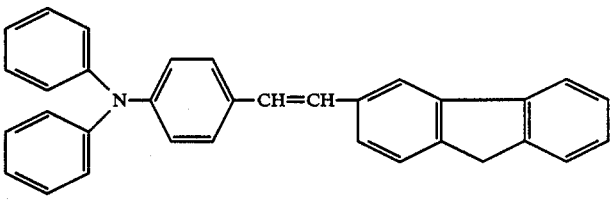

-continued
(III-35)
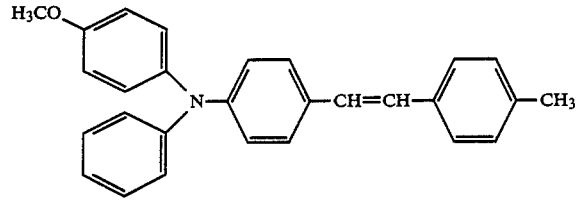
(III-36)
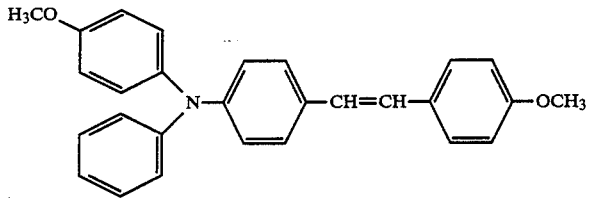
(III-37)
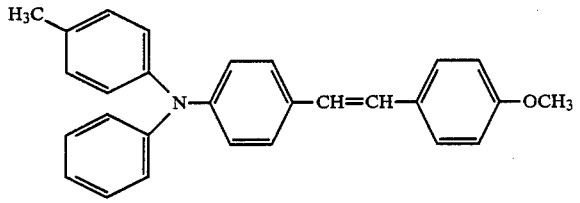
(III-38)
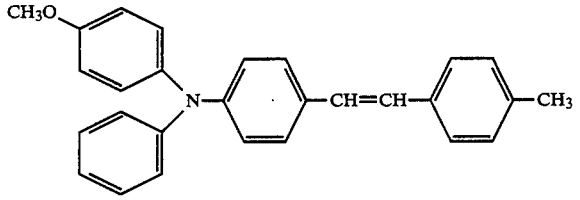
(III-39)
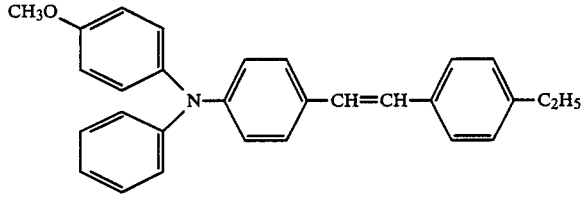
(III-40)
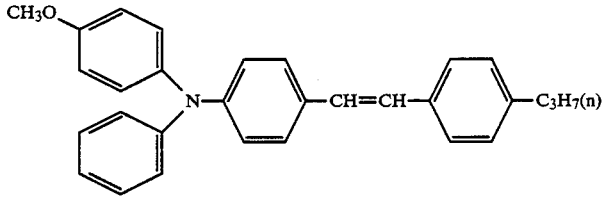
(III-41)
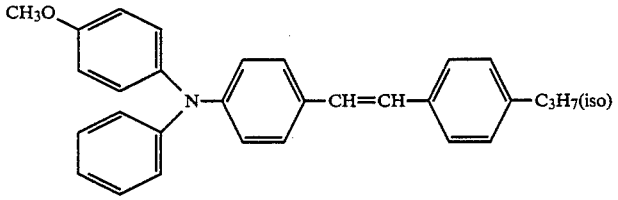

-continued
(III-42)
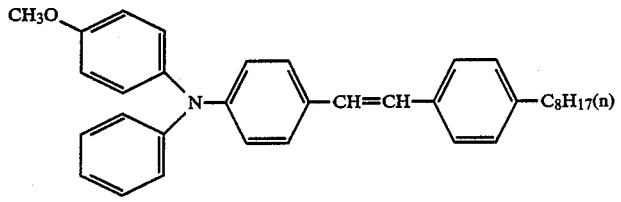
(III-43)
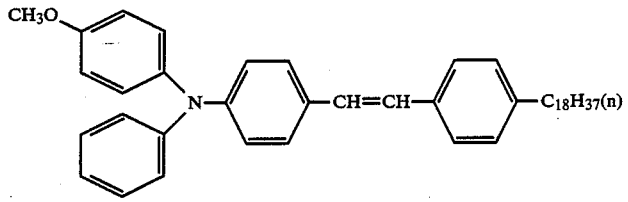
(III-44)
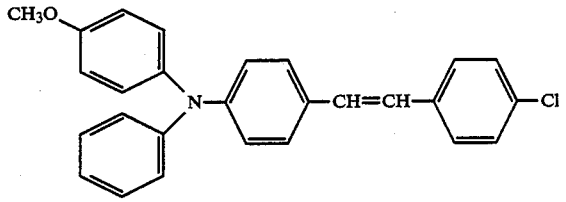
(III-45)
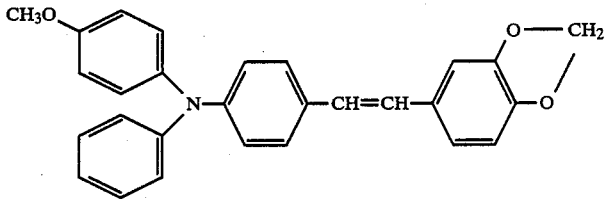
(III-46)
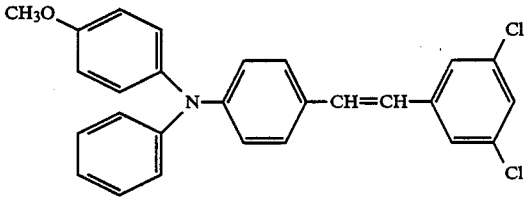
(III-47)
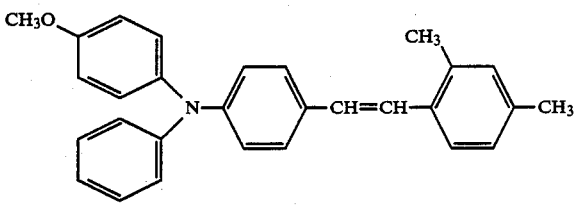
(III-48)
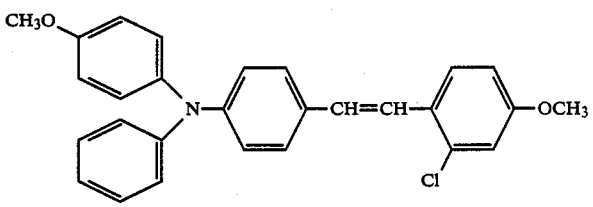

-continued
(III-49)
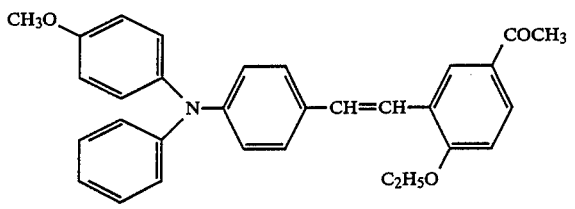
(III-50)
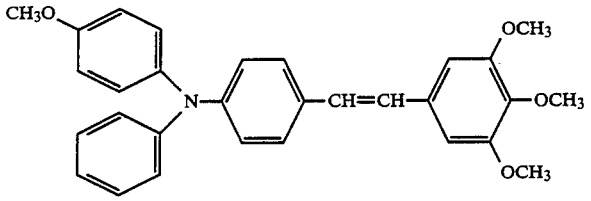
(III-51)
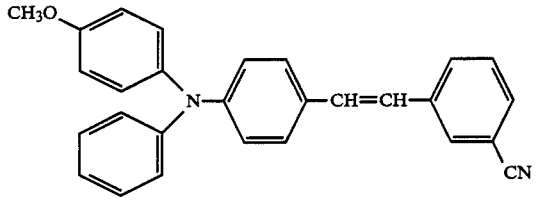
(III-52)
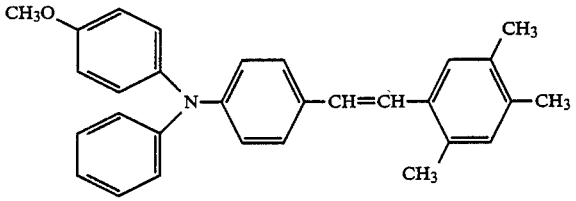
(III-53)
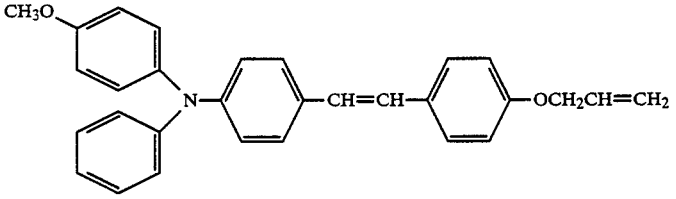
(III-54)
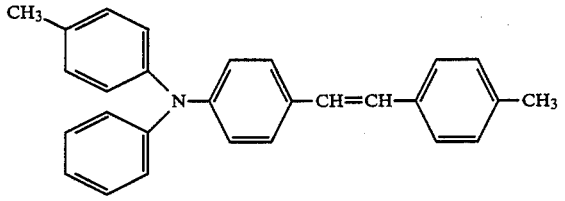
(III-55)
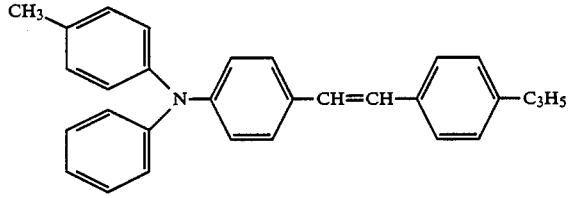

-continued
(III-56)
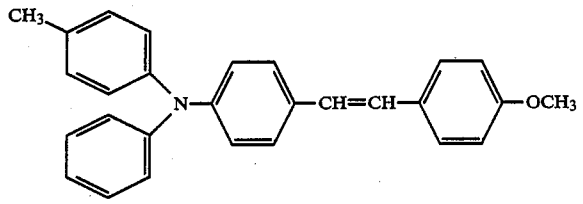
(III-57)
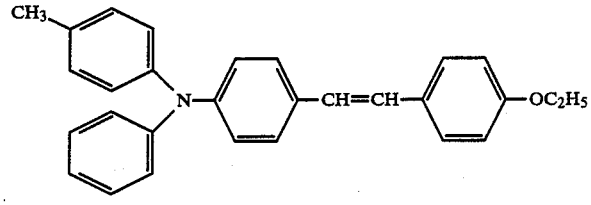
(III-58)
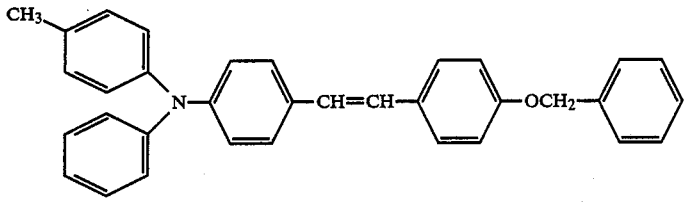
(III-59)
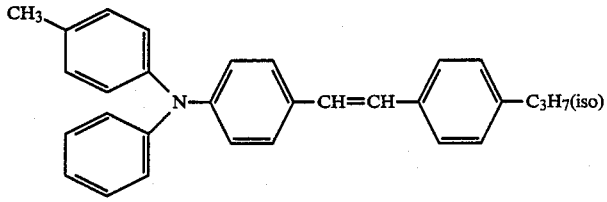
(III-60)
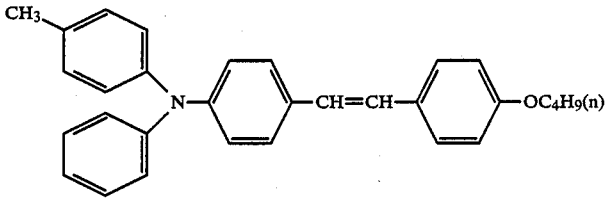
(III-61)
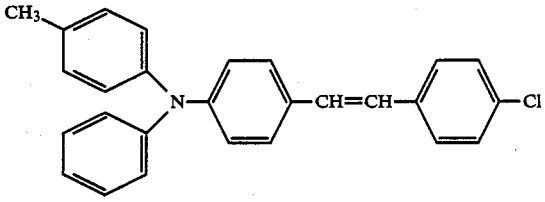
(III-62)
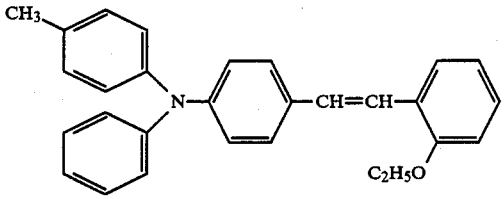

-continued
(III-63)
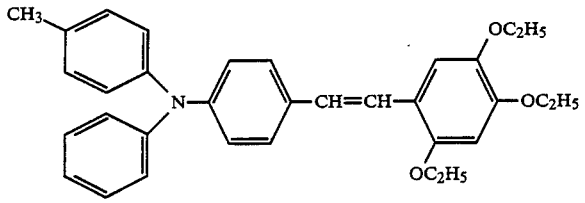
(III-64)
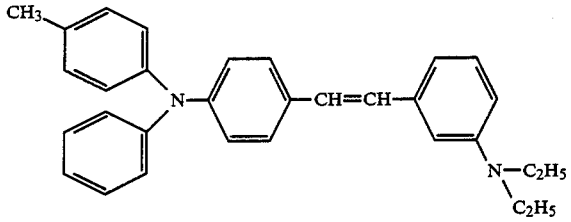
(III-65)
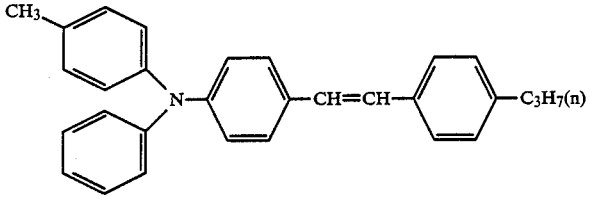
(III-66)
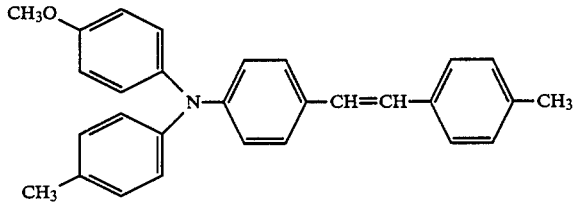
(III-67)
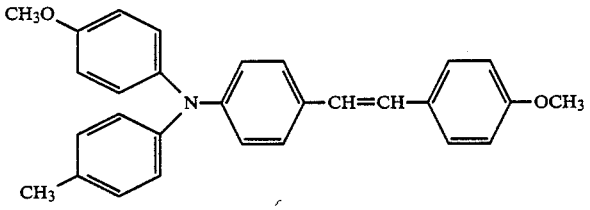
(III-68)
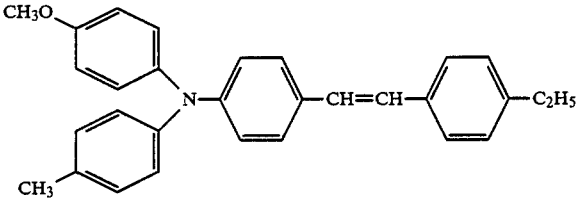
(III-69)
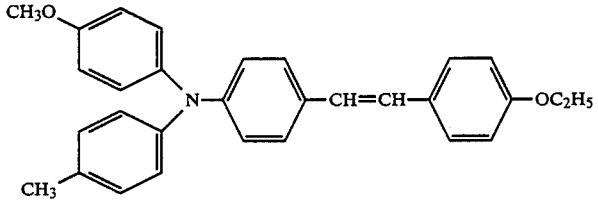

-continued
(III-70)
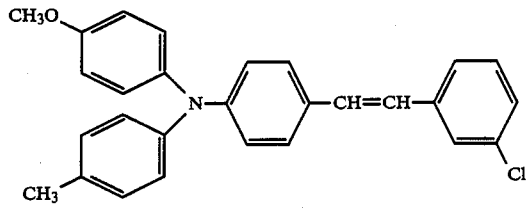
(III-71)
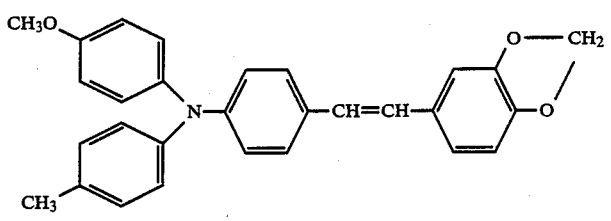
(III-72)
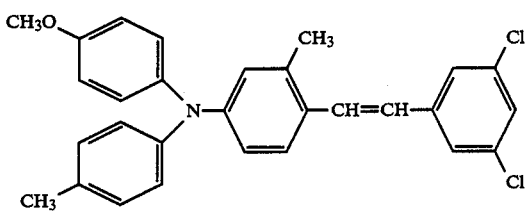
(III-73)
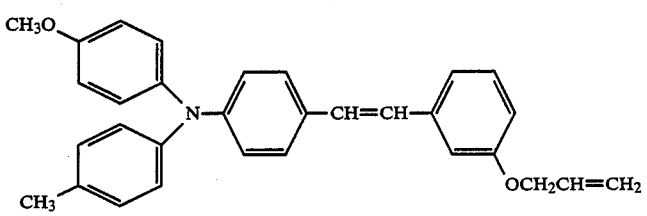
(III-74)
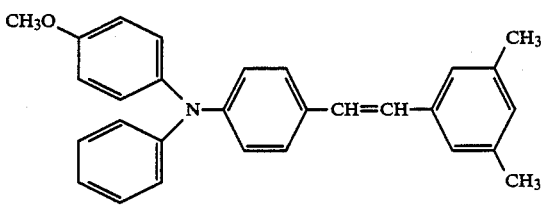
(III-75)
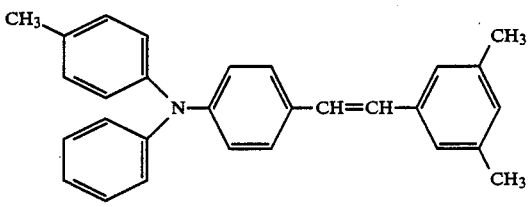
(III-76)
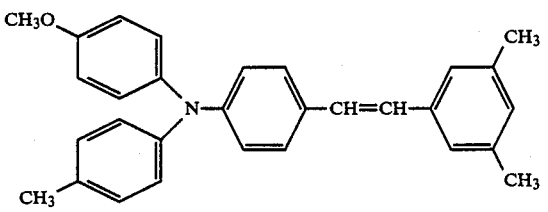

-continued
(III-77)
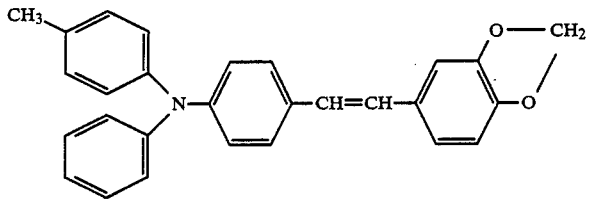
(IV-1)
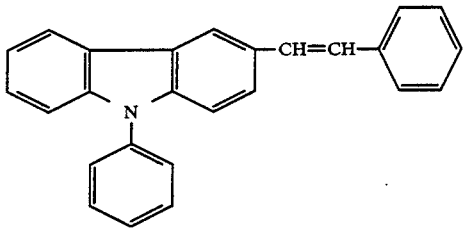
(IV-2)
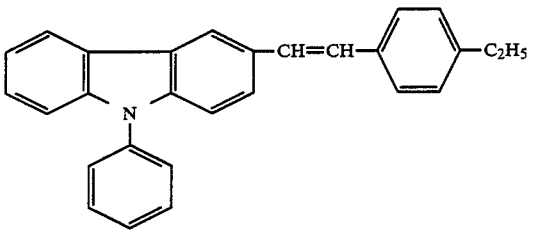
(IV-3)
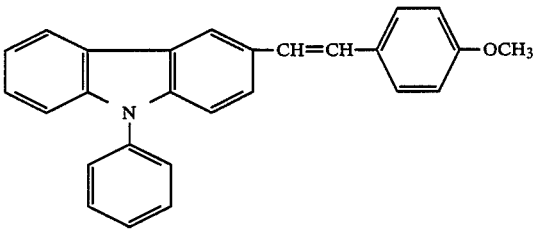
(IV-4)
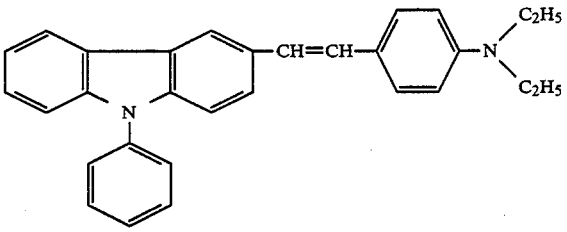
(IV-5)
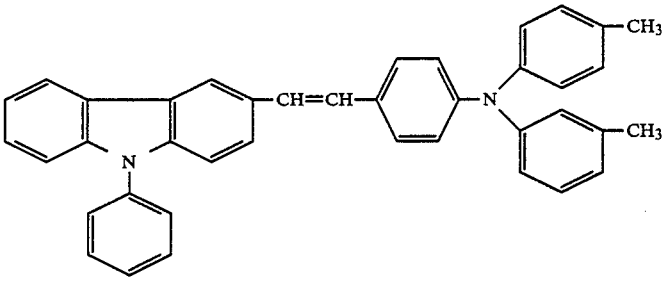

-continued
(IV-6)
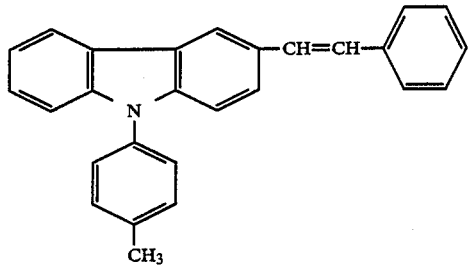
(IV-7)
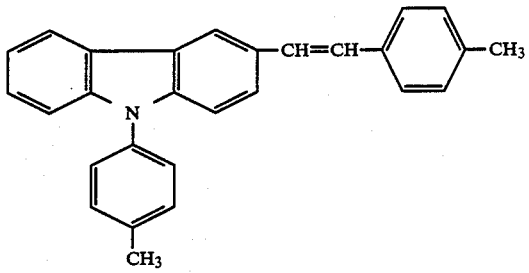
(IV-8)
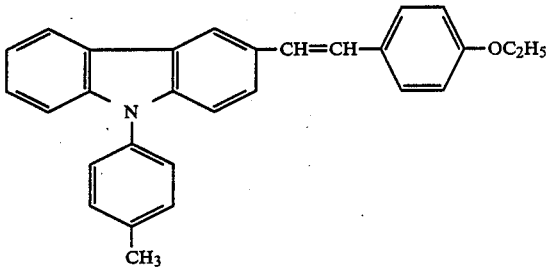
(IV-9)
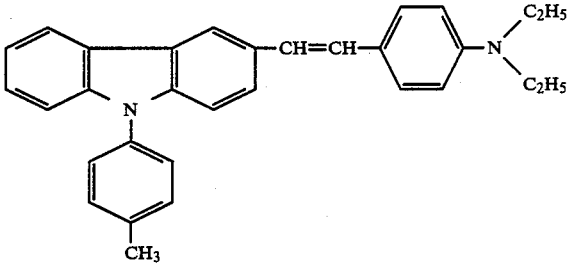
(IV-10)
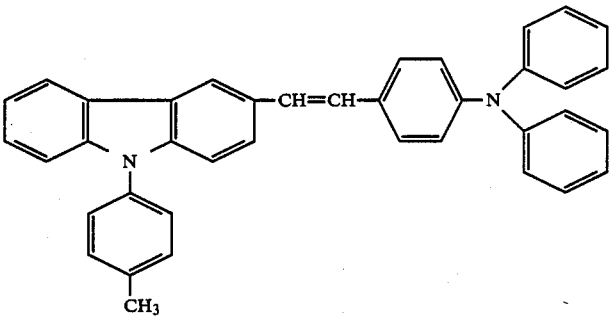

-continued
(IV-11)
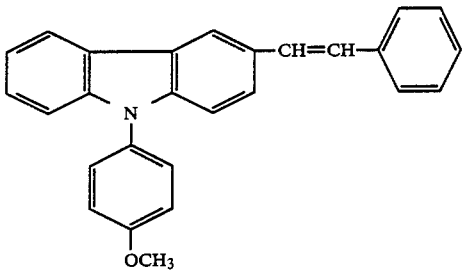
(IV-12)
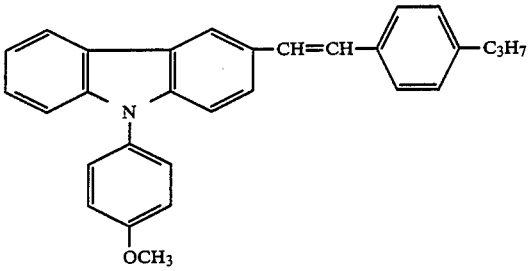
(IV-13)
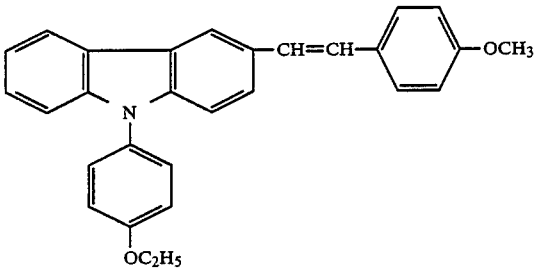
(IV-14)
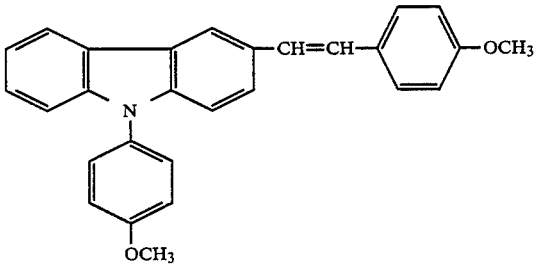
(IV-15)
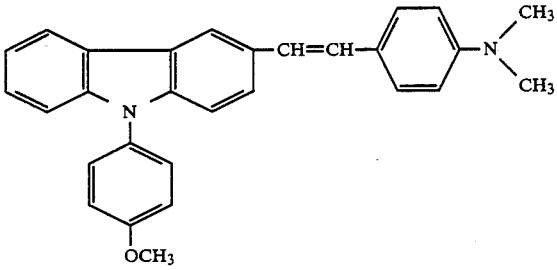

-continued
(IV-16)
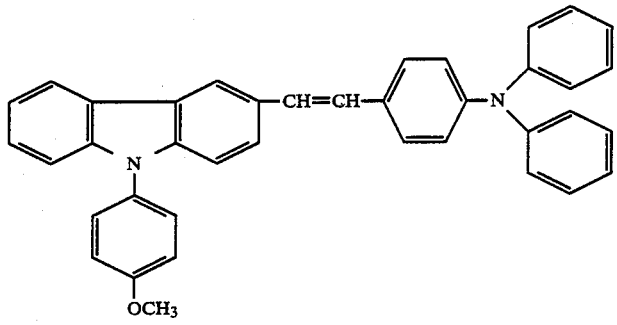
(IV-17)
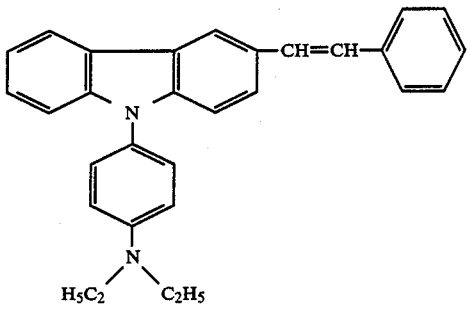
(IV-18)
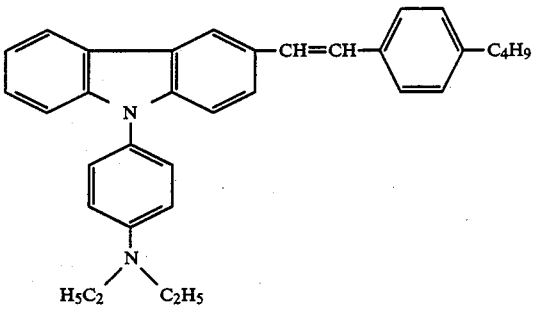
(IV-19)
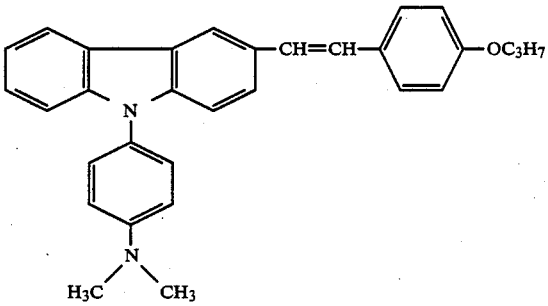
(IV-20)
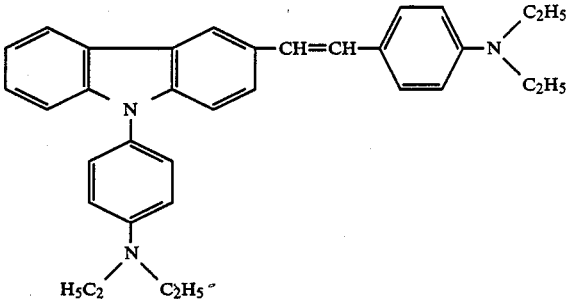

-continued
(IV-21)
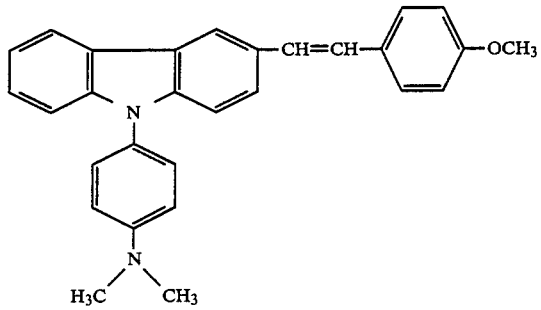
(IV-22)
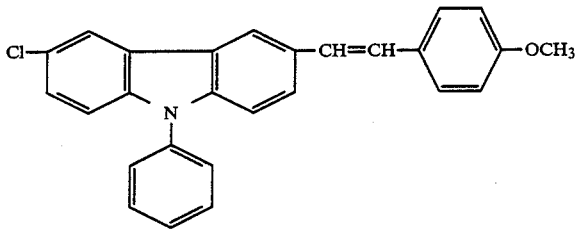
(IV-23)
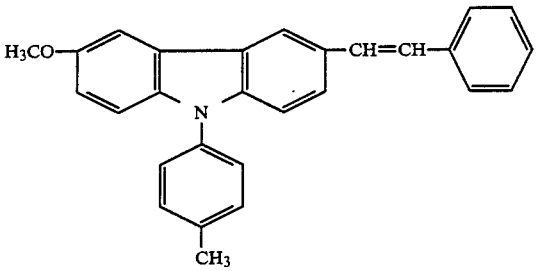
(IV-24)
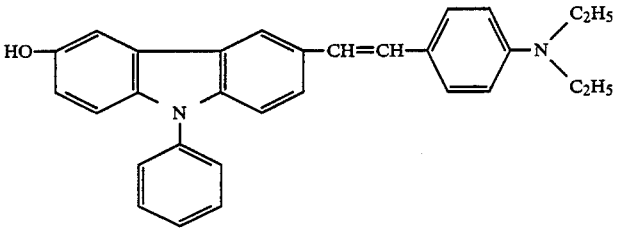
(IV-25)
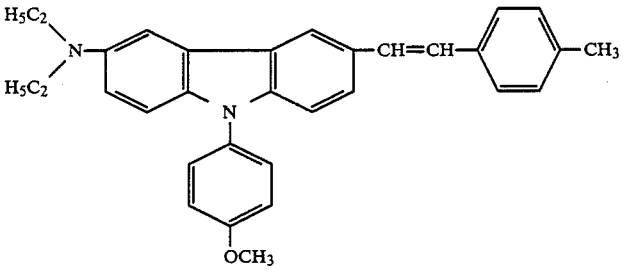
(IV-26)
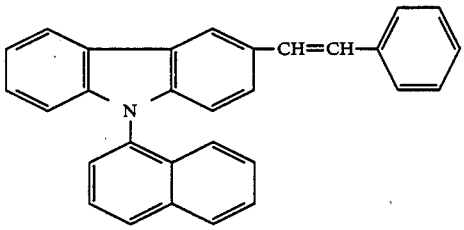

-continued
(IV-27)
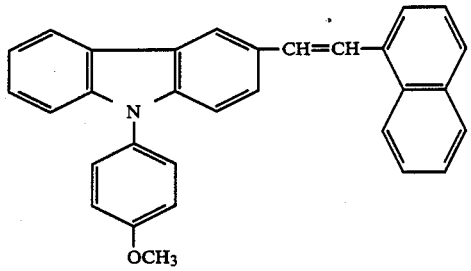
(IV-28)
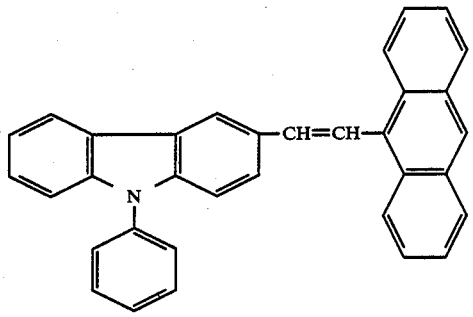
(IV-29)
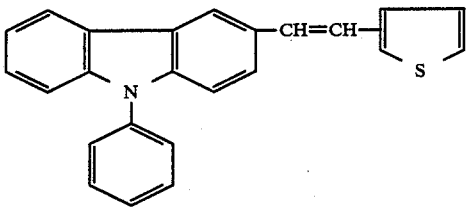
(IV-30)
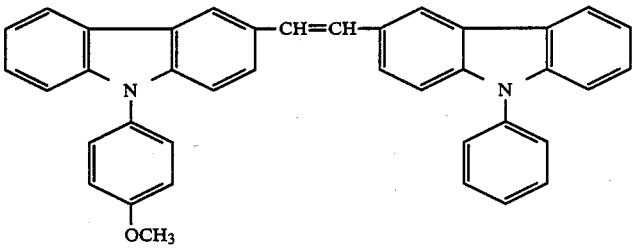
(IV-31)
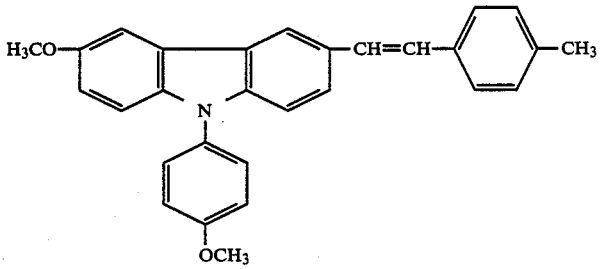

-continued (IV-32)

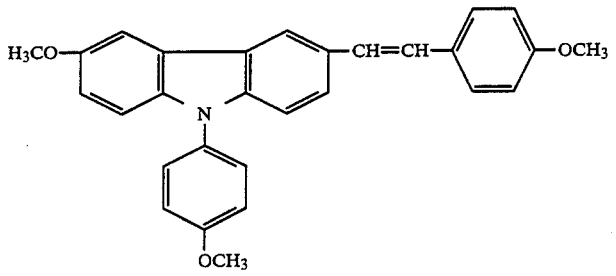

(IV-33)

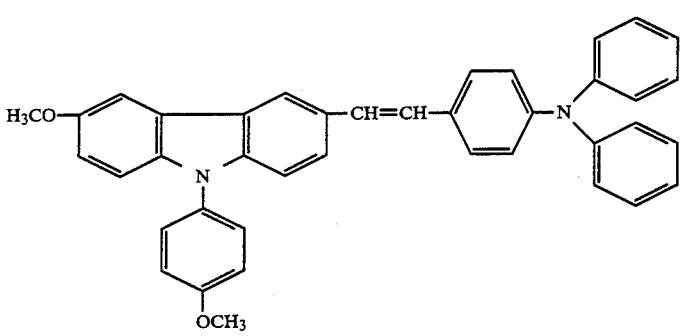

To serve as the carrier transporting substances, the hydrazone compounds represented by the following Formula [V], [VI], [VII] or [VIII] can be used;

Formula [V]:

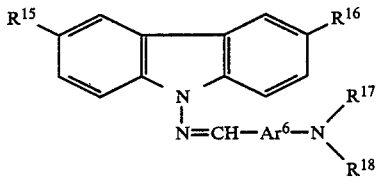

Wherein, $R^{15}$ and $R^{16}$ each are hydrogen or a halogen;

$R^{17}$ and $R^{18}$ each represent a substituted or unsubstituted aryl group; and $Ar^6$ represents a substituted or unsubstituted arylene group.

Formula [VI]:

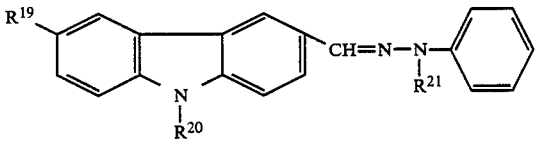

Wherein, $R^{19}$ represents a methyl group, an ethyl group, 2-hydroxyethyl group or 2-chloroethyl group;

$R^{20}$ represents an methyl group, ethyl group, benzyl group or phenyl group; and $R^{21}$ represents a methyl group, ethyl group, benzyl group or phenyl group.

Formula [VII]:

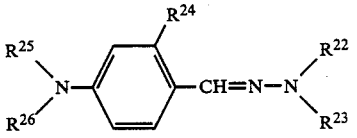

Wherein, $R^{22}$ represents a substituted or unsubstituted naphthyl group; $R^{23}$ represents a substituted or unsubstituted alkyl group, aralkyl group or aryl group; $R^{24}$ represents hydrogen, an alkyl group or alkoxy group; and $R^{25}$ and $R^{26}$ represents the same groups or the different groups from each other, comprising a substituted or unsubstituted alkyl group, aralkyl group or aryl group.

Formula [VIII]:

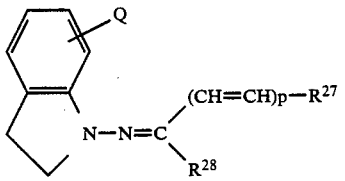

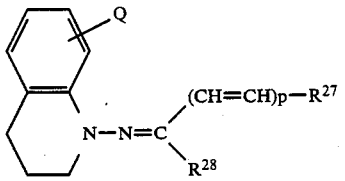

Wherein, $R^{27}$ represents a substituted or unsubstituted aryl group or a substituted or unsubstituted heterocyclic ring group;

$R^{28}$ represents hydrogen, a substituted or unsubstituted alkyl group or a substituted or unsubstituted aryl group;

Q represents hydrogen, a halogen, an alkyl group, a substituted amino group, alkoxy group or cyano group; and p is an integer of zero or one.

Typical examples of the hydrazone compounds represented by the Formulas [V] through [VIII] are given below:

(V-1)

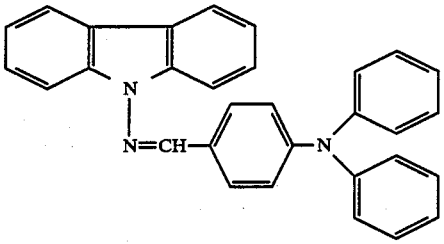

(V-2)

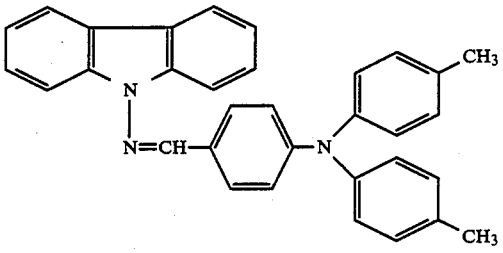

(V-3)

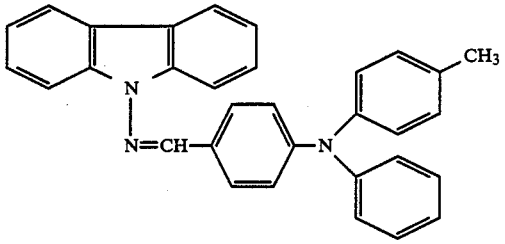

(V-4)

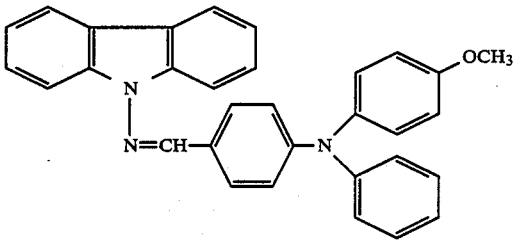

(V-5)

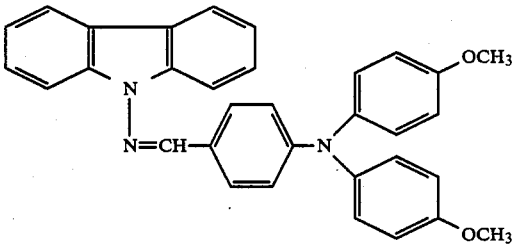

-continued (V-6)

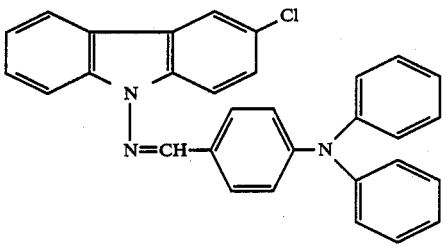

(V-7)

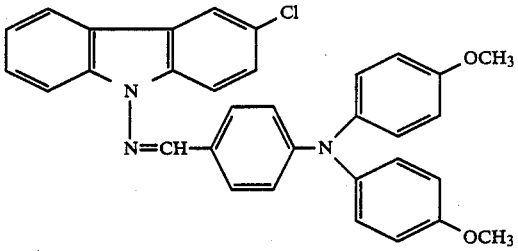

(V-8)

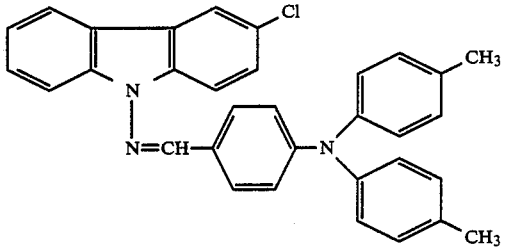

(V-9)

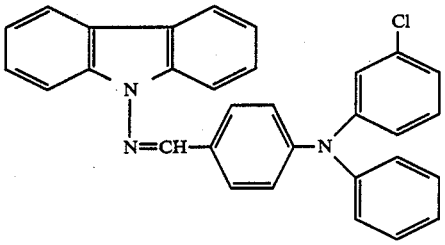

(V-10)

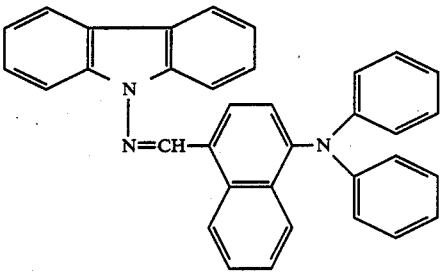

(V-11)

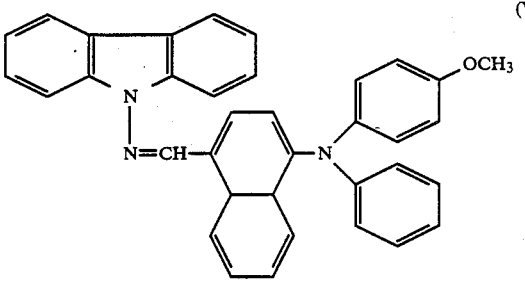

-continued
(V-12)
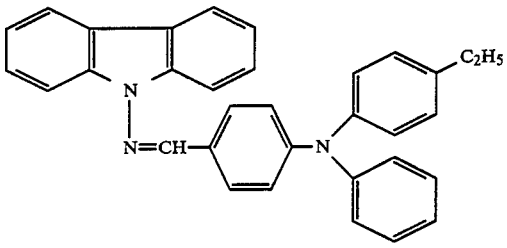
(V-13)
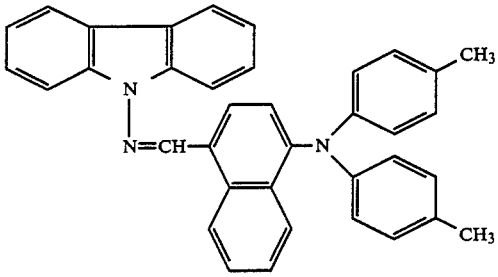
(V-14)
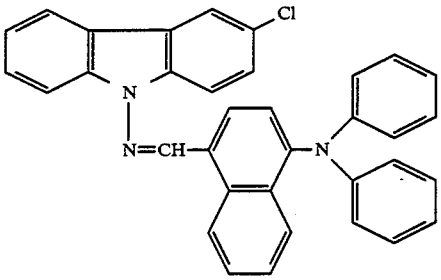
(VI-1)
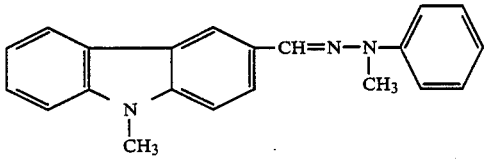
(VI-2)
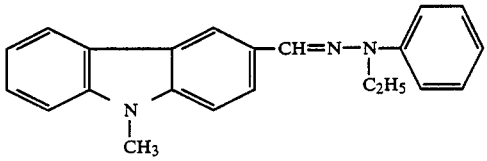
(VI-3)
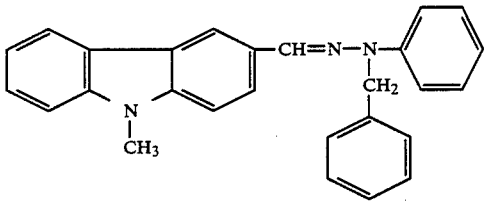
-continued
(VI-4)
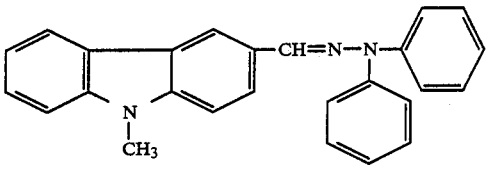
(VI-5)
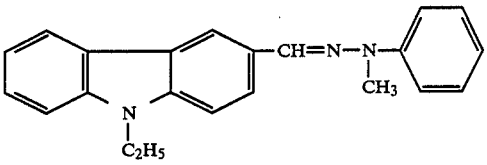
(VI-6)
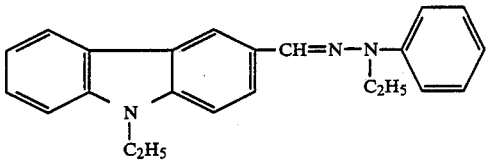
(VI-7)
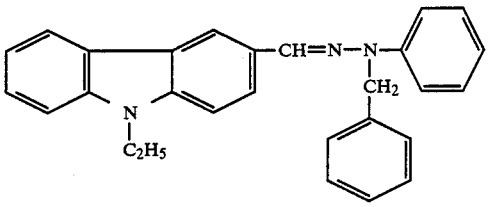
(VI-8)
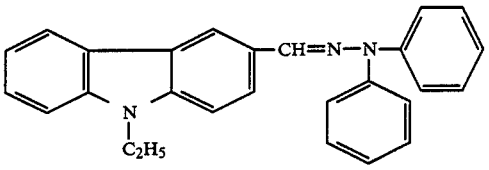
(VI-9)
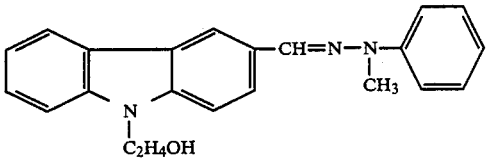
(VI-10)
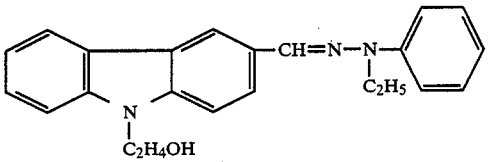
(VI-11)
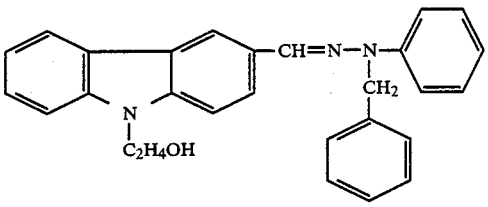

(VII-1)
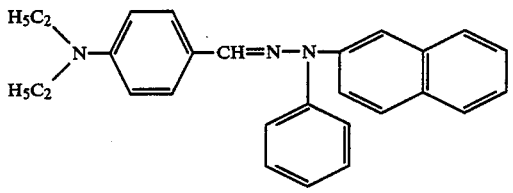
(VII-2)
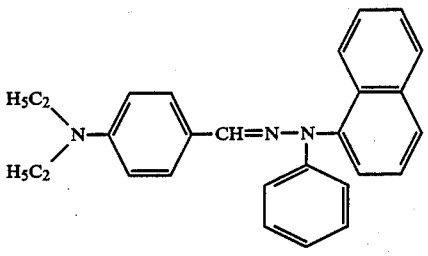
(VII-3)
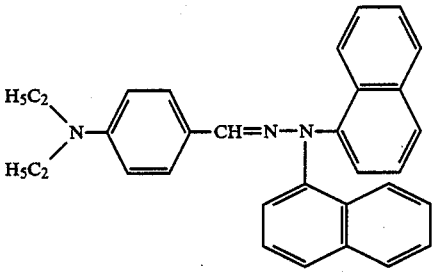
(VII-4)
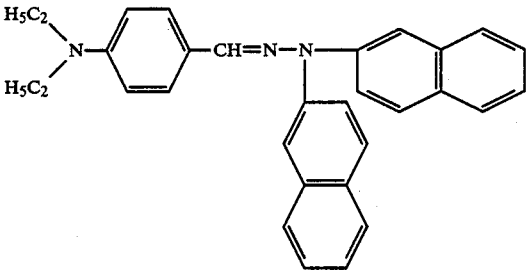
(VII-5)
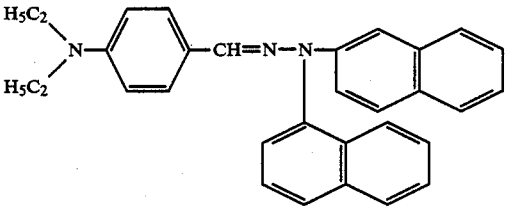
(VII-6)
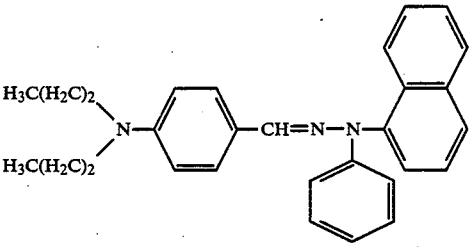

-continued
(VII-7)
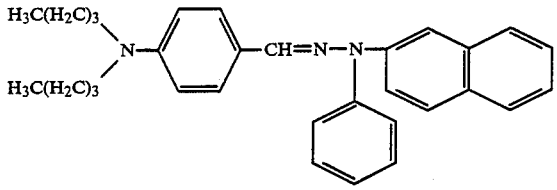
(VII-8)
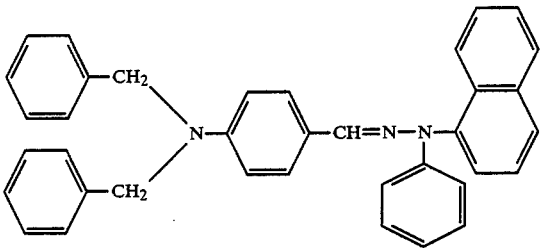
(VII-9)
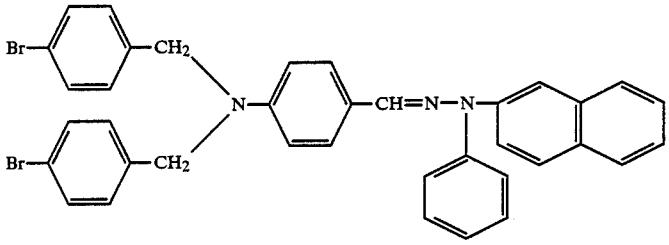
(VII-10)
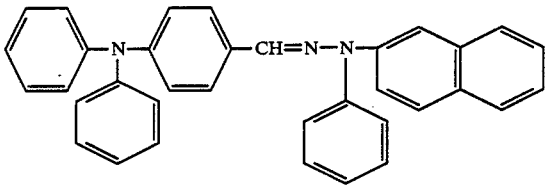
(VII-11)
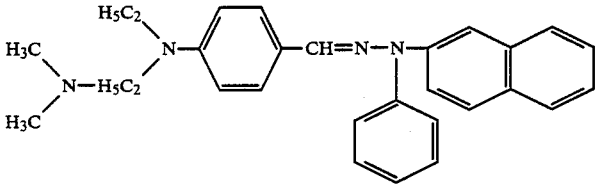
(VII-12)
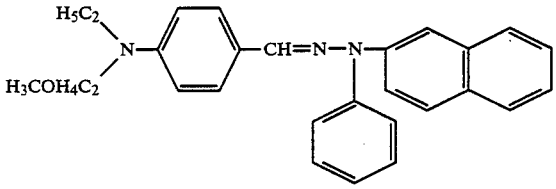
(VII-13)
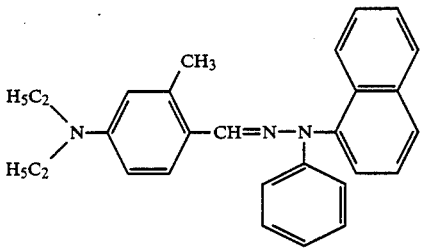

-continued
(VII-14)
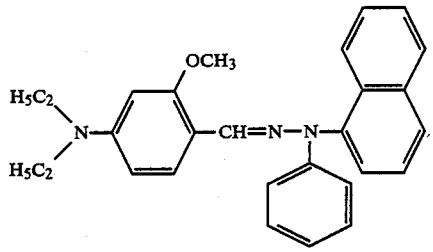
(VII-15)
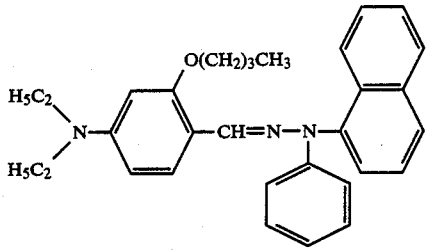
(VII-16)
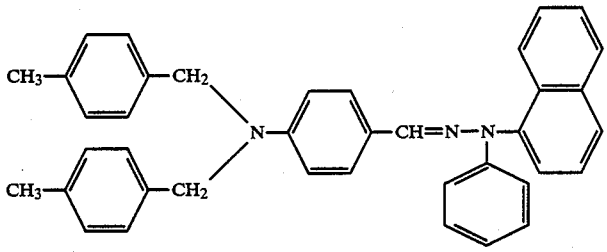
(VII-17)
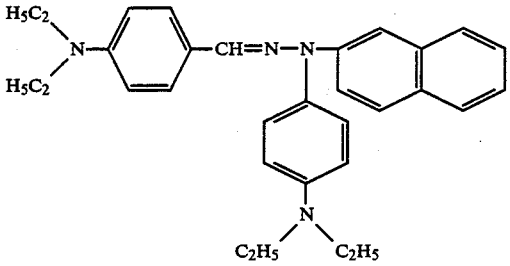
(VII-18)
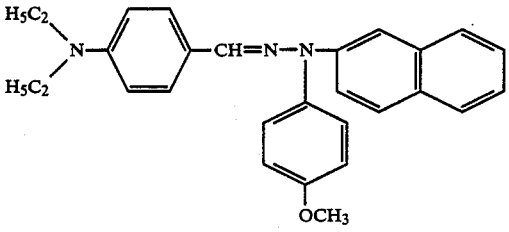
(VII-19)
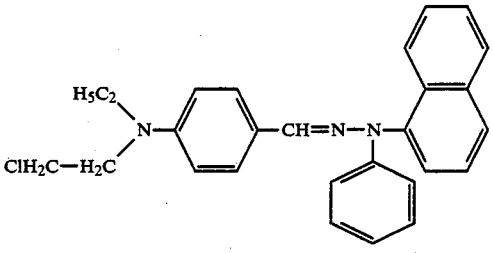

-continued
(VII-20)
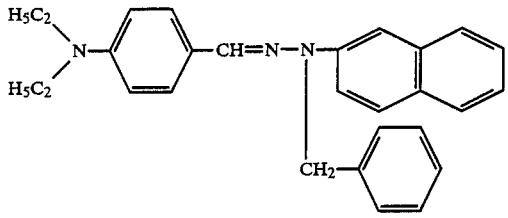
(VII-21)
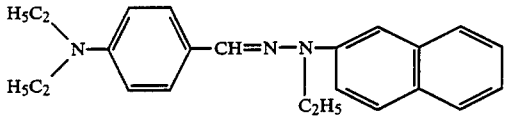
(VII-22)
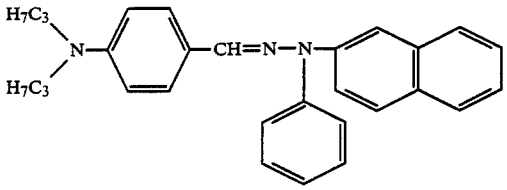
(VIII-1)
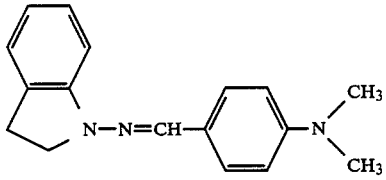
(VIII-2)
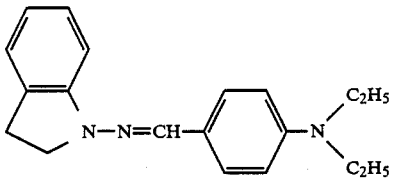
(VIII-3)
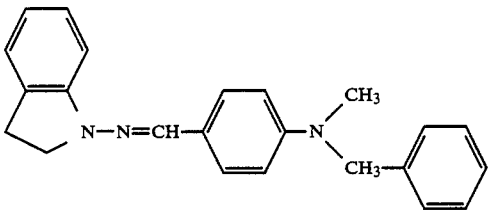
(VIII-4)
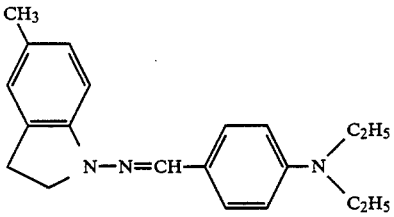

-continued
(VIII-5)
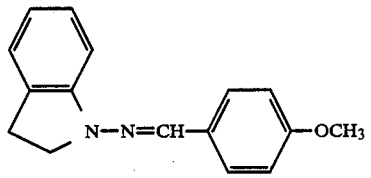
(VIII-6)
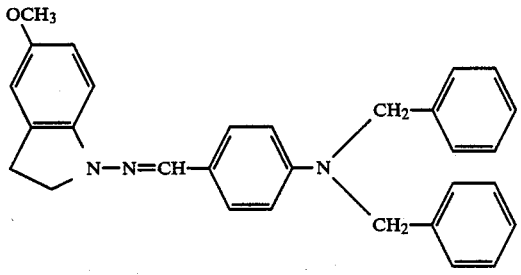
(VIII-7)
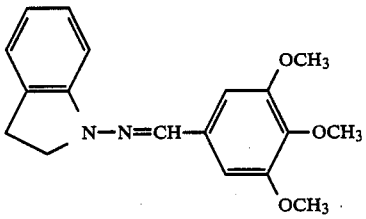
(VIII-8)
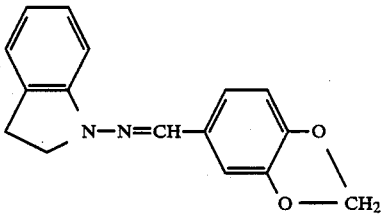
(VIII-9)
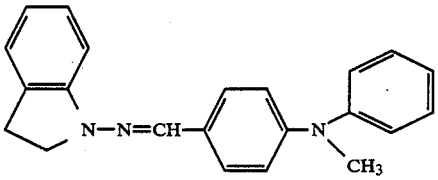
(VIII-10)
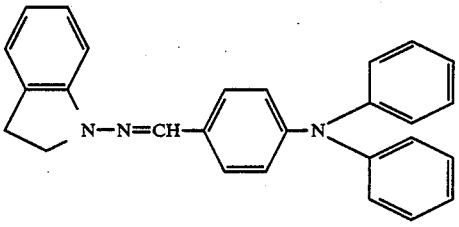
(VIII-11)
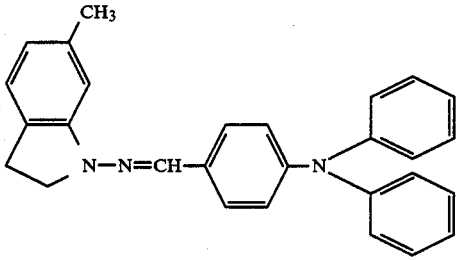

-continued
(VIII-12)
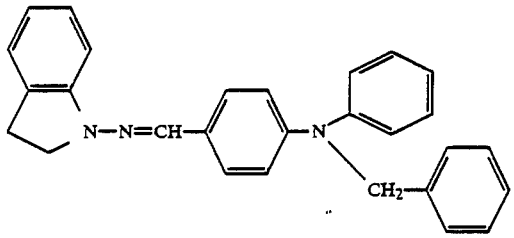
(VIII-13)
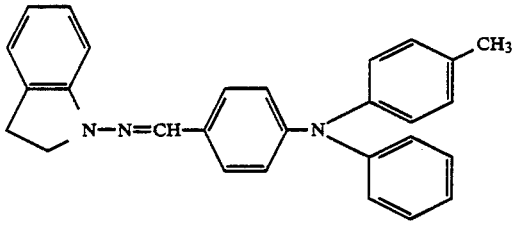
(VIII-14)
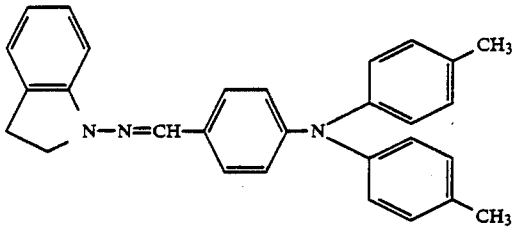
(VIII-15)
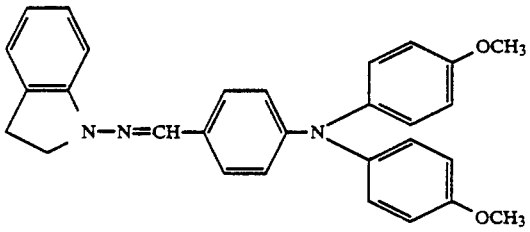
(VIII-16)
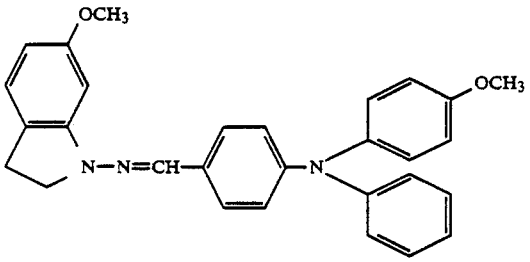
(VIII-17)
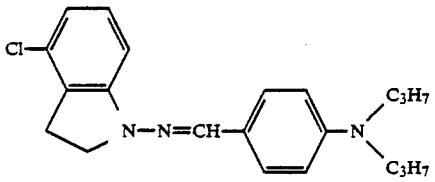

-continued
(VIII-18)
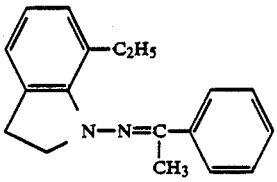
(VIII-19)
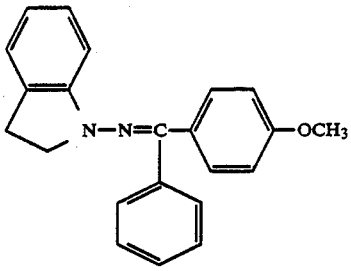
(VIII-20)
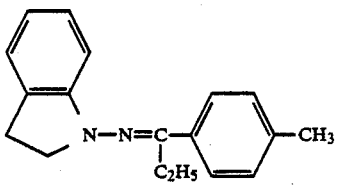
(VIII-21)
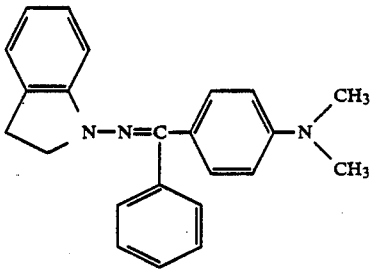
(VIII-22)
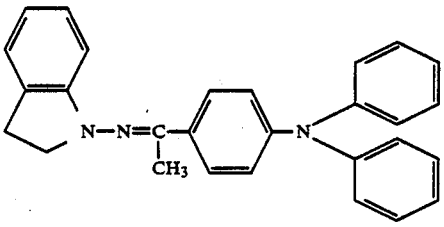
(VIII-23)
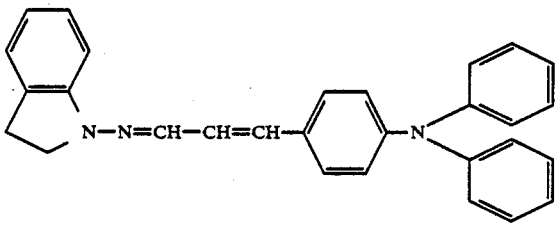

-continued
(VIII-24)
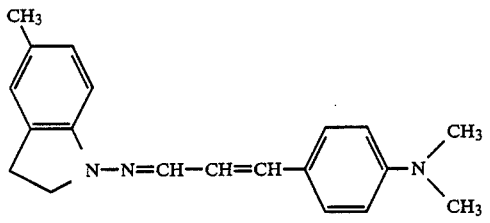
(VIII-25)
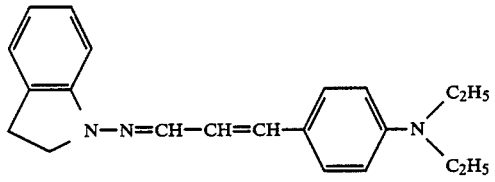
(VIII-26)
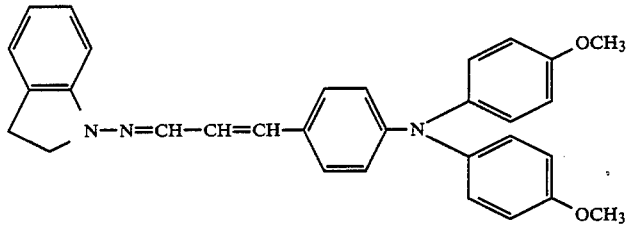
(VIII-27)
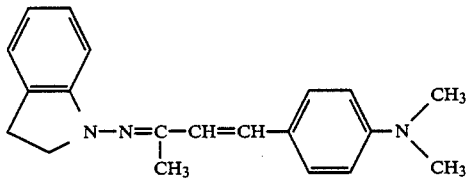
(VIII-28)
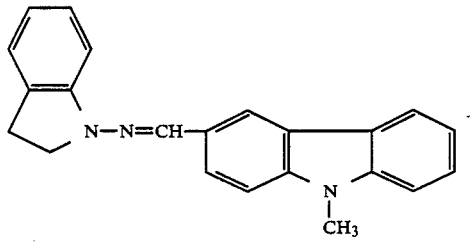
(VIII-29)
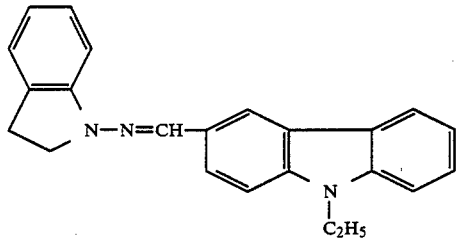

-continued
(VIII-30)
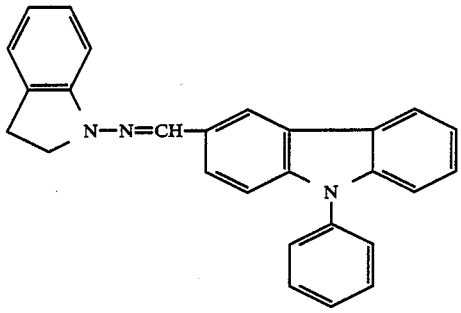
(VIII-31)
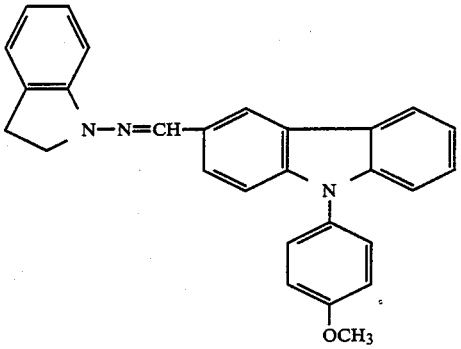
(VIII-32)
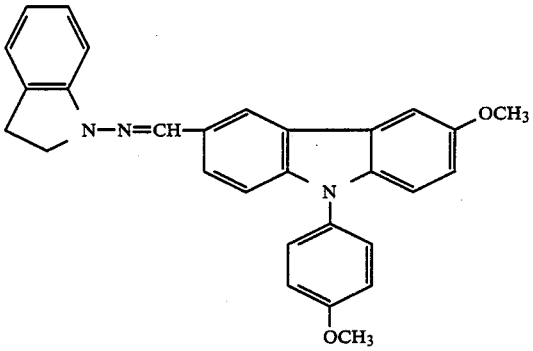
(VIII-33)
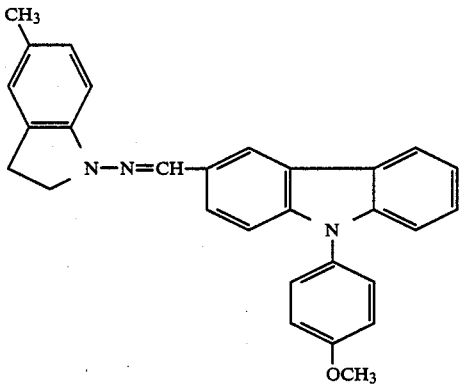

-continued
(VIII-34)
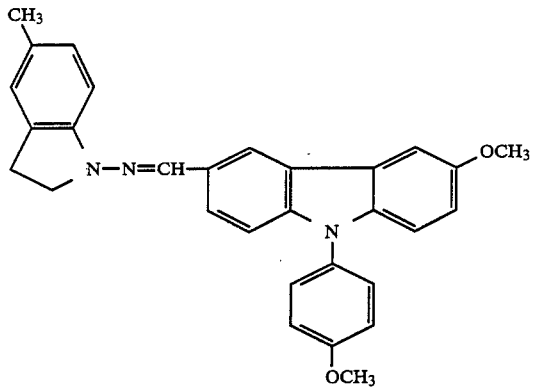
(VIII-35)
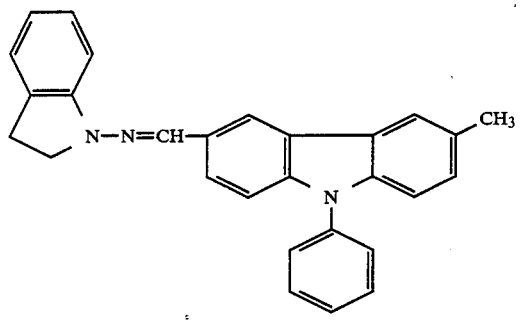
(VIII-36)
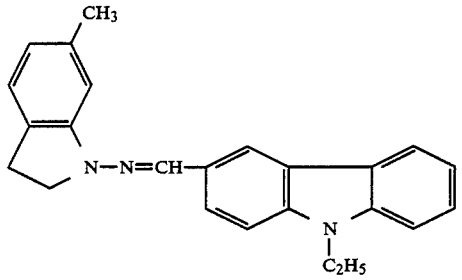
(VIII-37)
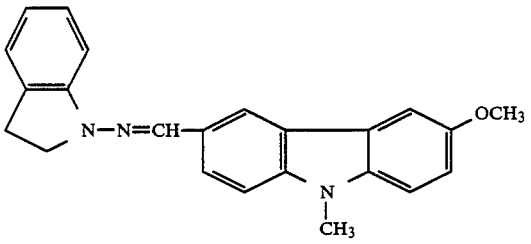
(VIII-38)
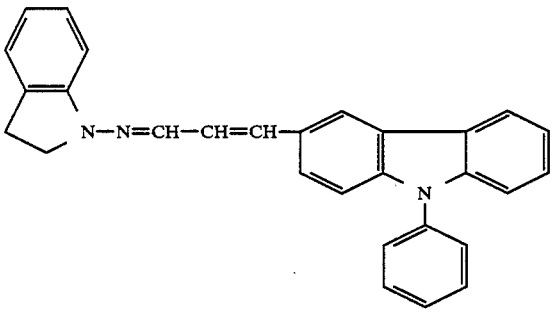

-continued
(VIII-39)
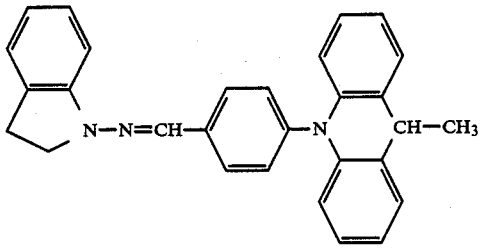
(VIII-40)
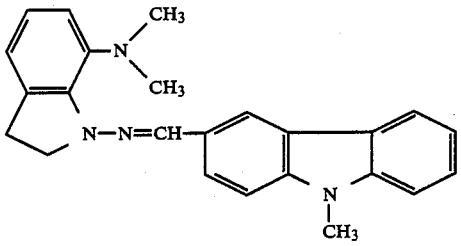
(VIII-41)
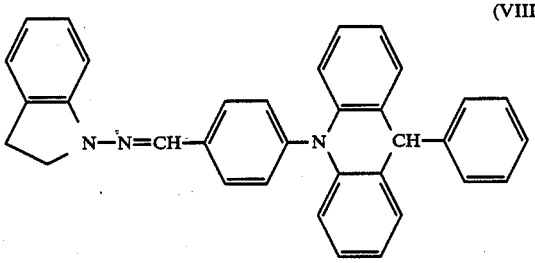
(VIII-42)
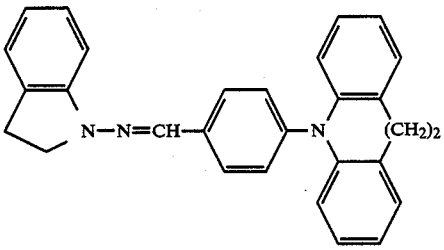
(VIII-43)
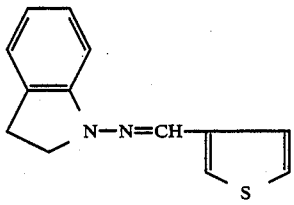
(VIII-44)
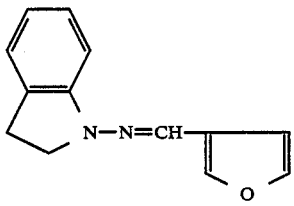
-continued
(VIII-45)
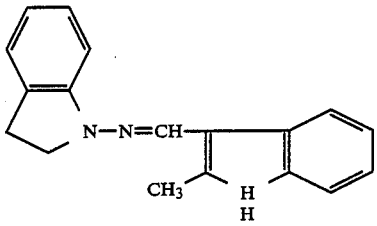
(VIII-46)
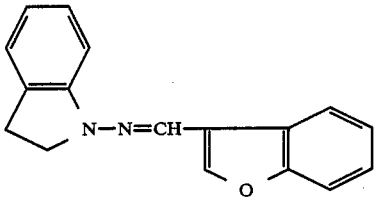
(VIII-47)
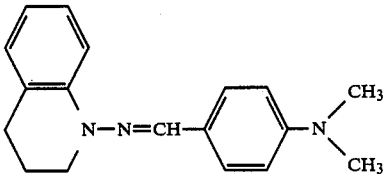
(VIII-48)
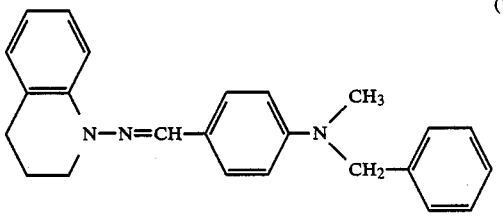

-continued
(VIII-49)
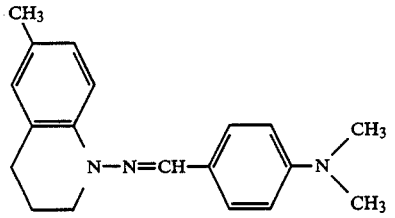
(VIII-50)
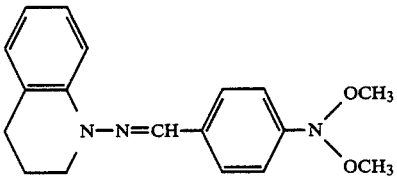
(VIII-51)
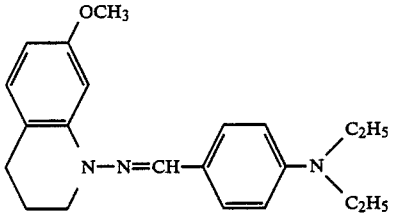
(VIII-52)
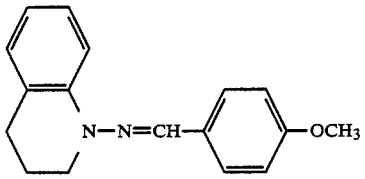
(VIII-53)
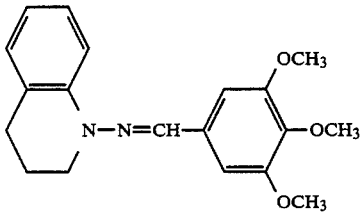
(VIII-54)
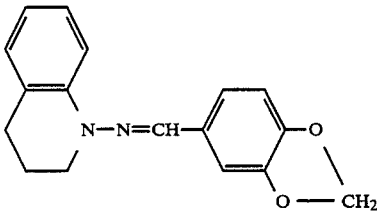
(VIII-55)
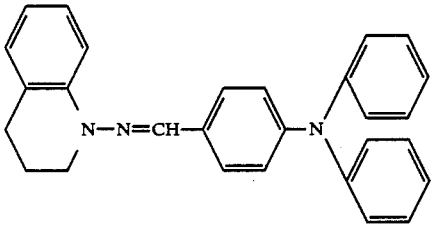
-continued
(VIII-56)
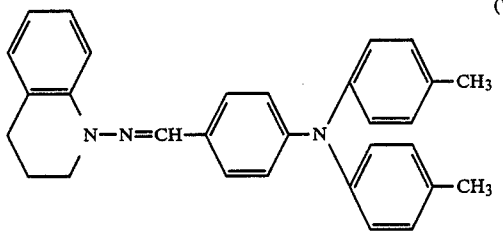
(VIII-57)
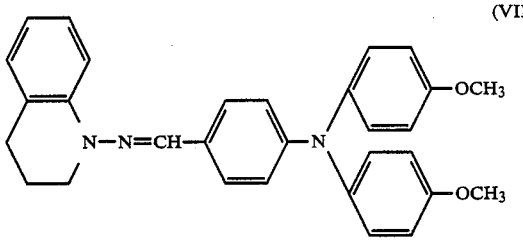
(VIII-58)
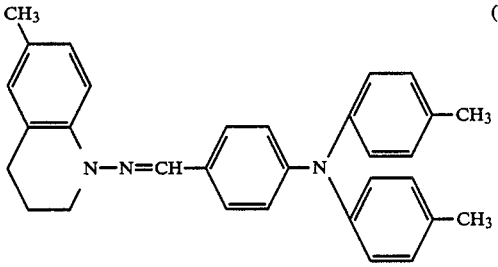
(VIII-59)
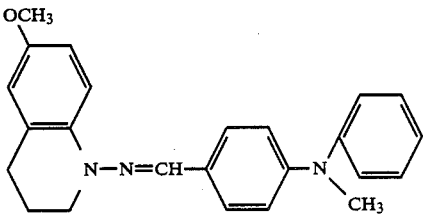
(VIII-60)
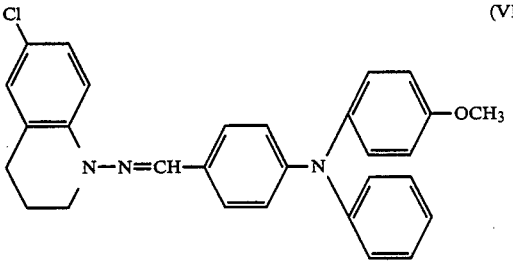
(VIII-61)
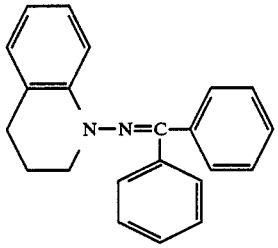

-continued
(VIII-62)
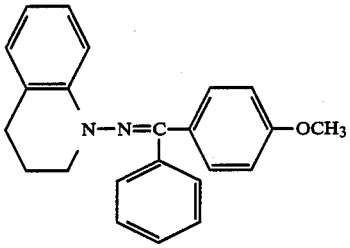
(VIII-63)
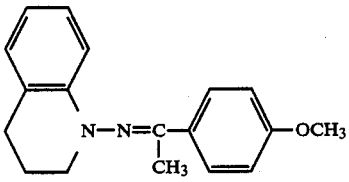
(VIII-64)
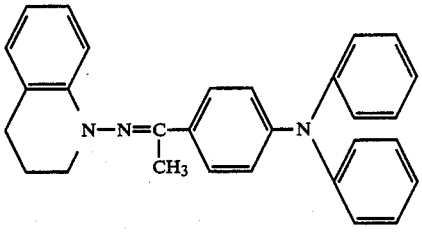
(VIII-65)
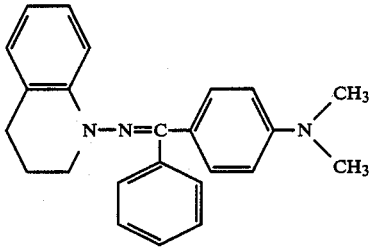
(VIII-66)
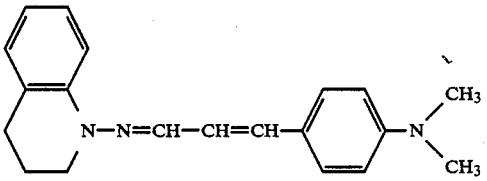
(VIII-67)
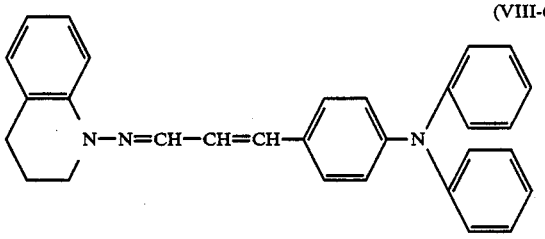
(VIII-68)
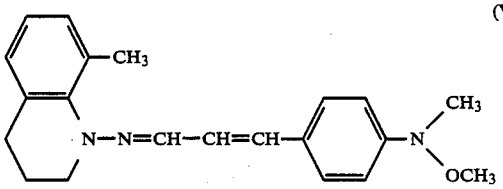
-continued
(VIII-69)
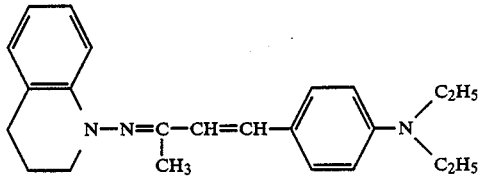
(VIII-70)
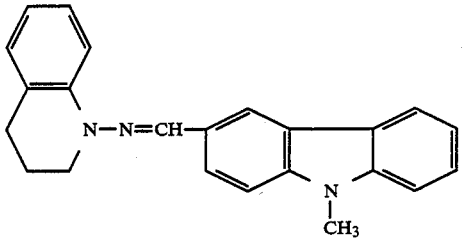
(VIII-71)
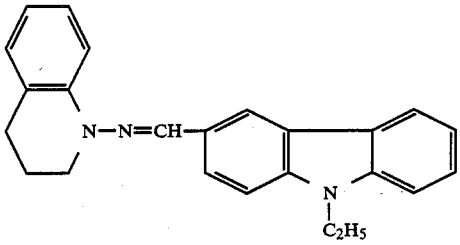
(VIII-72)
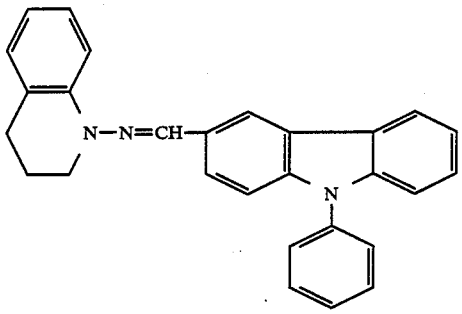
(VIII-73)
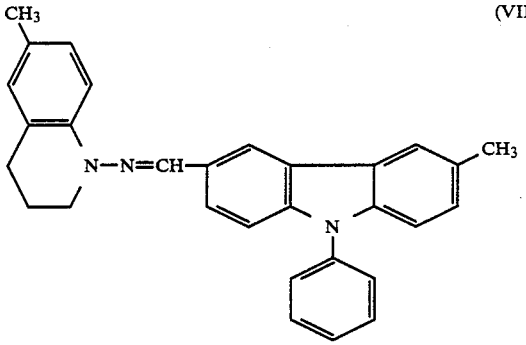

-continued
(VIII-74)
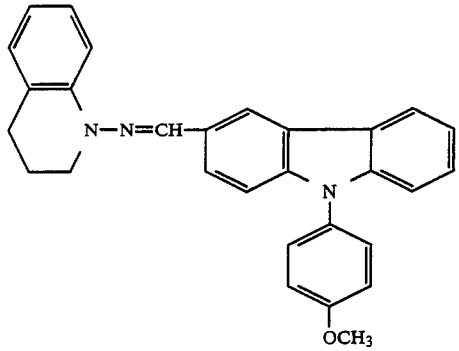
(VIII-75)
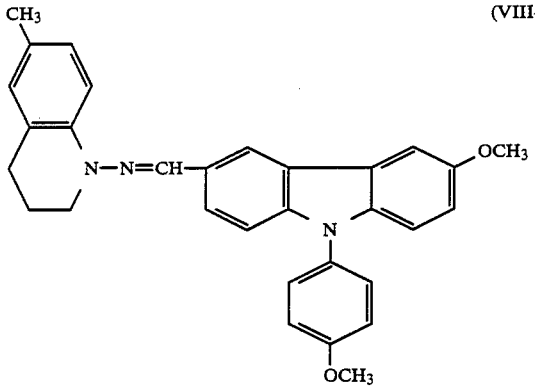
(VIII-76)
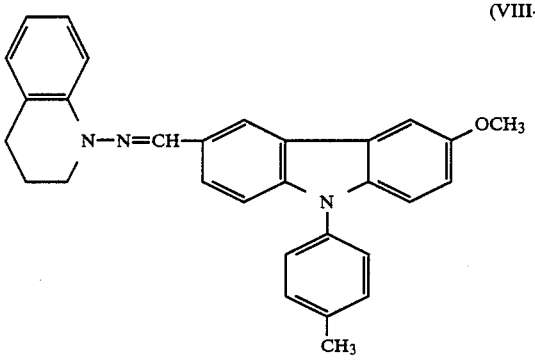
(VIII-77)
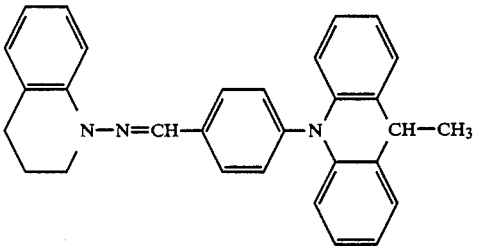
(VIII-78)
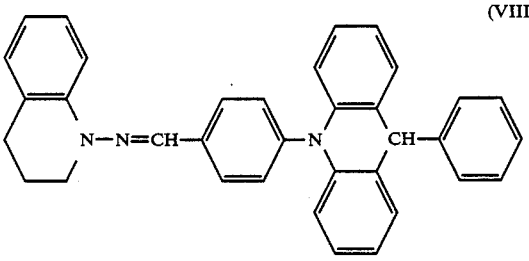
-continued
(VIII-79)
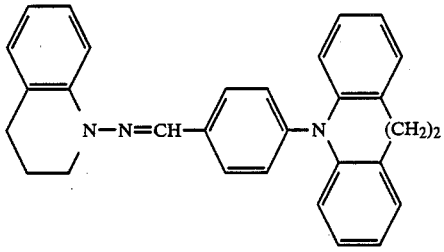
(VIII-80)
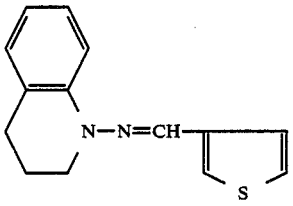
(VIII-81)
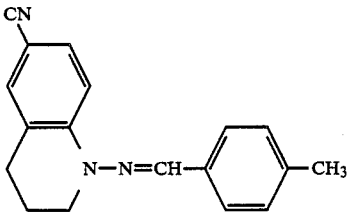
(VIII-82)
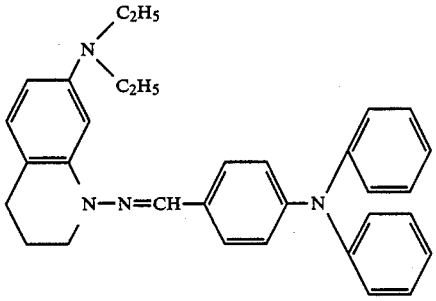
(VIII-83)
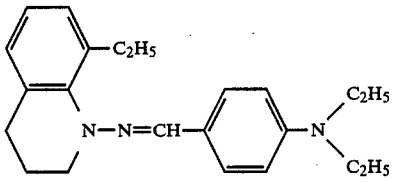
(VIII-84)
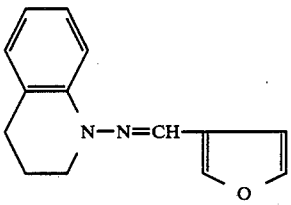

-continued (VIII-85)

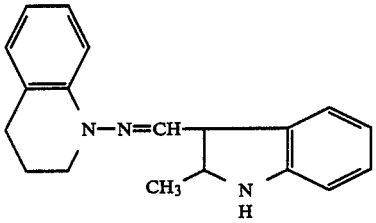

(VIII-86)

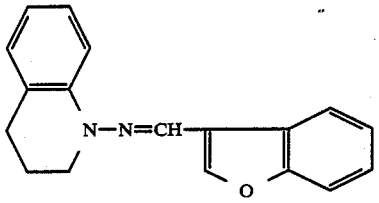

(VIII-87)

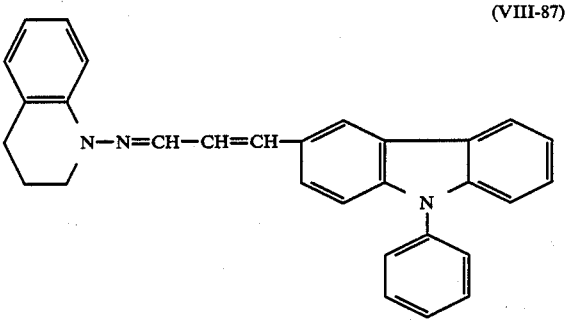

-continued (VIII-88)

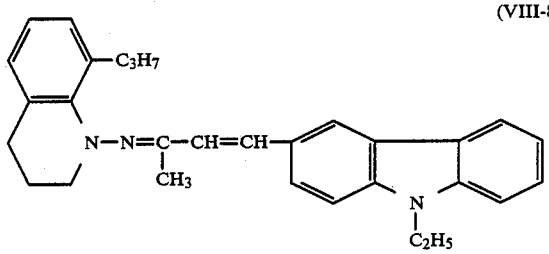

To serve as the carrier transporting substances, the pyrazoline compounds represented by the following formula [IX] can also be used:

Formula [IX]:

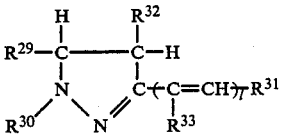

Wherein, l is zero or one;

$R^{29}$, $R^{30}$ and $R^{31}$ each represent a substituted or unsubstituted aryl group;

$R^{32}$ and $R^{33}$ each represent hydrogen, an alkyl group having one to four carbon atoms, or a substituted or unsubstituted aryl or aralkyl group; provided that $R^{32}$ and $R^{33}$ are not hydrogen at the same time, and $R^{32}$ is not hydrogen is l is zero.

Typical examples of the pyrazoline compounds are given below:

(IX-1)

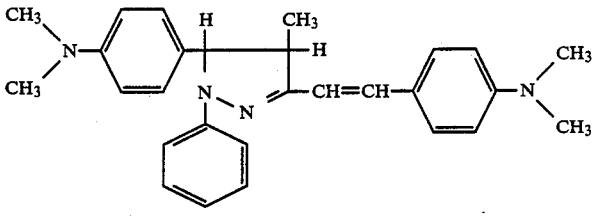

(IX-2)

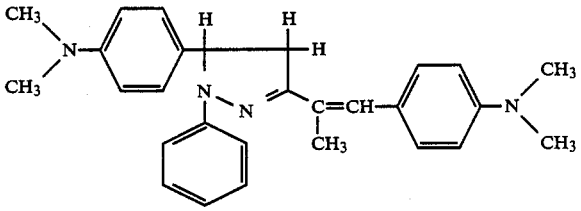

(IX-3)

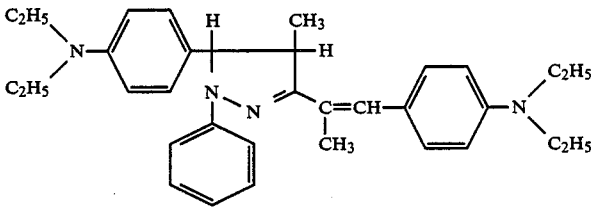

-continued
(IX-4)
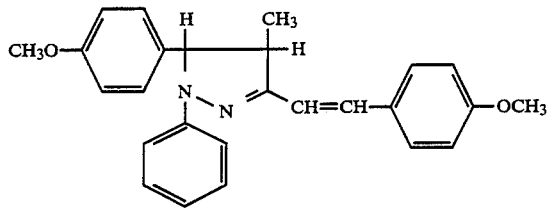
(IX-5)
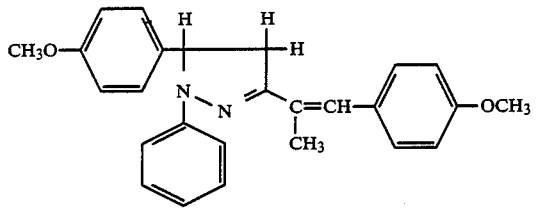
(IX-6)
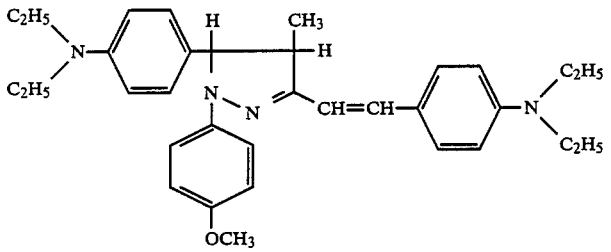
(IX-7)
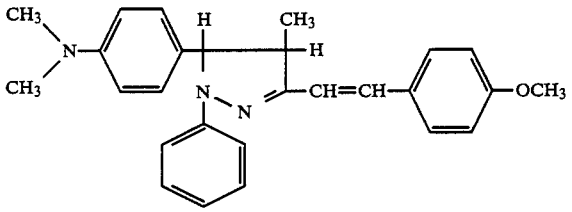
(IX-8)
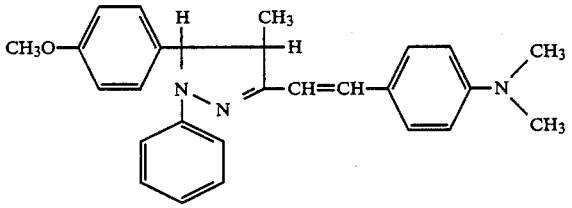
(IX-9)
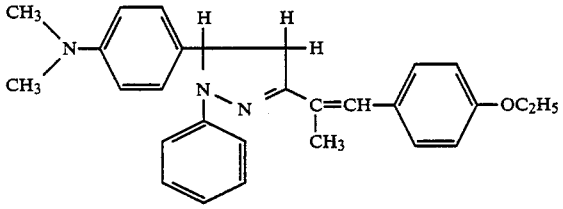
(IX-10)
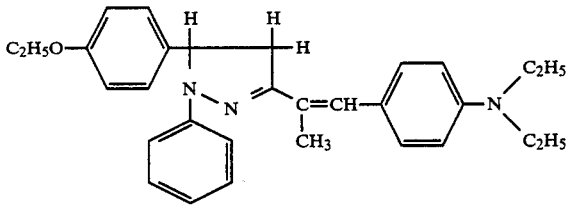

-continued
(IX-11)
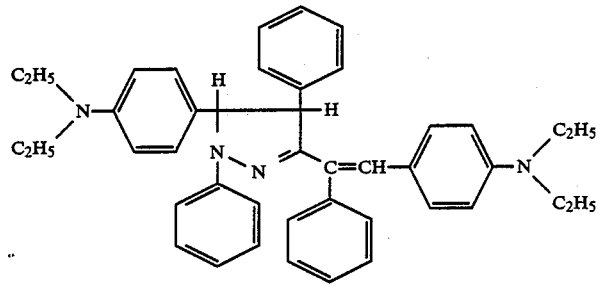
(IX-12)
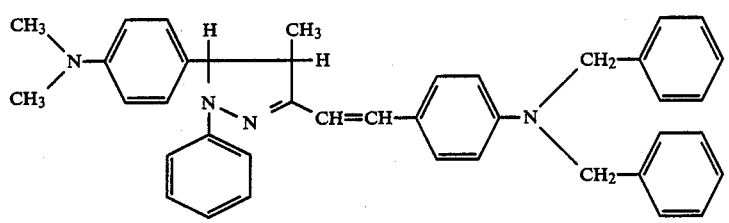
(IX-13)
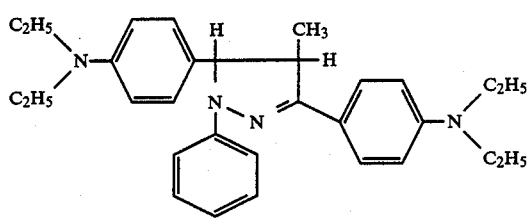
(IX-14)
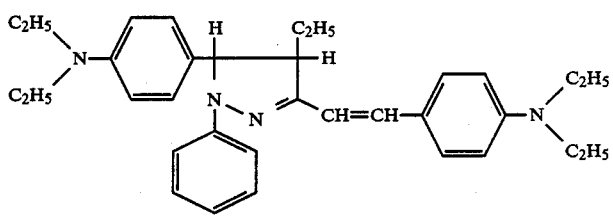
(IX-15)
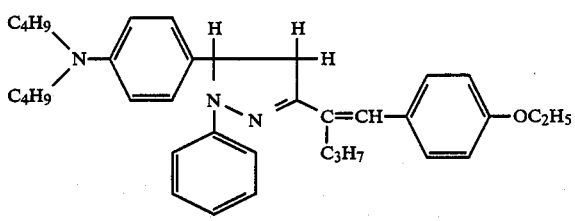
(IX-16)
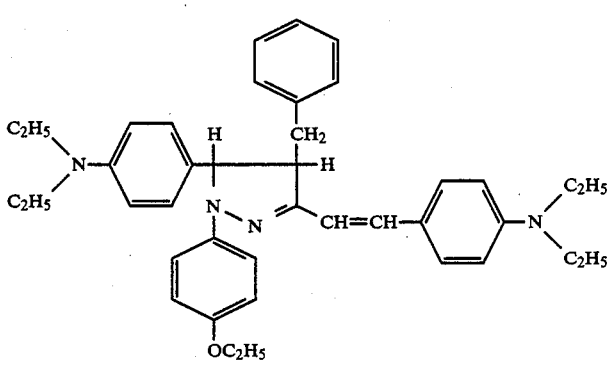

-continued (IX-17)

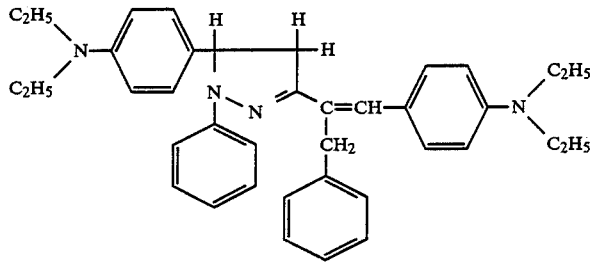

(IX-18)

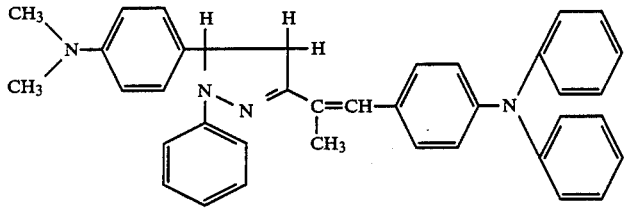

(IX-19)

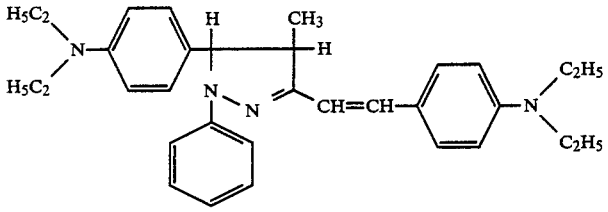

Further, the amine derivatives represented by the following formula [X] can also be used as the carrier transporting substances:

Formula [X]:

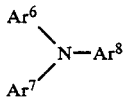

Wherein, $Ar^6$ and $Ar^7$ each represent a substituted or unsubstituted phenyl group; and a halogen, an alkyl group, nitro group or alkoxy group is used as the substituent;

$Ar^8$ represents a substituted or unsubstituted phenyl group, naphthyl group, anthryl group, fluorenyl group or heterocyclic ring group; and an alkyl group, an alkoxy group, a halogen, a hydroxyl group, an aryloxy group, an aryl group, an amino group, a nitro group, a piperidino group, a morpholino group, a naphthyl group, an anthryl group and a substituted amino group are used as the substituents, provided that an acyl group, an alkyl group, an aryl group and an aralkyl group are used as the substituents of the substituted amino group.

Typical examples of the amine derivatives are given below:

(X-1)

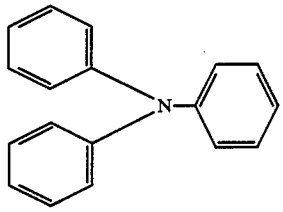

(X-2)

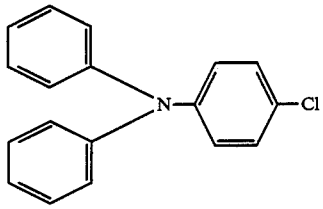

(X-3)

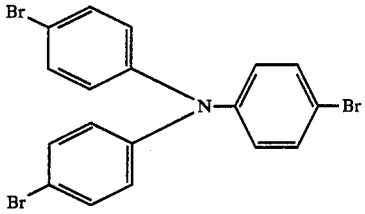

-continued
(X-4)
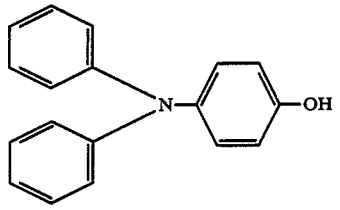
(X-5)
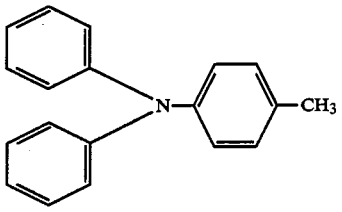
(X-6)
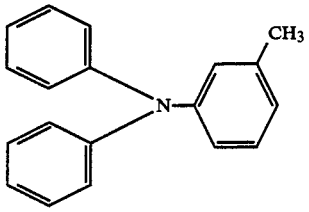
(X-7)
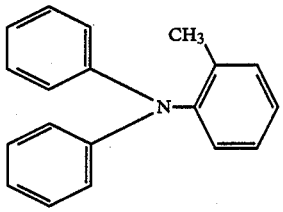
(X-8)
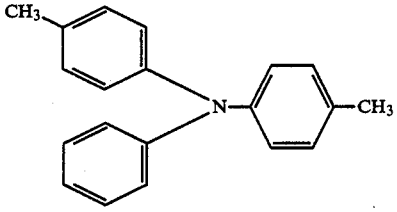
(X-9)
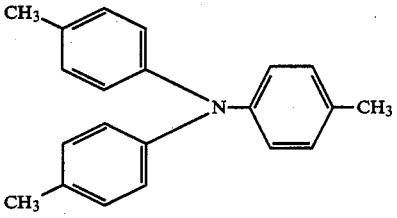
(X-10)
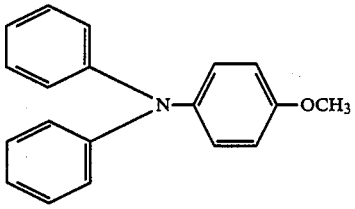
-continued
(X-11)
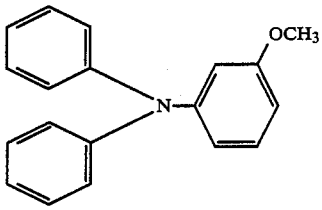
(X-12)
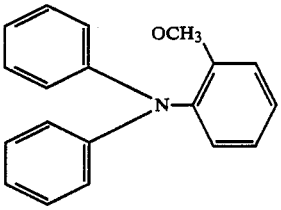
(X-13)
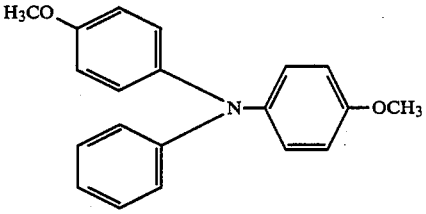
(X-14)
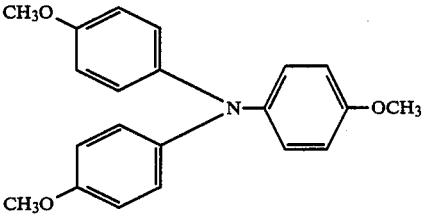
(X-15)
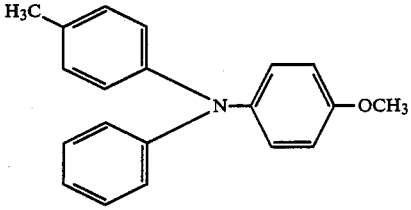
(X-16)
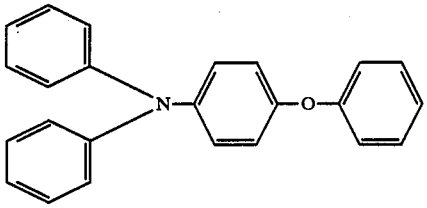
(X-17)
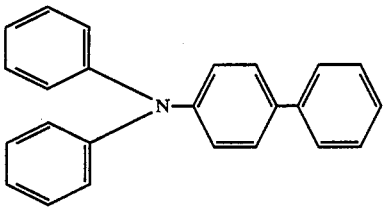

-continued
(X-18)
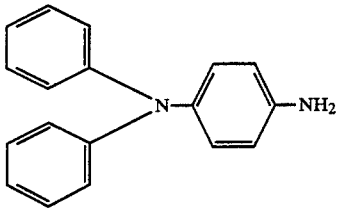
(X-19)
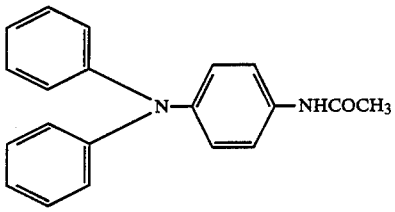
(X-20)
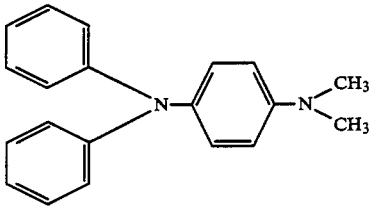
(X-21)
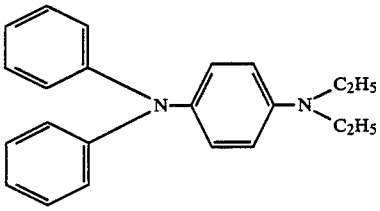
(X-22)
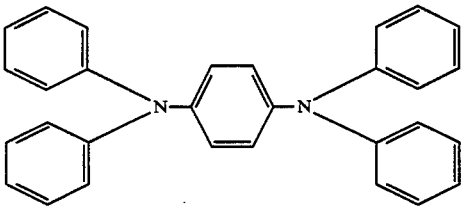
(X-23)
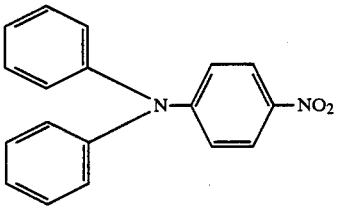
(X-24)
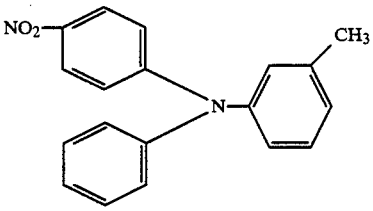
-continued
(X-25)
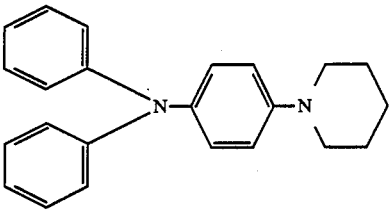
(X-26)
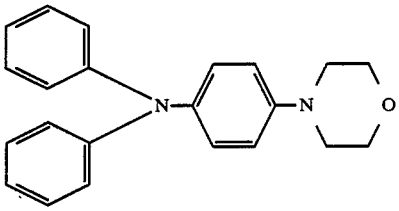
(X-27)
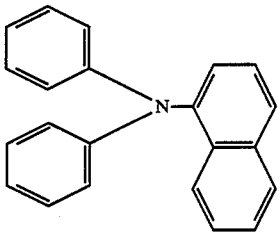
(X-28)
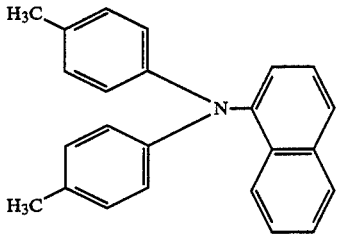
(X-29)
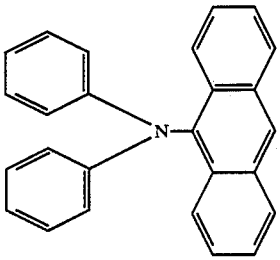
(X-30)
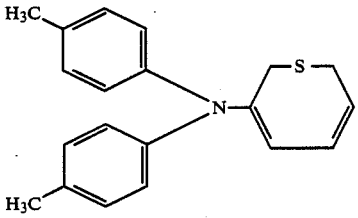

-continued (X-31)

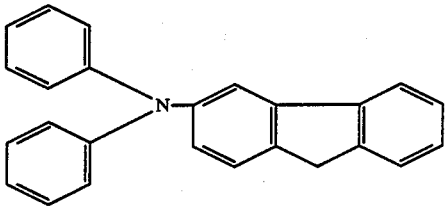

(X-32)

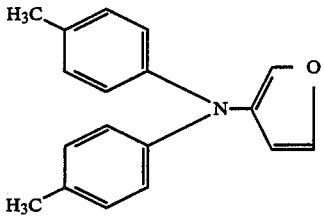

(X-33)

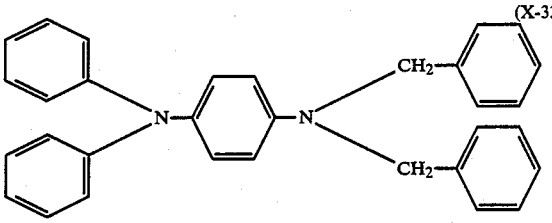

In the carrier generation layer of the photoreceptor relating to the invention, a photoreceptor for positive charge of which residual potential and receptive potential are less deteriorated can be provided, if the carrier generating substance is added in the binder substance in the amount within such a specific range of 20% to 50%=the carrier generating substance/the binder substance, i.e., 20 to 50 parts by weight by weight of the carrier generating substance to 100 parts by weight of the binder substance. If the above-mentioned range is deviated and the carrier substance is short, the photosensitivity will be lowered and the residual potential will be increased. If the carrier generating substance is too much, receptive potential will be apt to be more lowered. The contents of the carrier transporting substance are also an important factor. The desired proportion of the carrier transporting substance to the binder substance is from 20% to 200%, i.e., 20 to 200 parts by weight of the former to 100 parts by weight of the latter, and more desirably from 30 to 150 parts. When the proportion thereof is within this range, the residual potential is relatively less and the photosensitivity is excellent and further the solvent dissolvability of the carrier transporting substance can well be maintained. If the proportion is out of the range and the contents of the carrier transporting substance is less in the amount, the residual potential and the photosensitivity are apt to be deteriorated, and if the transporting substance is too much, the solvent-dissolvability is apt to be deteriorated. The range of the contents of the carrier transporting substance may also be applicable similarly to the case of the carrier transport layer.

In the carrier generation layer, the proportion of the carrier generating substance to the carrier transporting substance is desirably from 1:3 to 1:2 by weight, for the purpose of displaying the respective functions of each substance, effectively.

Binder substances, and among them binder resins in particular include, for example, an addition polymerization type resin, a polyaddition type resin and a polycondensation type resins such as polyethylene, polypropylene, acryl resin, methacryl resin, vinylcloride resin, vinylacetate resin, epoxy resin, polyurethane resin, phenol resin, polyester resin, alkyd resin, polycarbonate resin, silicone resin, melamine resin and the like; a copolymer resin containing two or more repetition units of the above-mentioned resins, such an insulating resin as vinly chloride-vinyl acetate copolymeric resin, vinyl chloride-vinyl acetate-maleic hydride copolymeric resin and the like; and besides, a high molecular organic semiconductor such as poly-N-vinyl carbazole and the like.

When an electrophotographic photoreceptor is so prepared as to be of the function-separation type, normally the constitution thereof is as shown in FIG. 1. Namely, such a photoreceptor comprises an electroconductive support 1 bearing thereon a photosensitive layer 4 laminated with a carrier generation layer of 1 μm in thickness prepared by dispersing the aforementioned particulate carrier generating substance 7 in a layer 6 containing the above-mentioned carrier transport substance as the principal ingredient thereof, and a carrier transport layer 3 comprising the above-mentioned carrier transporting substance. In the constitution shown in FIG. 1, it may also be allowed to provide an interlayer (not shown) between the electroconductive support 1 and the photosensitive layer 4.

When a photosensitive layer is formed by dispersing therein the above-mentioned particulate carrier generating substance, the carrier generating substance is to be of a particulate matter of not larger than 2 μm in the average particle size, and more preferable not larger than 1 μm. In other words, if the particle size thereof is too large, the dispersion thereof into the layer will be worsened and the smoothness of the layer surface will also be worsened, and further, in some cases, an electric discharge will be generated from the protruded portions of the particles, or toner particles will adhere to the protruded portion of the particles so that a toner filming phenomenon may be apt to cause. In a carrier generating substance having the sensitivity to a long wavelength up to 700 nm, it is assumed that the surface potential may be neutralized by generating a thermal excitation carrier in the carrier generating substance and also that the neutralization effect may be great when the particle size of the carrier generating substance is large. Accordingly, a high resistance and high sensitization cannot be achieved until the particle size is made minute. However, if the particle size is too minute, it is more harm than good, because a cohesion is apt to cause and the resistance of the layer is increased and further the sensitivity and the repetition property are lowered, so as to limit to make the particles minute. It is, therefore, desired to limit a minimum average particle size to 0.01 μm.

Such photosensitive layers can be prepared in the following process. The process is that the aforementioned carrier generating substance is made into fine particles in dispersion medium by means of a ball mile, a homogenizer or the like, and a binder resin an a carrier transporting substance are added to make a mixed dispersion, and the resulting dispersion solution is coated on. In this process, if the particles are dispersed under the application of ultrasonic wave, a uniform dispersion can be performed. The carrier transport layer can also be formed by coating thereon with the solution of the carrier transporting substance.

Dispersion media to be used for forming the above-mentioned layers include, for example, N,N-dimethyl formamide, benzene, toluene, xylene, 1,2-dichlorethane, dichloromethane, tetrahydrofuran, and the like.

In the case of using a binder resin for forming a photosensitive layer, any of the binder resins may be used, and among them, an electric-insulating film-forming high molecular polymers which are hydrophobic and high in electric permitivity is particularly preferable to use.

In addition, for the purpose of improving the sensitivity, and reducing the residual potential and/or the fatigue caused by using repeatedly, the above-mentioned photosensitive layer may be able to contain one or more kinds of electron receptive substances. Such electron receptive substances include, for example, succinic anhydride, maleic anhydride, derbomomaleic anydride, phthalic anhydride, tetrachlorophthalic anhydride, tetrabromophthalic anhydride, 3-nitrophthalic anhydride, 4-nitrophthalic anhydride, pyromellitic anhydride, mellitic anhydride, tetracyanoethylene, tetracyanoquinodimethane, o-dinitrilobenzene, m-dinitrilobenzene, 1,3,5-trinitronbenzene, paranitrobenzonitrile, picrylchloride, quinonechlorimide, chloranil, bromanil, dichlorodicyanoparabenzoquinone, anthraquinone, dinitroanthraquinone, 9-fluorenyliden[-dicyanomethylenemalonodinitrile], polynitro-9-fluorenylidene-[dicyanomethylenemalonodinitrile], picric acid, o-nitrobenzoic acid, p-nitrobenzoic acid, 3,5-dinitrobenzoic acid, pentafluorobenzoic acid, 5-nitrosalicylic acid, 3,5-dinitrosalicylic acid, phthalic acid, mellitic acid, and other compounds having a great electron-affinity. The proportion of the electron receptive substance to the carrier generating substance is 0.01 to 200:100 by weight and preferably 0.1 to 100:100 by weight.

As for the supports 1 to be provided with the above-mentioned photosensitive layer, a metal plate, a metal drum, or a support of which the substance such as a sheet of paper, plastic film or the like coated, evaporated or laminated with an electroconductive thin layer comprising an electroconductive polymer, electroconductive compound such as indium oxide, or a metal such as aluminium, palladium, gold or the like, are used. As for the interlayers which are to function as an adhesive layer or a barrier layer, there are used those interlayers comprising a high molecular polymer, an organic high molecular substance such as polyvinyl alcohol, ethyl cellulose, carboxymethyl cellulose and the like, or aluminium oxide, and the like, which were described as the aforementioned binder resins.

EXAMPLE

Now, a typical example of the invention will be described in detail, with reference to a comparative example:

There was formed an interlayer of 0.05 μm in thickness comprising an electroconductive support comprising a polyester film laminated with an aluminium foil bearing thereof vinyl chloride-vinyl acetate-maleic anhydride copolymer, [Eslec MF-10, manufacturd by Sekisui Chemical Co.]. Next, the carrier transporting substance and the binder resin each shown in FIG. 2 were dissolved in 67 ml of 1,2-dichloroethane. The resulting solution was coated over the interlayer, so that a carrier transport layer was prepared. After then, both of the carrier generating substances each and the carrier transporting substances each having the specific particle sizes indicated in FIG. 2, and the binder resins were added in 67 ml of 1,2-dichloroethane and dispersed by a ball mill for 12 hours. The resulting solution was coated over the above-mentioned carrier transport layer and dried up so as to form a carrier generation layer. Thus, each of the electrophotographic photoreceptors were prepared.

The electrophotographic photoreceptors were tried on an electrostatic test machine [SP-428, manufactured by Kawaguchi Electric Mfg. Co.], and the characteristics tests tereof were carried out, respectively. To be more concrete, in each of the tests, a photosensitive layer was electrically charged by applying a corona discharge for 5 seconds after applying a +6 KV voltage to an electric charger, and was then allowed to stand for 5 seconds, (the voltage at this point of time is called $V_I$). Next, the surface of the photosensitive layer was irradiated with light from a tungsten lamp in the state that the illuminance thereon was at 35 lux, so as to obtain an exposure amount necessary for attenuating the surface potential of the photosensitive layer to a half, that was a half attenuation exposure amount, $E\frac{1}{2}$. Measurememts were made for the receptive voltage $V_A$ at the initial stage where the charging was made by the above-mentioned corona discharge and the receptive voltage after 10,000 copies were made. And, the measurements were made for the dark decay rate, $(V_A-V_I)/V_I\times 100(\%)$, and the exposure quantity, $E_{50}{}^{500}$(lux·sec.) which is necessary for attenuating the initial voltage $V_I$ from −500(V) to −50(V).

According to the results obtained, it can be found that the samples (No. 1 through No. 10) of the example based on the invention can display considerably excellent electrophotographic characteristics in comparison with the comparative examples No. 1 through 4.

What is claimed is:

1. A photoreceptor comprising a carrier generation layer and a carrier transport layer, wherein said carrier generation layer contains an organic carrier generating substance having a photosensitivity at a time of negative charging which is higher than that at a time of positive charging, a carrier transporting substance selected from the group consisting of an oxazole derivative, an oxadiazole derivative, a thiazole derivative, a thiadiazole derivative, a triazole derivative, an imidazole derivative, an imidazolone derivative, an imidazolidine derivative, a bisimidazolidine derivative, a styryl compound, a hydrazone compound, a pyrazoline derivative, an oxazolone derivative, a benzothiazole derivative, a benzimidazole derivative, a quinazoline derivative, a benzofuran derivative, an acridine derivative, a phenazine derivative, an aminostilbene derivative, poly-N-vinylcarbazole, poly-1-vinylpyrene and poly-9-vinylanthracene, and a binder, said carrier generation layer having a thickness of 1 to 10 μm, said carrier transport layer comprising a carrier transport substance and a binder, said carrier transport layer being formed on the lower surface of said carrier generation layer.

2. The photoreceptor of claim 1, wherein the thickness of said carrier generation layer is more than 3 μm.

3. The photoreceptor of claim 1, wherein the thickness of said carrier transport layer is in the range of from 5 μm to 50 μm.

4. The photoreceptor of claim 3, wherein the ratio of the thickness of said carrier generation layer Tg against said carrier transport layer Tt, Tg:Tt, is 1:(1 to 30).

5. The photoreceptor of claim 1, wherein said carrier generating substance is a substance represented by a formula selected from the group consisting of

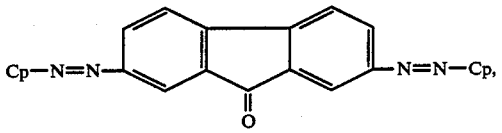

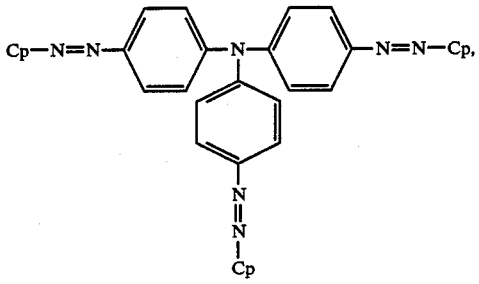

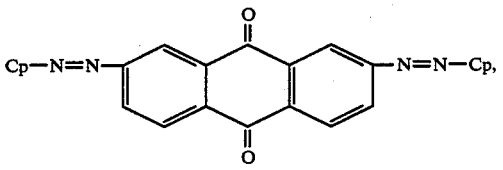

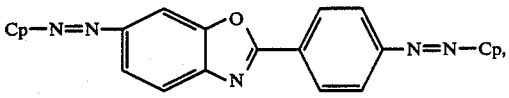

$Cp—N=N—Ar_1—CH=CH—Ar_2—N=N—Cp,$ $Cp—N=N—Ar_1—CH=CH—Ar_2—CH=CH—Ar_3—N=N—Cp,$

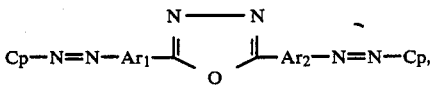

(Wherein, $Ar_1$, $Ar_2$ and $Ar_3$ each represent a substituted or unsubstituted carbocyclic compounds, respectively; Cp is

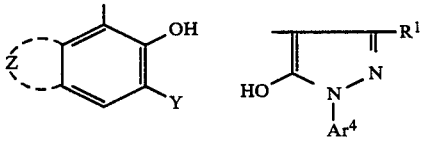

-continued

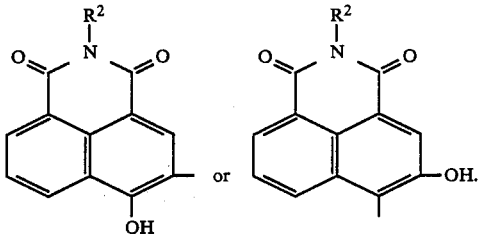

wherein Z is a group of atoms necessary for forming a substituted or unsubstituted aromatic carbocyclic ring or a substituted or unsubstituted aromatic heterocyclic ring; Y is hydrogen, a hydroxyl group, carboxyl group or any of the ester groups thereof, a sulfo group, a substituted or unsubstituted carbamoyl group, or a substituted or unsubstituted sulfamoyl group; $R^1$ is hydrogen, a substituted or unsubstituted alkyl group, a substituted or unsubstituted amino group, a substituted or unsubstituted carbamoyl group, a carboxyl group or any of the ester groups thereof, or a cyano group; $Ar^4$ is a substituted or unsubstituted aryl group; and $R^2$ is a substituted or unsubstituted alkyl group, a substituted or unsubstituted aralkyl group, or substituted or unsubstituted aryl group)

$A—N=N—Ar^5—N=N—Ar^6—N=N—A,$ $A—N=N—Ar^5—N=N—Ar^6—N=N—Ar^7—N=N—A,$ (Wherein, $Ar^5$, $Ar^6$ and $Ar^7$ are a substituted or unsubstituted carbocyclic aromatic ring group; A is

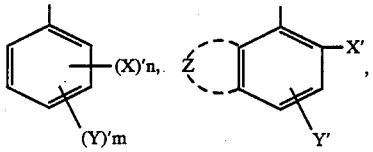

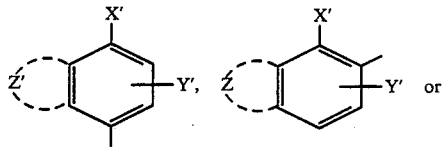

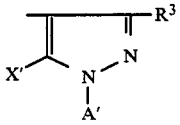

wherein

X' is a hydroxy group,

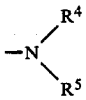

or $—NHSO_2—R^6$, wherein $R^4$ and $R^5$ are hydrogen, or a substituted or unsubstituted alkyl group; and $R^6$ is a substituted or unsubstituted alkyl group or a substituted or unsubstituted aryl group, Y' is hydrogen, a halogen, a substituted or unsubstituted alkyl group, an alkoxy group, a carboxy group, a sulfo group, a substituted or unsubstituted carbamoyl group, or a substituted or unsubstituted sulfamoyl group, in which if m represents not less than two the groups are allowed to be different from each other;

Z' is a group of atoms necessary for forming a substituted or unsubstituted carbocyclic aromatic ring or a substituted or unsubstituted heterocyclic aromatic ring; $R^3$ is a hydrogen, a substituted or unsubstituted amino group, a substituted or unsubstituted carbamoyl group, or a carboxyl group or any of the ester groups thereof;

A' is a substituted or unsubstituted aryl group;

n is an integer of one or two; and m is an integer of from zero to four)

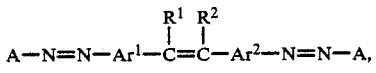

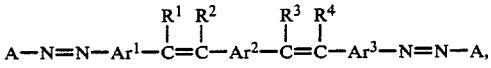

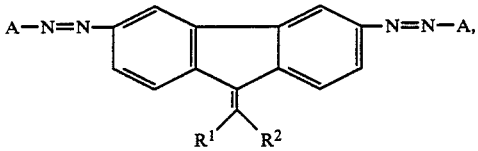

(Wherein, $Ar^1$, $Ar^2$ and $Ar^3$ each are a substituted or unsubstituted carbocyclic aromatic ring group; $R^1$, $R^2$, $R^3$ and $R^4$ each are an electron withdrawing group or hydrogen, and at least one of the $R^1$ through $R^4$ is an electron withdrawing group such as a cyano group; A is

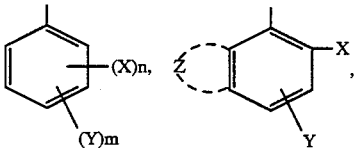

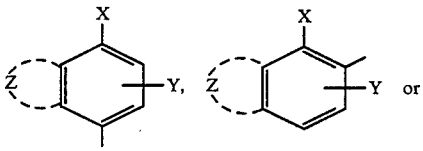

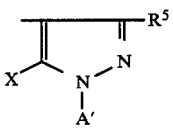

wherein,

X is a hydroxy group,

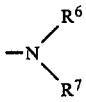

or $—NHSO_2—R^8$ provided that $R^6$ and $R^7$ each are hydrogen, or a substituted or unsubstituted alkyl group and $R^8$ is a substituted or unsubstituted alkyl group or a substituted or unsubstituted aryl group;

Y is hydrogen, a halogen, a substituted or unsubstituted alkyl group, an alkoxy group, a carbosyl group, a sulfo group, a substituted or unsubstituted carbamoyl group or a substituted or unsubstituted sulfamoyl group, in which if m represents not less than two the groups are allowed to be different from each other Z is a group of atoms necessary for forming a substituted or unsubstituted carbocyclic aromatic ring or a substituted or unsubstituted heterocyclic aromatic ring;

$R^5$ is hydrogen, a substituted or unsubstituted amino group, a substituted or unsubstituted carbamoyl group, or a carboxyl group or any of the ester group thereof;

A' is a substituted or unsubstituted aryl group;

n is an integer of one or two; and m is an integer of from zero to four)

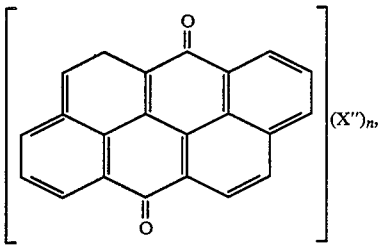

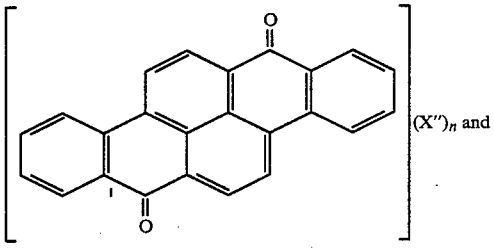

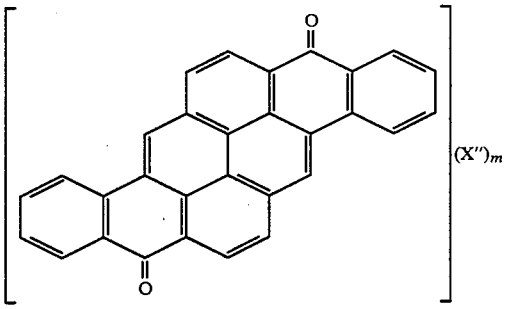

wherein, X'' represents a halogen, nitro group, cyano group, acyl group or carboxyl group; n is an integer of from zero to 4; and m is an integer of from zero to 6).

6. The photoreceptor of claim 1, wherein said carrier generation layer contains said carrier generating substance in the amount of 20% to 50% by weight of said binder and said carrier transporting substance in the amount of 20% to 200% by weight of said binder.

7. The photoreceptor of claim 6, wherein the weight ratio of said carrier generating substance Sg and said carrier transporting substance St in said carrier generation layer, Sg:St, is 1:(2 to 3).

8. The photoreceptor of claim 1, wherein said carrier generating substance is dispersed in said carrier generation layer as particles whose diameter is less than 2 μm.

9. The photoreceptor of claim 6 wherein said binder is selected from the group consisting of an addition polymerization type resin, a polyaddition type resin and a polycondensation type resin such as polyethylene, polypropylene, acryl resin, methacryl resin, vinylchloride resin, vinylacetate resin, epoxy resin, polyurethane resin, phenol resin, polyester resin, alkyl resin, polycarbonate resin, silicone resin, melamine resin, a copolymer resin containing two or more repetition units of the above-mentioned resins, such as an insulating resin as vinylchloride-vinyl acetate copolymeric resin, vinyl chloride-vinyl acetate-maleic hydride copolymeric resin, and a high molecular organic semiconductor such as poly-N-vinyl carbazole.

* * * * *